US009756426B2

(12) United States Patent
Tsutsumi et al.

(10) Patent No.: US 9,756,426 B2
(45) Date of Patent: Sep. 5, 2017

(54) LOUDSPEAKER

(71) Applicant: Panasonic Intellectual Property Management Co., Ltd., Osaka (JP)

(72) Inventors: Hiroko Tsutsumi, Mie (JP); Koichi Nakayama, Mie (JP); Satoshi Koura, Okayama (JP); Kazuhiro Oshika, Mie (JP); Mitsukazu Kuze, Okayama (JP); Tomonori Shibuya, Okayama (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/023,383

(22) PCT Filed: Aug. 17, 2015

(86) PCT No.: PCT/JP2015/004073

§ 371 (c)(1),
(2) Date: Mar. 19, 2016

(87) PCT Pub. No.: WO2016/035263

PCT Pub. Date: Mar. 10, 2016

(65) Prior Publication Data

US 2016/0219371 A1 Jul. 28, 2016

(30) Foreign Application Priority Data

Sep. 1, 2014 (JP) ..... 2014-176833
Sep. 2, 2014 (JP) ..... 2014-177638
(Continued)

(51) Int. Cl.
*H04R 9/06* (2006.01)
*H04R 7/04* (2006.01)
(Continued)

(52) U.S. Cl.
CPC ..... *H04R 9/063* (2013.01); *H04R 7/04* (2013.01); *H04R 1/24* (2013.01); *H04R 7/127* (2013.01);
(Continued)

(58) Field of Classification Search
CPC . H04R 1/24; H04R 9/063; H04R 7/04; H04R 7/24; H04R 7/16; H04R 7/127;
(Continued)

(56) References Cited

U.S. PATENT DOCUMENTS

2007/0140519 A1 6/2007 Fukuyama et al.
2009/0217509 A1 9/2009 Fukuyama et al.
(Continued)

FOREIGN PATENT DOCUMENTS

JP 55-152764 U 11/1980
JP 56-079098 U 6/1981
(Continued)

OTHER PUBLICATIONS

International Search Report of PCT application No. PCT/JP2015/004073 dated Nov. 10, 2015.

*Primary Examiner* — Tuan D Nguyen
(74) *Attorney, Agent, or Firm* — McDermott Will & Emery LLP

(57) ABSTRACT

A loudspeaker includes a diaphragm body having a dome shape protruding upwardly, a magnetic circuit disposed below the diaphragm body, a voice coil coupled to the diaphragm body, an edge coupled to an outer circumference of the diaphragm body, and a frame coupled to the edge. The edge includes a first coupling portion provided at an outer circumference of the edge, a second coupling portion provided at an inner circumference of the edge and coupled to an outer circumference of the diaphragm body, and a roll portion disposed between the first coupling portion and the
(Continued)

second coupling portion. The edge has a surface facing downward. The frame has a connecting surface disposed below the second coupling portion and coupled to the surface of the edge at the first coupling portion of the edge. This loudspeaker can decrease distortion of sound.

17 Claims, 40 Drawing Sheets

(30) Foreign Application Priority Data

Sep. 2, 2014 (JP) ..... 2014-177639
Sep. 2, 2014 (JP) ..... 2014-177640
Sep. 2, 2014 (JP) ..... 2014-177641

(51) Int. Cl.

| | |
|---|---|
| *H04R 1/24* | (2006.01) |
| *H04R 7/22* | (2006.01) |
| *H04R 9/02* | (2006.01) |
| *H04R 7/12* | (2006.01) |
| *H04R 7/16* | (2006.01) |
| *H04R 7/24* | (2006.01) |

(52) U.S. Cl.
CPC ..... *H04R 7/16* (2013.01); *H04R 7/22* (2013.01); *H04R 7/24* (2013.01); *H04R 9/02* (2013.01); *H04R 2209/022* (2013.01); *H04R 2209/024* (2013.01); *H04R 2209/027* (2013.01); *H04R 2307/207* (2013.01); *H04R 2400/07* (2013.01); *H04R 2400/11* (2013.01)

(58) Field of Classification Search
CPC ..... H04R 7/22; H04R 9/02; H04R 2307/207; H04R 2209/027; H04R 2400/11; H04R 2400/07; H04R 2209/022; H04R 2209/024
See application file for complete search history.

(56) References Cited

U.S. PATENT DOCUMENTS

| | | | | |
|---|---|---|---|---|
| 2009/0262972 | A1 | 10/2009 | Yuasa | |
| 2011/0299718 | A1* | 12/2011 | Williamson | H04R 7/16 381/423 |
| 2013/0315435 | A1* | 11/2013 | Sato | H04R 7/02 381/412 |

FOREIGN PATENT DOCUMENTS

| | | | |
|---|---|---|---|
| JP | 59-001035 | B | 1/1984 |
| JP | 61-166689 | U | 10/1986 |
| JP | 61-195189 | U | 12/1986 |
| JP | 62-013197 | | 1/1987 |
| JP | 63-120588 | | 5/1988 |
| JP | 5-137194 | | 6/1993 |
| JP | 2001-136595 | | 5/2001 |
| JP | 2005-073129 | | 3/2005 |
| WO | 2005/099305 | | 10/2005 |

* cited by examiner

LOUDSPEAKER

CROSS-REFERENCE TO RELATED APPLICATIONS

This application is a U.S. national stage application of the PCT International Application No. PCT/JP2015/004073 filed on Aug. 17, 2015, which claims the benefit of foreign priority of Japanese patent applications 2014-176833 filed on Sep. 1, 2014, 2014-177638 filed on Sep. 2, 2014, 2014-177639 filed on Sep. 2, 2014, 2014-177640 filed on Sep. 2, 2014, and 2014-177641 filed on Sep. 2, 2014, the contents all of which are incorporated herein by reference.

TECHNICAL FIELD

The present invention relates to a loudspeaker mounted to various audio apparatuses.

BACKGROUND ART

PTL 1 discloses a conventional loudspeaker which includes a frame, a magnetic circuit, and a diaphragm. The magnetic circuit is coupled to the frame.

The diaphragm includes a diaphragm body and an edge. The diaphragm body has a dome-shape. An outer circumference of the diaphragm is connected to the edge. An outer circumference of the edge is connected to the frame. The frame has a connecting surface. An outer circumference of the edge is connected to the connecting surface of the frame.

Another conventional loudspeaker includes a frame, a magnetic circuit, a support strut, a flat diaphragm, a first edge, a second edge, and a loudspeaker unit. The magnetic circuit is coupled to the frame. Threaded portions are formed on an upper end and a lower end of the support strut. The loudspeaker unit is mounted to the support strut and is fixed to the support strut with the threaded portion. The support strut is mounted to a center of the magnetic circuit, and is fixed to the magnetic circuit with the threaded portion.

An inner circumference of the first edge is coupled to an outer circumference of the diaphragm. On the other hand, an outer circumference of the first edge is coupled to the first frame. An outer circumference of the second edge is coupled to an inner circumference of the diaphragm. On the other hand, an inner circumference of the second edge is coupled to the loudspeaker unit.

A conventional loudspeaker similar to this loudspeaker is disclosed in, e.g. PTL 2.

FIG. 42 is a cross-sectional view of still another conventional loudspeaker 501 including conventional flat diaphragm 502. FIG. 43 is a top view of core substrate 502A of flat diaphragm 502.

Loudspeaker 501 is a coaxial-type loudspeaker. Loudspeaker 501 includes flat diaphragm 502 for reproducing low sound, high-frequency diaphragm 503 for reproducing sound in a high frequency band, voice coil 504, and voice coil bobbin 5 which transmits vibrations of voice coil 504 to flat diaphragm 502.

Although a position of a sound source can be unified with the use of flat diaphragm 502, flat diaphragm 502 exhibits fragility in mechanical strength because flat diaphragm 502 has a flat plate shape. To decrease fragility, flat diaphragm 502 includes core substrate 502A having high rigidity and skin layers 502B. Skin layers 502B is laminated on both surfaces of core substrate 502A with adhesive. A honeycomb structure shown in FIG. 43 is used in core substrate 502A, thus enhancing mechanical strength of flat diaphragm 502.

A loudspeaker similar to this loudspeaker is disclosed in, e.g. PTL 3. FIG. 44 is a cross-sectional view of another conventional loudspeaker 601. FIG. 45 is a cross-sectional view of flat diaphragm 602 of loudspeaker 601.

Although a position of a sound source can be unified with the use of flat diaphragm 602, flat diaphragm 602 exhibits fragility in mechanical strength because flat diaphragm 602 has a flat plate shape.

To decrease this mechanical fragility, flat diaphragm 602 includes core substrate 603 having a honeycomb structure and skin layers 604 mounted on both surfaces of core substrate 603.

In loudspeaker 601, in general, skin layer 604 made of, e.g. a thin aluminum plate is laminated on each surface of core substrate 603. Individual cells 607 of core substrate 603 are substantially sealed with skin layer 604 described above.

In such a configuration, flat diaphragm 602 is configured to receive vibrations of voice coil 605 via driver cone 606, thus reproducing sound.

A conventional loudspeaker similar to this loudspeaker is disclosed in, e.g. PTL 4. The loudspeaker including the flat diaphragm can stabilizes a distance between a power source and a listening position (ears) to a fixed value more easily than a loudspeaker including a cone diaphragm, hence reproducing sound with small distortion.

The conventional loudspeaker includes a magnetic circuit having a magnetic gap, a voice coil movably disposed in the magnetic gap of the magnetic circuit, a coupling cone fixed to the voice coil, and a flat diaphragm fixed to the coupling cone. One end of the coupling cone is fixed to the voice coil while another end of coupling cone is fixed to the flat diaphragm.

The coupling cone has a conical cylindrical shape such that the coupling cone has a small diameter on the voice coil and a large diameter on the flat diaphragm. A flange bent toward the outside is formed on a portion of the coupling cone toward the diaphragm. An adhesive which fixes the flange to a back-side plate body of the flat diaphragm is applied to the flange. A conventional loudspeaker similar to this loudspeaker is disclosed in PTL 5.

CITATION LIST

Patent Literatures

PTL 1: Japanese Patent Laid-Open Publication No. 05-137194

PTL 2: Japanese Utility Model Laid-Open Publication No. 61-195189

PTL 3: Microfilm of Japanese Utility Model Application No. 54-163846

PTL 4: Japanese Patent Publication No. 59-1035

PTL 5: Japanese Utility Model Laid-Open Publication No. 61-166689

SUMMARY

A loudspeaker includes a diaphragm body having a dome shape protruding upwardly, a magnetic circuit disposed below the diaphragm body, a voice coil coupled to the diaphragm body, an edge coupled to an outer circumference of the diaphragm body, and a frame coupled to the edge. The edge includes a first coupling portion provided at an outer circumference of the edge, a second coupling portion provided at an inner circumference of the edge and coupled to an outer circumference of the diaphragm body, and a roll portion disposed between the first coupling portion and the second coupling portion. The edge has a surface facing downward. The frame has a connecting surface disposed below the second coupling portion and coupled to the surface of the edge at the first coupling portion of the edge.

This loudspeaker can decrease distortion of sound.

DETAIL DESCRIPTION OF PREFERRED EMBODIMENTS

Exemplary Embodiment 1

Figure 1:
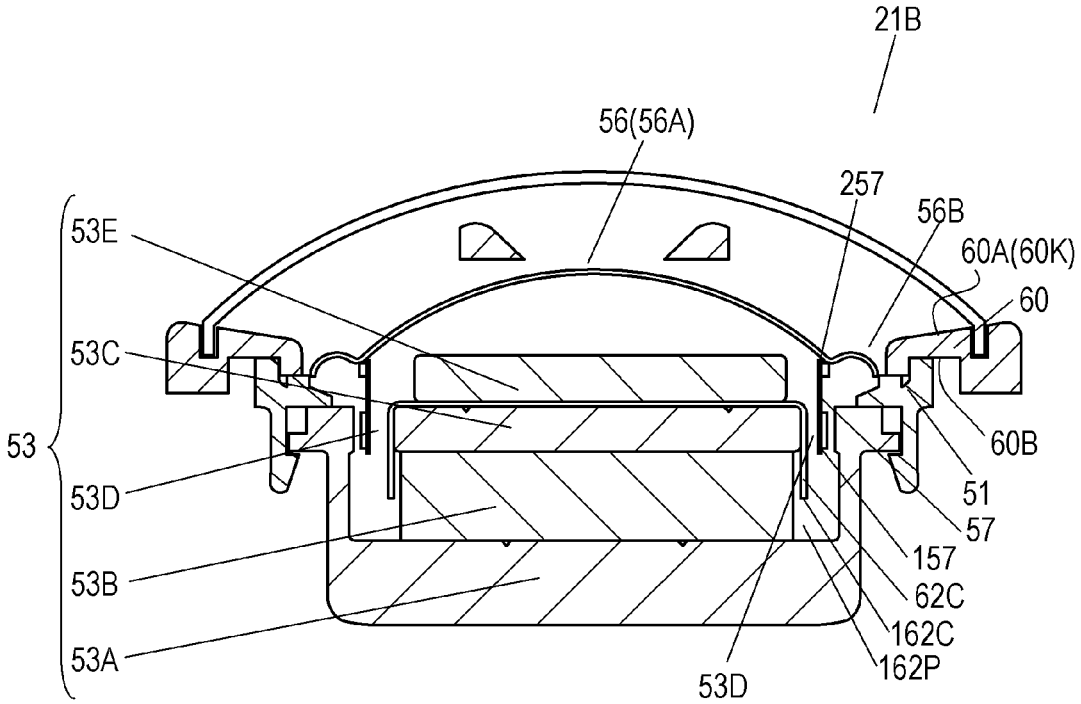
FIG. 1 is a cross-sectional view of a loudspeaker according to Exemplary Embodiment 1.

FIG. 1 is a cross-sectional view of loudspeaker 21B according to Exemplary Embodiment 1. Loudspeaker 21B includes frame 51, diaphragm 56, magnetic circuit 53, and voice coil 57. Magnetic circuit 53 has magnetic gap 53D. Diaphragm 56 includes diaphragm body 56A and edge 56B. Frame 51 has connecting surface 51A.

Magnetic circuit 53 is disposed below diaphragm body 56A. Frame 51 is coupled to magnetic circuit 53. End portion 157 of voice coil 57 is inserted into magnetic gap 53D. On the other hand, end portion 257 of voice coil 57 is coupled to diaphragm body 56A.

Diaphragm body 56A has a dome shape protruding upwardly. That is, diaphragm body 56A has a shape obtained by cutting a part of a sphere, hence having a circular shape viewing from above. Edge 56B has an annular shape. An outer circumference of diaphragm body 56A is coupled to edge 56B. An outer circumference of edge 56B is connected to frame 51. Frame 51 has an annular shape viewing from above.

Figure 2:
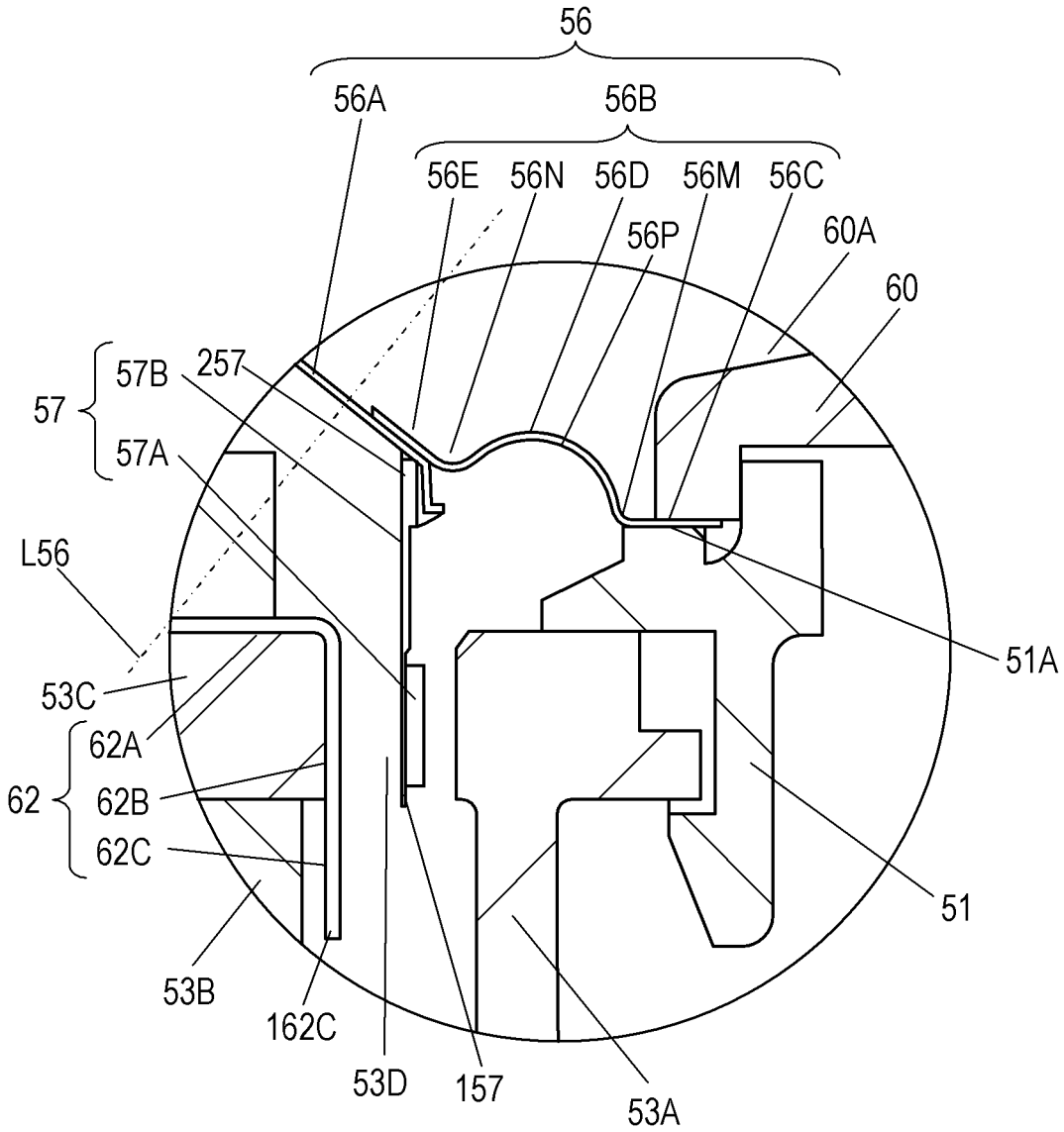
FIG. 2 is an enlarged cross-sectional view of the loudspeaker shown in FIG. 1.

FIG. 2 is an enlarged cross-sectional view of loudspeaker 21B. Edge 56B includes coupling portion 56C, roll portion 56D, and coupling portion 56E. Coupling portion 56C is provided at an outer circumference of edge 56B. Coupling portion 56E is provided at an inner circumference of edge 56B. Coupling portion 56E is coupled to an outer circumference of diaphragm body 56A. Roll portion 56D is disposed between coupling portion 56C and coupling portion 56E. Roll portion 56D has a cross section having an arcuate shape. Roll portion 56D protrudes upwardly from coupling portion 56C and coupling portion 56E.

In the above configuration, connecting surface 51A is disposed below coupling portion 56E. Coupling portion 56C is coupled to connecting surface 51A. This configuration suppresses reflection of sound output from diaphragm body 56A on roll portion 56D. As a result, Sound output from loudspeaker 21B is prevented from being mixed with sound reflected on roll portion 56D, hence reducing distortion of the sound output from loudspeaker 21B.

In the conventional loudspeaker described above, sound output from the diaphragm is reflected on an edge of the diaphragm, thus generating reflected sound. The reflected sound may be mixed with sound output from the diaphragm, thereby generating distortion in sound output from the loudspeaker.

Loudspeaker 21B shown in FIG. 1 will be detailed below. Loudspeaker 21B may preferably be a tweeter which reproduces sound in a high frequency band. Diaphragm body 56A having a high elastic modulus can reproduce sound in a high frequency band. Diaphragm body 56A may preferably be made of, e.g. metal. Diaphragm body 56A may be formed by, e.g. pressing a titanium alloy.

Voice coil 57 may include coil 57A and bobbin 57B. In this case, coil 57A is wound on one end portion (end portion 157) of bobbin 57B. Another end portion (end portion 257) of bobbin 57B is coupled to diaphragm body 56A.

Magnetic circuit 53 is an inner magnet type magnetic circuit. Magnetic circuit 53 is not limited to an inner magnet type magnetic circuit, and may be an outer magnet type magnetic circuit. Inner magnet type magnetic circuit 53 includes yoke 53A, magnet 53B, and upper plate 53C. Magnet 53B and upper plate 53C have circular columnar shapes. Yoke 53A has a cylindrical shape with a bottom. Yoke 53A and upper plate 53C are made of magnetic metal material.

Magnet 53B is disposed at a center of yoke 53A and is coupled to yoke 53A. Upper plate 53C is mounted on an upper surface of magnet 53B opposite to yoke 53A, and is magnetically coupled to magnet 53B. Upper plate 53C and magnet 53B are mechanically coupled to each other with, e.g. adhesive. Yoke 53A and upper plate 53C are disposed such that an inner circumferential surface of yoke 53A faces an outer circumferential side surface of upper plate 53C. This configuration produces magnetic gap 53D between the inner circumference surface of yoke 53A and the outer circumference surface of upper plate 53C.

Canceling magnet 53E may be disposed on upper plate 53C. In this case, a magnetic flux generated from canceling magnet 53E repels against a magnetic flux generated from magnet 53B. This configuration increases a magnetic flux density in magnetic gap 53D.

Magnetic circuit 53 may include cap 62. Cap 62 may preferably be made of non-magnetic material having high electrical conductivity. Cap 62 may be made of, e.g. copper. Cap 62 is a so-called short ring. Cap 62 includes upper plate portion 62A, side plate portion 62B extending downward from upper plate portion 62A, and extension portion 62C extending downward from side plate portion 62B. Upper plate portion 62A covers an outer circumference of an upper surface of upper plate 53C. Side plate portion 62B extends along an outer circumference surface of upper plate 53C. Extension portion 62C extends downward from a distal end of side plate portion 62B. In this configuration extension portion 62C prevents an adhesive which couples upper plate 53C to magnet 53B from protruding toward magnetic gap 53D, hence narrowing magnetic gap 53D and reducing a distance between magnet 53B and extension portion 62C. That is, magnet 53B having a large diameter can be used so that a magnet having a large magnetic force can be used as magnet 53B. The reason is as follows. In assembling magnet 53B and upper plate 53C, magnet 53B protrudes toward magnetic gap 53D due to the adhesion displacement between magnet 53B and upper plate 53C, which often occurs when a magnet having a large diameter is used. However, a guiding effect of extension portion 62C can prevent magnet 53B from projecting toward magnetic gap 53D. As a result, a magnetic flux density in magnetic gap 53D can be increased.

On the other hand, gap 162P (see FIG. 1) is preferably provided between distal end 162C of extension portion 62C and yoke 53A. This configuration prevents a gap from being formed between the upper surface of upper plate 53C and a lower surface of upper plate portion 62A of cap 62.

Figure 3:
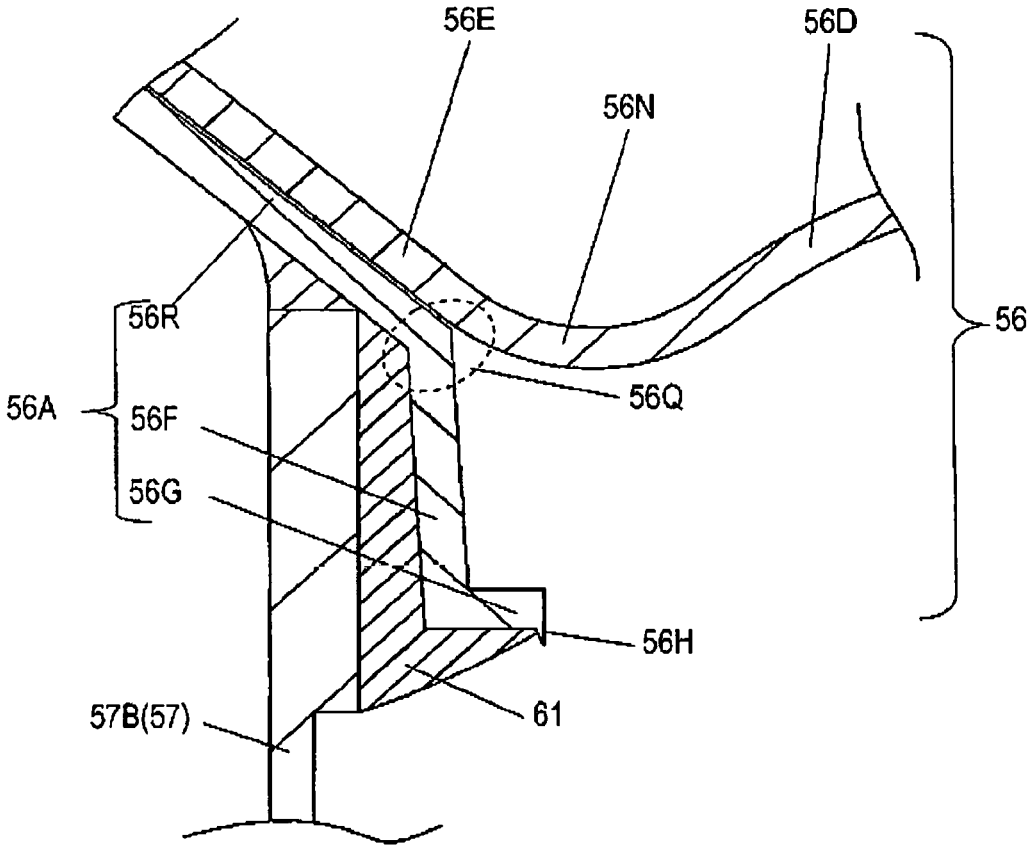
FIG. 3 is an enlarged cross-sectional view of a diaphragm of the loudspeaker shown in FIG. 1.

FIG. 3 is an enlarged cross-sectional view of diaphragm 56. Diaphragm 56 is made of an extremely hard material punched out by, e.g. a press. Accordingly, an outer circumferential end of diaphragm 56 has burrs 56H formed at the time of punching out diaphragm 56. In view of the above, diaphragm 56 may preferably include extension portion 56F. Extension portion 56F extends from an outer circumferential end of diaphragm body 56A. This configuration prevents burrs 56H formed at the outer circumferential end of diaphragm 56 from rubbing against edge 56B, hence avoiding damages on edge 56B.

Extension portion 56F is bent at a bent portion 56Q from a dome portion 56R in a direction away from roll portion 56D. This configuration prevents extension portion 56F from contacting roll portion 56D, hence suppressing a hitting noise caused by the contact between extension portion 56F and roll portion 56D. This configuration can prevent roll portion 56D from being coupled to extension portion 56F, hence avoiding the suppressing of a deformation of roll portion 56D.

Extension portion 56F may preferably have a shape along an outer circumference of bobbin 57B. In this case, extension portion 56F may adhere to bobbin 57B preferably with adhesive 61. This configuration increases a coupling strength between voice coil 57 and diaphragm 56, and enhances a response characteristic of diaphragm 56. Flange 56G may preferably be provided at the outer circumferential end of diaphragm 56. Flange 56G is provided at a distal end of extension portion 56F. Flange 56G may preferably be bent toward an outer side of diaphragm 56. In this case, burrs 56H are formed on a distal end of flange 56G. Burrs 56H preferably project in a direction away from roll portion 56D. This configuration prevents burrs 56H from rubbing against edge 56B, and suppresses damage on edge 56B accordingly.

Flange 56G may not necessarily be formed at the distal end portion of extension portion 56F. Flange 56G may be formed at an end of diaphragm body 56A. In this case, flange 56G may preferably be bent toward an inner side of diaphragm 56.

Figure 4:
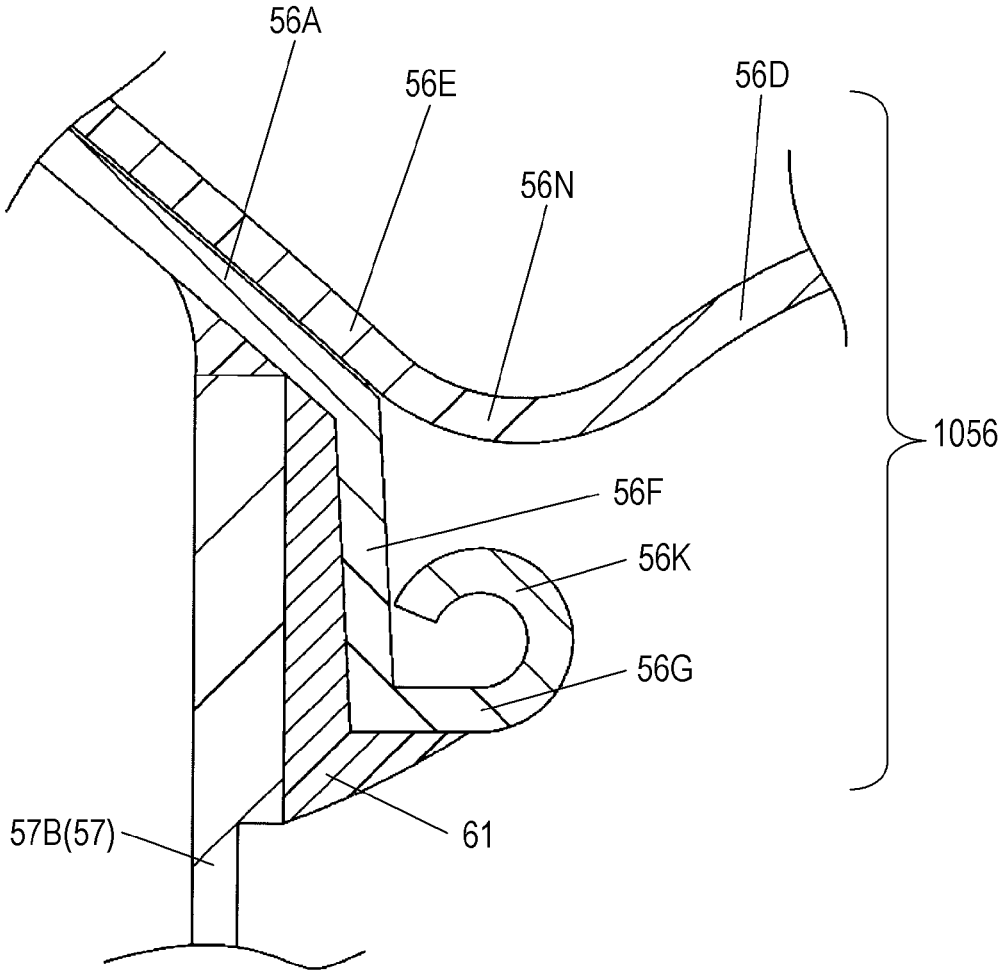
FIG. 4 is an enlarged cross-sectional view of another diaphragm of the loudspeaker shown in FIG. 1.

FIG. 4 is an enlarged cross-sectional view of another diaphragm 1056 of loudspeaker 21B according to Embodiment 1. In FIG. 4, components identical to those of diaphragm 56 shown in FIG. 3 are denoted by the same reference numerals. Diaphragm 1056 includes bent portion 56K formed on flange 56G. Bent portion 56K is provided at a distal end of flange 56G. Bent portion 56K has a rolled shape. Bent portion 56K may be bent either in an upward direction or in a downward direction. Bent portion 56K is bent such that a distal end of bent portion 56K is located away from roll portion 56D. This configuration can prevent a distal end of flange 56G from contacting roll portion 56D, hence suppressing a hitting noise generated due to the contact between flange 56G and roll portion 56D, and suppressing damages on roll portion 56D.

Figure 5:
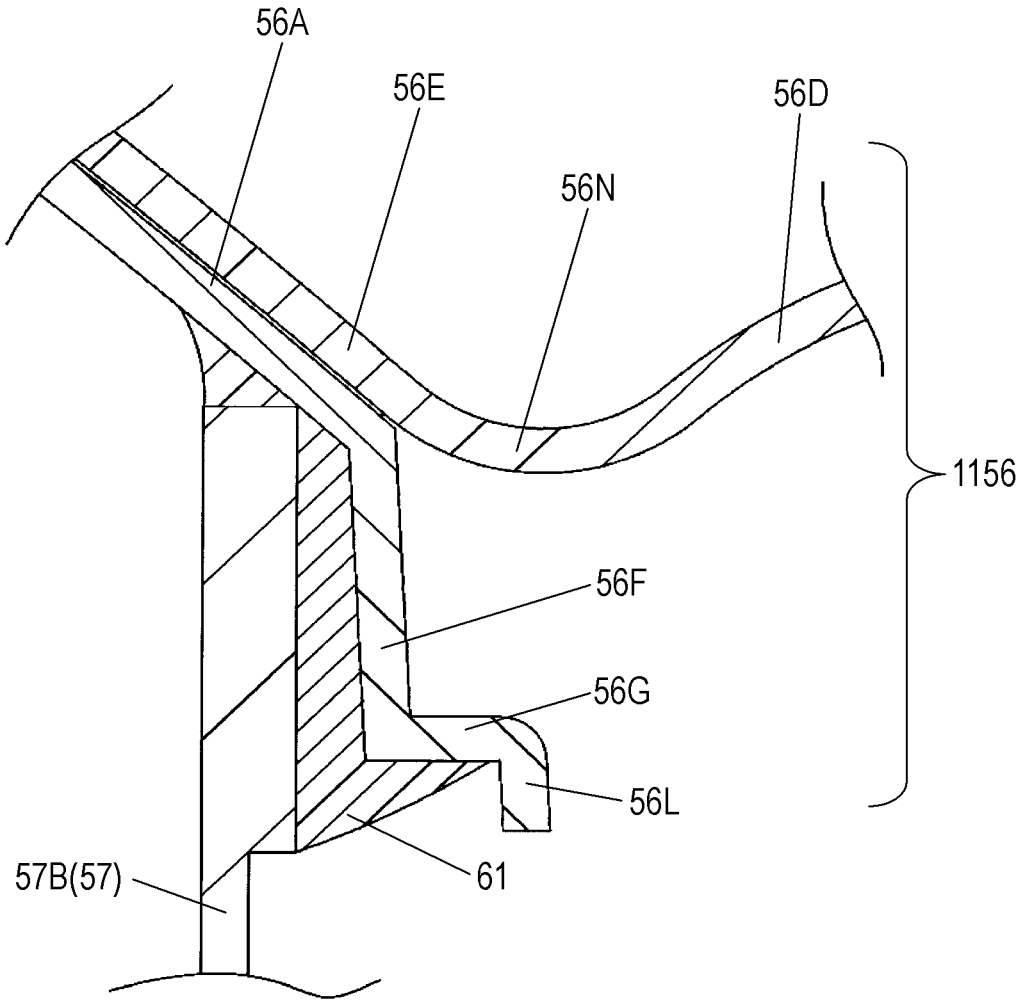
FIG. 5 is an enlarged cross-sectional view of still another diaphragm of the loudspeaker shown in FIG. 1.

FIG. 5 is an enlarged cross-sectional view of a main part of still another diaphragm 1156 of loudspeaker 21B according to Embodiment 1. In FIG. 5, components identical to those of diaphragm 56 shown in FIG. 3 are denoted by the same reference numerals. Diaphragm 1156 includes bent portion 56L provided at flange 56G. Bent portion 56L is provided at a distal end of flange 56G. Bent portion 56L has a straight shape. Bent portion 56L is bent such that a distal end of bent portion 56L is located away from roll portion 56D. This configuration can prevent the distal end of flange 56G from contacting roll portion 56D, hence suppressing a hitting noise generated by the contact between flange 56G and roll portion 56D, and suppressing damages on roll portion 56D.

Edge 56B will be detailed below with reference to FIG. 2. Coupling portion 56E may preferably be angled with respect to coupling portion 56C. This configuration can prevent a reflection of sound output from diaphragm body 56A on roll portion 56D. As a result, sound output from loudspeaker 21B shown in FIG. 1 can be prevented from being mixed with sound reflected on roll portion 56D, hence reducing distortion of sound output from loudspeaker 21B.

Peak 56P of roll portion 56D is preferably located below straight line L56 extending from the outside of diaphragm body 56A perpendicularly onto a surface of diaphragm body 56A. Peak 56P of roll portion 56D can further prevents sound output from diaphragm body 56A from being reflected on roll portion 56D. As a result, of sound output from loudspeaker 21B shown in FIG. 1 can be prevented from being mixed with sound reflected on roll portion 56D, hence reducing distortion of sound output from loudspeaker 21B. Peak 56P of roll portion 56D may preferably be located below arbitrary straight line L56 extending from the outside of diaphragm body 56A perpendicularly onto the surface of diaphragm body 56A. Peak 56P of roll portion 56D can further suppress a reflection of sound output from diaphragm body 56A on roll portion 56D.

Edge 56B preferably includes connecting portion 56M and connecting portion 56N. Connecting portion 56M connects roll portion 56D to coupling portion 56C. Connecting portion 56N connects roll portion 56D to coupling portion 56E. Connecting portion 56M and connecting portion 56N have cross sections having arcuate shapes. The arcuate shape of connecting portion 56M has a first radius while the arcuate shape of connecting portion 56N has a second radius. The second radius is larger than the first radius. This configuration can locate peak 56P of roll portion 56D away from diaphragm body 56A. Roll portion 56D and diaphragm body 56A can be disposed such that a distance between diaphragm body 56A and a surface of roll portion 56D which faces diaphragm body 56A is increased. This configuration can further suppress a reflection of sound output from diaphragm body 56A on roll portion 56D. As a result, sound output from loudspeaker 21B shown in FIG. 1 can be prevented from being mixed with sound reflected on roll portion 56D, hence reducing distortion of sound output from loudspeaker 21B.

Loudspeaker 21B may include ring body 60. Ring body 60 may constitute, e.g. a portion of an equalizer. Alternatively, ring body 60 may be a protector. Ring body 60 may be a gasket or a cushion. Ring body 60 has upper surface 60A and lower surface 60B opposite to upper surface 60A. As shown in FIG. 2, lower surface 60B is coupled to coupling portion 56C.

Upper surface 60A of ring body 60 preferably include angled surface 60K. Angled surface 60K is angled such that a distance between upper surface 60A and lower surface 60B gradually decreases from a circumference of ring body 60 to an inner circumference of ring body 60. Peak 56P of roll portion 56D may preferably be located below a plane expanded straight from angled surface 60K. In this case, angled surface 60K is preferably located below straight line L56 extending from the outside of diaphragm body 56A perpendicularly onto the surface of diaphragm body 56A. This configuration can suppress a reflection of sound output from diaphragm body 56A on ring body 60. As a result, sound output from loudspeaker 21B shown in FIG. 1 is prevented from being mixed with sound reflected on ring body 60, hence reducing distortion of sound output from loudspeaker 21B. Angled surface 60K is preferably located below arbitrary straight line L56 extending from the outside of diaphragm body 56A perpendicularly onto the surface of diaphragm body 56A. Angled surface 60K can suppress a reflection of sound output from diaphragm body 56A on ring body 60.

Peak 56P of roll portion 56D is preferably located below a plane expanding straight from angled surface 60K in a direction toward roll portion 56D. Peak 56P of roll portion 56D can further suppress a reflection of sound output from diaphragm body 56A on ring body 60.

Figure 6:
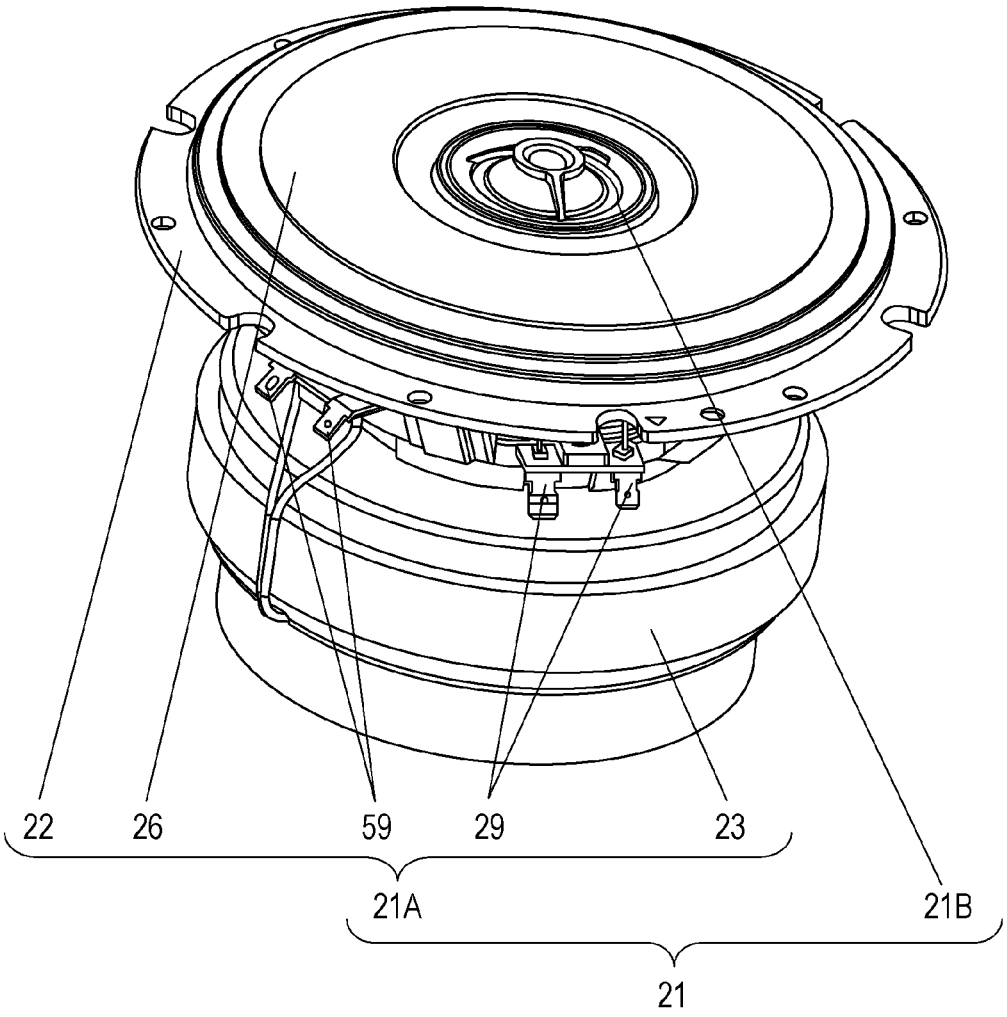
FIG. 6 is a perspective view of another loudspeaker according to Embodiment 1.
Figure 7:
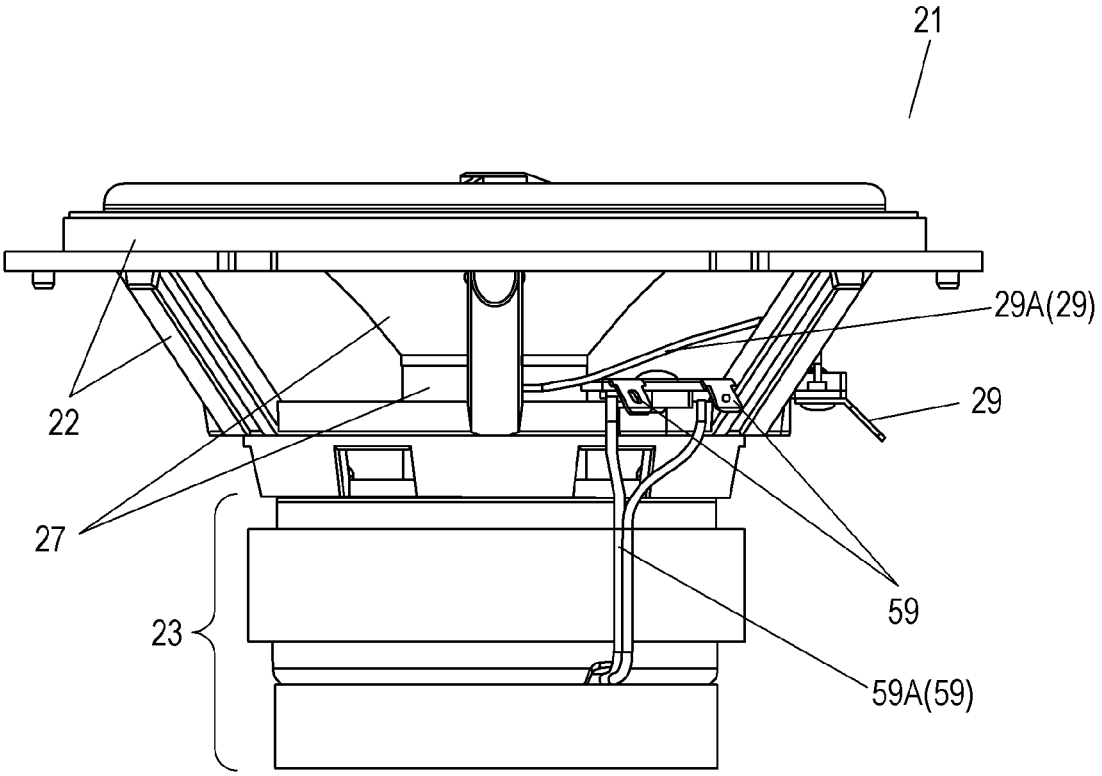
FIG. 7 is a side view of the loudspeaker shown in FIG. 6.
Figure 8:
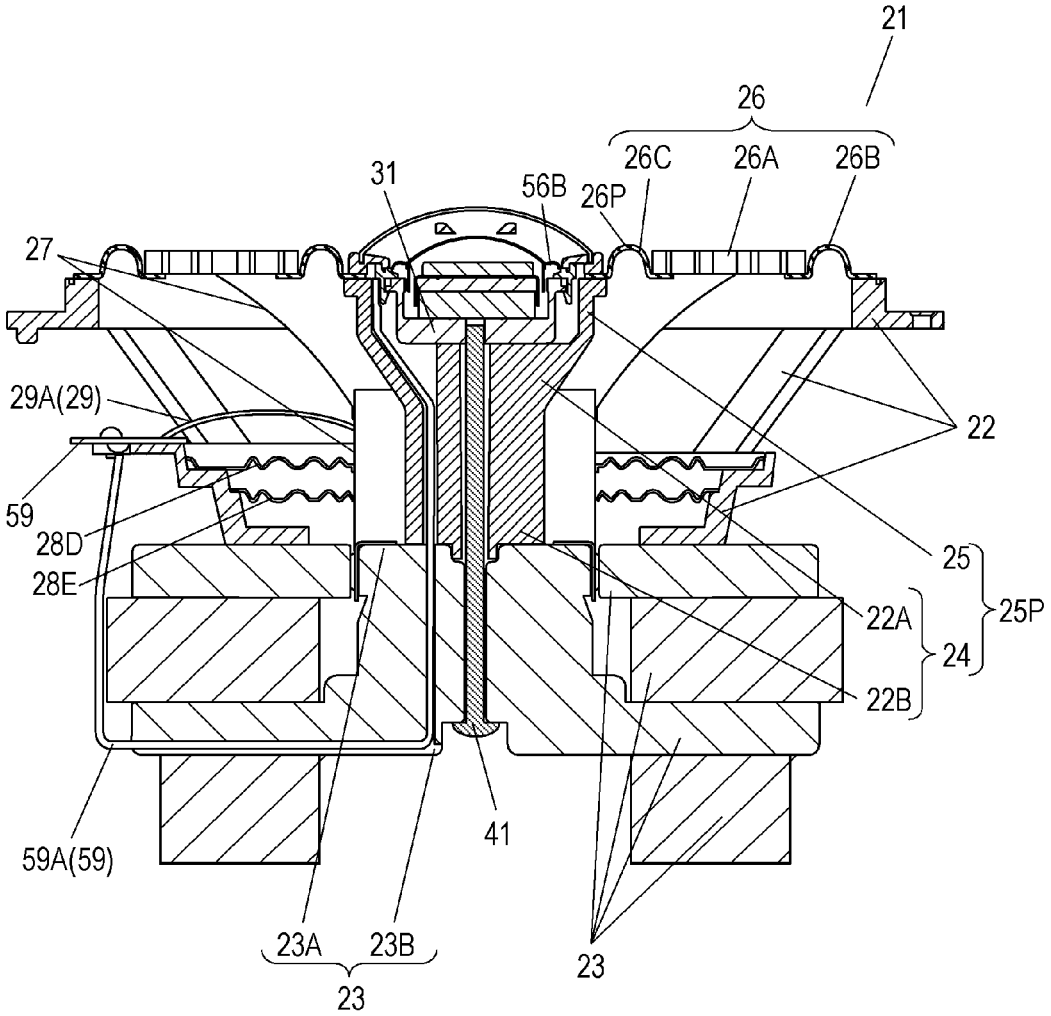
FIG. 8 is a cross-sectional view of the loudspeaker shown in FIG. 6.

FIG. 6 is a perspective view of another loudspeaker 21 according to Embodiment 1. FIG. 7 is a side view of loudspeaker 21. FIG. 8 is a cross-sectional view of loudspeaker 21. Loudspeaker 21 includes loudspeaker 21A and loudspeaker 21B shown in FIGS. 1 to 5. A frequency band of sound output from loudspeaker 21A is different from and a frequency band of sound output from loudspeaker 21B. Loudspeaker 21 includes terminals 29 and terminals 59. Terminals 29 and 59 are fixed to frame 22. Terminals 29 supply signals to loudspeaker 21A while terminals 59 supply signals to loudspeaker 21B.

In accordance with Embodiment 1, loudspeaker 21A is a full-range loudspeaker. Loudspeaker 21A may not necessarily be a full-range loudspeaker, and may be a woofer or a subwoofer. On the other hand, loudspeaker 21B is, e.g. a dome-type tweeter. Loudspeaker 21B is disposed at the center of loudspeaker 21A viewing from above. That is, the center of loudspeaker 21A and the center of loudspeaker 21B are coaxially arranged. That is, loudspeaker 21 is a coaxial-type loudspeaker. This configuration stabilizes a position of a sound image generated from loudspeaker 21.

Loudspeaker 21A and loudspeaker 21B preferably have circular outer shapes viewing from above. This configuration can decrease distortion of sound output from loudspeaker 21.

Loudspeaker 21A will be described with reference to drawings. As shown in FIG. 8, loudspeaker 21A includes frame 22, magnetic circuit 23, support body 25P, flat diaphragm 26, driver body 27, and fixing element 41 which is made of metal. As shown in FIG. 8, support body 25P includes frame 25 and support strut 24 which extends downward from frame 25.

Figure 9:
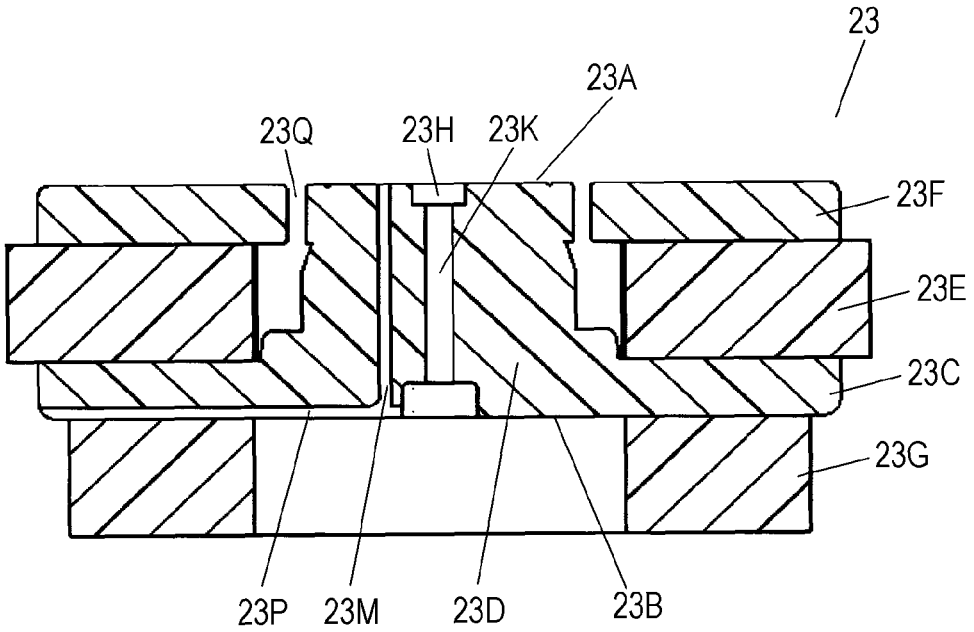
FIG. 9 is a cross-sectional view of a magnetic circuit of the loudspeaker shown in FIG. 6.

FIG. 9 is a cross-sectional view of magnetic circuit 23. Magnetic circuit 23 is mechanically coupled to frame 22. Magnetic circuit 23 has upper surface 23A and lower surface 23B which is opposite to upper surface 23A and magnetic circuit 23. Magnetic circuit 23 may preferably be an outer magnet type magnetic circuit. Outer magnet type magnetic circuit 23 includes lower plate 23C, center pole 23D, magnet 23E, and upper plate 23F. Lower plate 23C, center pole 23D, and upper plate 23F are made of magnetic material. Lower plate 23C, center pole 23D, and upper plate 23F are made of iron. Frame 22 is preferably made of metal. This configuration increases the strength of frame 22. Frame 22 is preferably made of non-magnetic material. This configuration suppresses leakage of a magnetic flux generated by magnetic circuit 23 to frame 22, accordingly, increasing a magnetic flux density in magnetic gap 23Q. Frame 22 is preferably formed by die-casting, e.g. an aluminum as the material. This configuration enhances productivity of frame 22. Internal loss of frame 22 formed by die-casting of aluminum is larger than internal loss of frame 22 made of metal, such as iron. Accordingly, the generation of peaks and dips in frequency sound pressure characteristics of loudspeaker 21 caused by resonance of frame 22 can be suppressed.

Figure 10:
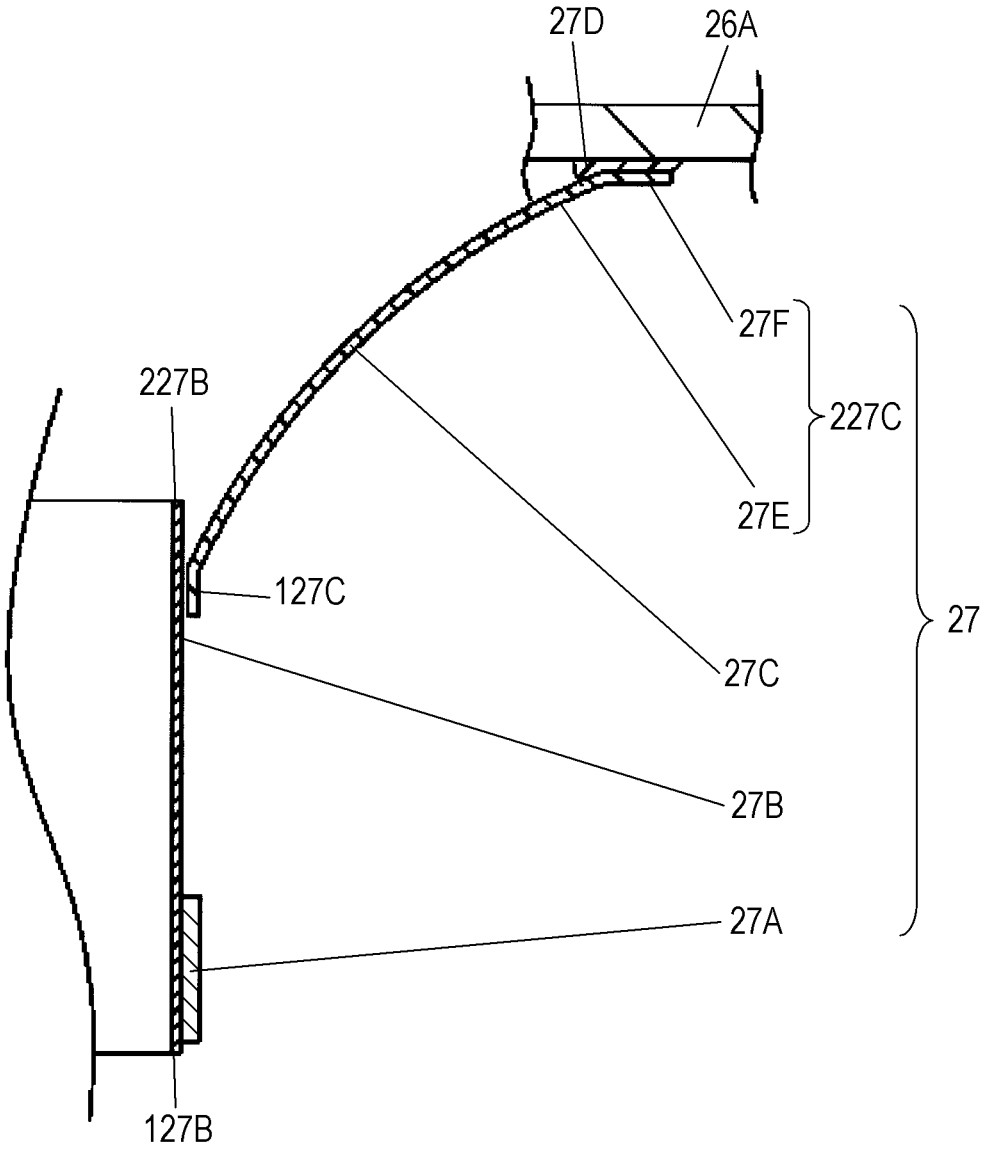
FIG. 10 is an enlarged cross-sectional view of a driver body of the loudspeaker shown in FIG. 6.

FIG. 10 is an enlarged cross-sectional view of driver body 27. Driver body 27 includes voice coil 27A, bobbin 27B, and coupling cone 27C. Voice coil 27A is wound on end portion 127B of bobbin 27B. End portion 227B of bobbin 27B is coupled to end portion 127C of coupling cone 27C. End portion 227C of coupling cone 27C is coupled to a lower surface of diaphragm body 26A. Voice coil 27A is inserted into magnetic gap 23Q shown in FIG. 9. This configuration allows driver body 27 to drive flat diaphragm 26 in response to a current flowing in voice coil 27A.

End portion 227C of coupling cone 27C is coupled to a lower surface of diaphragm body 26A with adhesive 27D. End portion 227C of coupling cone 27C includes adhering portion 27F and angled portion 27E. Adhering portion 27F is parallel to the lower surface of diaphragm body 26A. On the other hand, angled portion 27E is angled with respect to the lower surface of diaphragm body 26A. This configuration allows adhesive 27D to fill between diaphragm body 26A and angled portion 27E. Accordingly, in coupling cone 27C, diaphragm body 26A adheres to adhering portion 27F with adhesive 27D, and diaphragm body 26A adheres to angled portion 27E with adhesive 27D, thereby increasing coupling strength between coupling cone 27C and flat diaphragm 26. As a result, a speed of sound of flat diaphragm 26 is increased, and distortion of sound output from flat diaphragm 26 can be decreased.

Angled portion 27E may preferably be bent in a direction to approach flat diaphragm 26. This configuration can increase a region where adhesive 27D is attached to angled portion 27E, and prevent adhesive 27D from flowing down along angled portion 27E, accordingly increasing a coupling strength between coupling cone 27C and flat diaphragm 26.

Terminals 29 shown in FIG. 6 preferably include lead wire 29A shown in FIG. 8. In this case, a hole which allows lead wire 29A to pass through the hole is formed in frame 22. This configuration allows, voice coil 27A to be electrically connected to terminals 29 via lead wire 29A.

Figure 11:
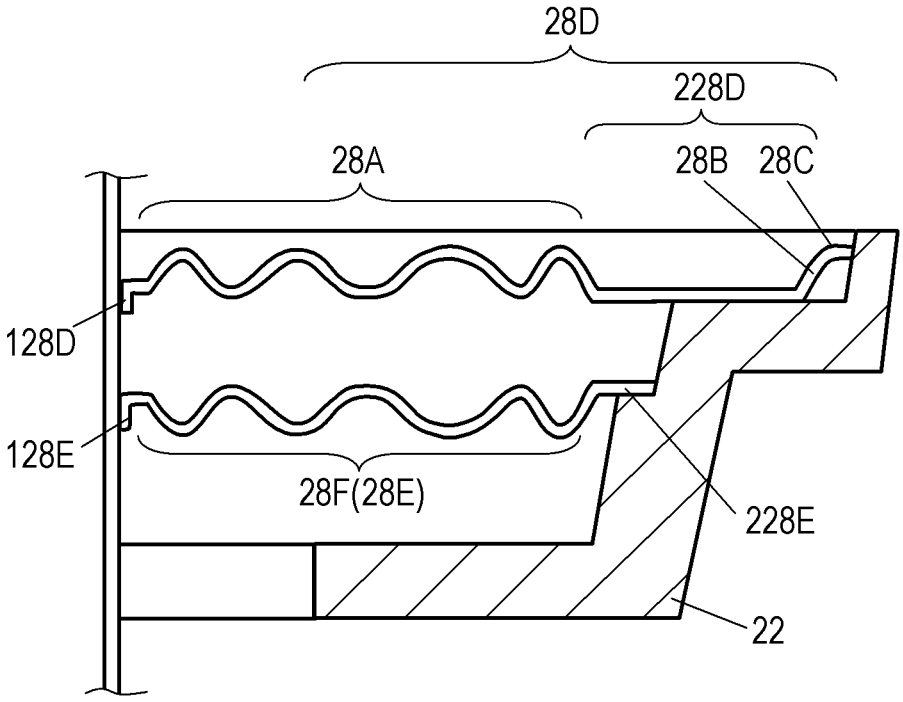
FIG. 11 is an enlarged cross-sectional view of a damper of the loudspeaker shown in FIG. 6.

Loudspeaker 21A may include damper 28D. FIG. 11 is an enlarged cross-sectional view of loudspeaker 21A, and shows a cross section of damper 28D. Damper 28D includes body portion 28A, inner circumferential portion 128D and outer circumferential portion 228D. Body portion 28A is provided between inner circumferential portion 128D and outer circumferential portion 228D. Body portion 28A has a cross section with a wave shape. Inner circumferential portion 128D of damper 28D is coupled to bobbin 27B. Outer circumferential portion 228D of damper 28D is coupled to frame 22. Outer circumferential portion 228D of damper 28D preferably includes bent portion 28B which is bent upward or downward from body portion 28A. This configuration can suppress plastic deformation of damper 28D when an external force is applied to damper 28D. Outer circumferential portion 228D further includes flange 28C which is further bent and extends from a distal end of bent portion 28B. This configuration can further suppress plastic deformation of damper 28D.

Loudspeaker 21A may further include damper 28E. FIG. 11 shows a cross section of damper 28E. Damper 28E includes body portion 28F, inner circumferential portion 128E and outer circumferential portion 228E. Body portion 28F is provided between inner circumferential portion 128E and outer circumferential portion 228E. Body portion 28F has a cross section having a wave shape. Inner circumferential portion 128E of damper 28E is coupled to bobbin 27B while outer circumferential portion 228E of damper 28E is coupled to frame 22. The shape of body portion 28A of damper 28D is symmetrical to the shape of body portion 28F of damper 28E with respect to a plane perpendicular to a center axis of voice coil 27A. This configuration can decrease distortion of voice coil 27A in upward and downward directions. Accordingly, distortion of sound output from loudspeaker 21 can be decreased. In this case, flange 28C is preferably provided only at outer circumferential portion 228D of damper 28D while flange 28C be not formed at outer circumferential portion 228E of damper 28E. This configuration prevents damper 28D and damper 28E from being coupled incorrectly to bobbin 27B and frame 22 due to inverted arrangement of damper 28D and damper 28E.

As shown in FIG. 9, center pole 23D protrudes upwardly from the center of lower plate 23C. Magnet 23E is coupled to an upper surface of lower plate 23C. Magnet 23E has an annular shape having a hole formed at the center thereof. Upper plate 23F is coupled to an upper surface of magnet 23E. Upper plate 23F also has an annular shape having a hole formed at the center thereof. This configuration allows lower plate 23C, center pole 23D, magnet 23E, and upper plate 23F to be magnetically coupled to one another. Center pole 23D passes through the hole formed in magnet 23E and the hole formed in upper plate 23F. Center pole 23D and upper plate 23F are disposed such that an outer side surface of center pole 23D faces an inner side surface of upper plate 23F. This configuration provides magnetic gap 23Q between the outer side surface of center pole 23D and the inner side surface of upper plate 23F.

In outer magnet type magnetic circuit 23, an upper surface of center pole 23D constitutes upper surface 23A, and a lower surface of center pole 23D constitutes lower surface 23B. Through-hole 23K is formed in center pole 23D. Through-hole 23K penetrates center pole 23D from lower surface 23B to upper surface 23A. A center axis of through-hole 23K is aligned with a center axis of center pole 23D.

Magnetic circuit 23 may further include canceling magnet 23G. Canceling magnet 23G is coupled to a lower surface of lower plate 23C. Canceling magnet 23G preferably has an annular shape. Canceling magnet 23G generates a magnetic field repelling against a magnetic flux generated from magnet 23E. That is, a surface of magnet 23E and a surface of canceling magnet 23G which face each other have the same magnetic polarity. This configuration increases a magnetic flux density in magnetic gap 23Q. Insertion hole 23H is formed in upper surface 23A of center pole 23D.

Magnetic circuit 23 may not necessarily an outer magnet type magnetic circuit, and may be an inner magnet type magnetic circuit. Alternatively, magnetic circuit 23 may be configured by combining an outer magnet type magnetic circuit and an inner magnet type magnetic circuit.

Figure 12:
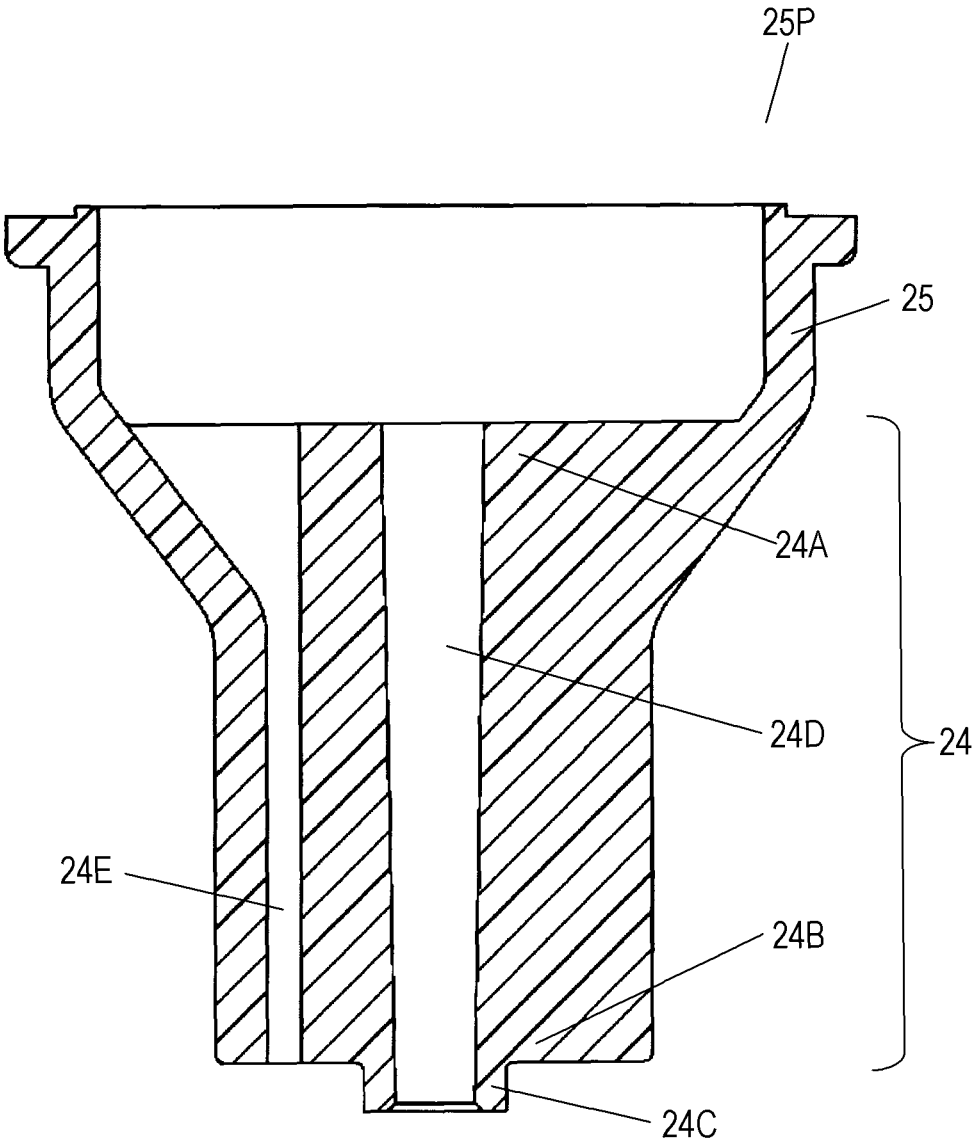
FIG. 12 is a cross-sectional view of a support strut of the loudspeaker shown in FIG. 6.

FIG. 12 is a cross-sectional view of support body 25P. Support body 25P includes frame 25 and support strut 24 which extends downward from frame 25. Frame 25 is coupled to upper end portion 24A of support strut 24. Frame 25 stands upwardly on upper end portion 24A of support strut 24. Frame 25 is coupled to an outer circumferential end of upper end portion 24A. As shown in FIG. 8, loudspeaker 21B is accommodated in frame 25.

Frame 25 is preferably unified with support strut 24. This configuration positions frame 25 accurately with respect to support strut 24, hence preventing flat diaphragm 26 from being angled and preventing flat diaphragm 26 from deviating from the center of the support strut 24. Further, it is unnecessary to form frame 25 and support strut 24 separately, and hence, productivity of frame 25 is enhanced. In forming frame 25 and support strut 24 as a unified body, frame 25 and support strut 24 may be formed by die-casting aluminum as material. This configuration prevents vibrations generated by loudspeaker 21A shown in FIG. 6 from transmitting to loudspeaker 21B. This configuration also prevents vibrations generated by loudspeaker 21B from transmitting to loudspeaker 21A. Frame 25 and support strut 24 may be formed separately. In this case, frame 25 may be made of a resin.

Support strut 24 is coupled to upper surface 23A such that support strut 24 extends upward from upper surface 23A of magnetic circuit 23. Support strut 24 is disposed at the center of upper surface 23A. Support strut 24 includes upper end portion 24A and lower end portion 24B. Upper end portion 24A of support strut 24 is opposite to lower end portion 24B. Lower end portion 24B of support strut 24 faces upper surface 23A. Protrusion 24C is provided on lower end portion 24B of support strut 24. Protrusion 24C is fitted in insertion hole 23H shown in FIG. 9 so that support strut 24 can maintain the state shown in FIG. 8 where support strut 24 stands upwardly on upper surface 23A of center pole 23D. Insertion hole 23H shown in FIG. 9 is formed in the center of upper surface 23A of center pole 23D. That is, a center axis of protrusion 24C is aligned with a center axis of insertion hole 23H and a center axis of through-hole 23K shown in FIG. 9. Accordingly, support strut 24 can be disposed accurately at the center of center pole 23D shown in FIG. 9.

Support strut 24 has through-hole 24D which penetrates support strut 24 from lower end portion 24B to upper end portion 24A. A center axis of through-hole 24D is aligned with the center axis of through-hole 23K shown in FIG. 9. This configuration allows fixing element 41 shown in FIG. 8 to be inserted straight into through-hole 24D.

Through-hole 24D at lower end portion 24B has a first diameter while through-hole 24D in upper end portion 24A has a second diameter. As shown in FIG. 8, the second diameter may preferably be larger than the first diameter. That is, an inner circumferential surface of through-hole 24D is angled such that a diameter of through-hole 24D gradually increases toward upper end portion 24A from lower end portion 24B. With such a configuration, even if through-hole 24D is angled with respect to a center axis of support strut 24, fixing element 41 shown in FIG. 8 inserted into through-hole 24D is prevented from being angled with respect to the center axis of support strut 24. This configuration prevents support strut 24 from being angled with respect to upper surface 23A shown in FIG. 8.

Support strut 24 is preferably made of metal. Support strut 24 made of metal has more stable size and shape against an external force for a change in temperature environment than support strut 24 made of resin. Accordingly, a change in distortion characteristics of loudspeaker 21 shown in FIG. 8 against, e.g. an external force and a change in temperature environment can be suppressed.

Figure 13:
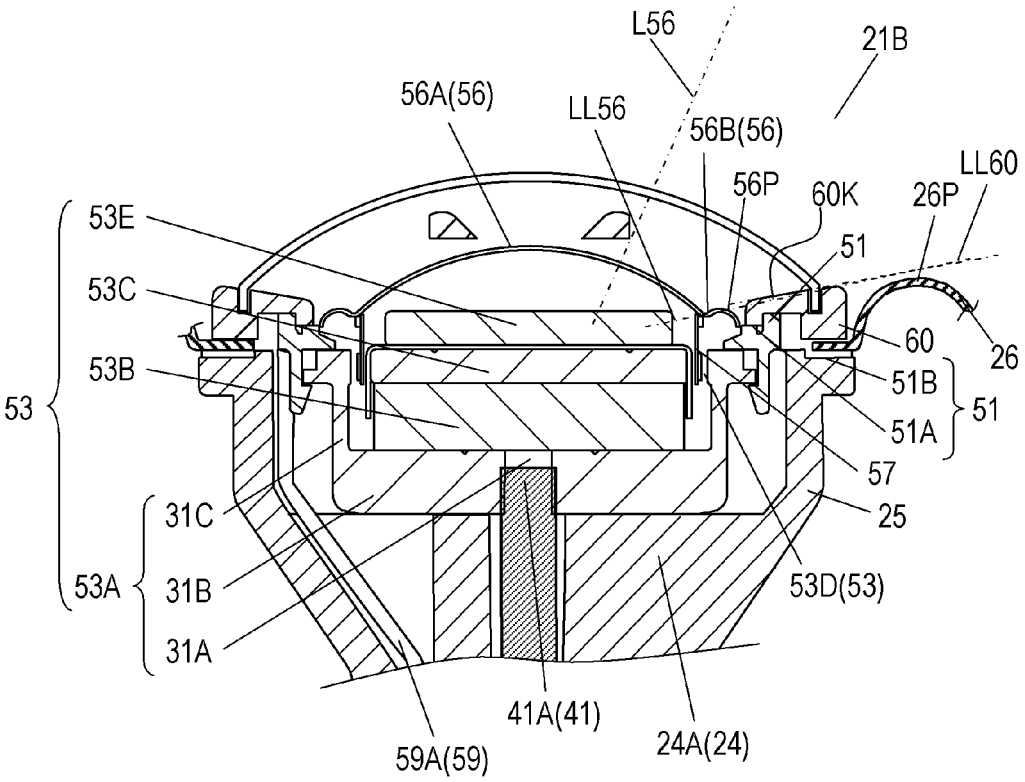
FIG. 13 is a cross-sectional view of the loudspeaker shown in FIG. 6.

Support strut 24, yoke 53A, and center pole 23D will be detailed below. FIG. 13 is a cross-sectional view of a main part of loudspeaker 21 shown in FIG. 6. Yoke 53A includes bottom portion 31B, threaded hole 31A, and tubular portion 31C. Threaded portion 41A is formed in bottom portion 31B such that threaded portion 41A passes through the center of bottom portion 31B. Tubular portion 31C is bent from an outer circumferential end of bottom portion 31B. Tubular portion 31C and upper plate 53C are disposed such that an inner circumferential surface of tubular portion 31C faces a side surface of an outer circumference of upper plate 53C. This configuration provides magnetic gap 53D between the inner circumferential surface of tubular portion 31C and the side surface of the outer circumference of upper plate 53C.

Figure 14:
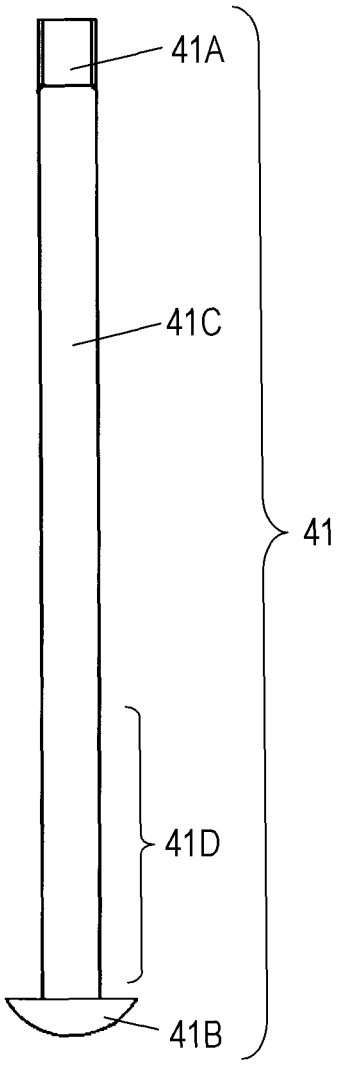
FIG. 14 is a side view of a fixing element of the loudspeaker shown in FIG. 6.

FIG. 14 is a side view of fixing element 41. Fixing element 41 includes threaded portion 41A. Threaded portion 41A is provided at a distal end of fixing element 41. As shown in FIG. 13, threaded portion 41A of fixing element 41 engages with threaded hole 31A so as to hold support strut 24 such that support strut 24 is provided between yoke 53A and upper surface 23A of center pole 23D shown in FIG. 8.

Support strut 24 is preferably made of a softer material softer than yoke 53A. That is, yoke 53A is more rigid than support strut 24. Support strut 24 is preferably made of a softer material than center pole 23D. That is, center pole 23D is preferably harder than support strut 24. Support strut 24 is held such that support strut 24 is provided between yoke 53A and center pole 23D which are harder than support strut 24.

With this configuration, yoke 53A presses down an upper surface of support strut 24. Further, a lower surface of support strut 24 is pressed onto upper surface 23A of center pole 23D. Support strut 24 is less hard than yoke 53A, hence allowing a portion of the upper surface of support strut 24 to deform. Further, support strut 24 is less hard than center pole 23D, hence allowing a portion of the lower surface of support strut 24 to deform. This reliably maintains perpendicularity of support strut 24 with respect to upper surface 23A of magnetic circuit 23.

Yoke 53A may preferably be softer than fixing element 41. That is, fixing element 41 may harder than yoke 53A. In accordance Embodiment 1, fixing element 41 is made of stainless steel. This configuration suppresses deformation of threaded portion 41A which is generated when threaded portion 41A is inserted and fasten into threaded hole 31A. That is, some threads formed on threaded hole 31A can deform to have a shape which conforms to the shape of threaded portion 41A. Therefore, even when fixing element 41 is inserted into yoke 53A while a center axis of threaded hole 31A is angled with respect to a center axis of fixing element 41, the angle of the center axis of threaded hole 31A with respect to the center axis of fixing element 41 can be decreased. As a result, it is possible to reliably maintain perpendicularity of the center axis of support strut 24 with respect to a surface of yoke 53A pressed to support strut 24.

As described above, fixing element 41 is harder than yoke 53A and, yoke 53A and center pole 23D shown in FIG. 8 are harder than support strut 24. This configuration prevents the center axis of support strut 24 from deviating from the center axis of magnetic circuit 23. Further, this configuration reliably maintains perpendicularity between the center axis of support strut 24 and upper surface 23A of magnetic circuit 23.

Accordingly, a stepped portion is prevented from being formed between a surface of frame 22 coupled to outer circumferential and 26B of flat diaphragm 26 and a surface of frame 22 coupled to inner circumferential end 26C. As a result, loudspeaker 21B is mounted not while being angled. Flat diaphragm 26 is disposed not while being angled. That is, a surface of flat diaphragm 26 can be perpendicular to the center axis of magnetic circuit 23 reliably, accordingly preventing flat diaphragm 26 from being rolled, and reducing distortion of sound output from loudspeaker 21. Voice coil 27A is prevented from contacting magnetic circuit 23 when flat diaphragm 26 vibrates with high amplitude. Further, magnetic gap 23Q shown in FIG. 9 can be narrowed, and increases a magnetic flux density in magnetic gap 23Q accordingly.

Further, the center axis of flat diaphragm 26 is prevented from deviating from the center axis of magnetic circuit 23, and hence prevents rolling of flat diaphragm 26, hence reducing distortion of sound output from loudspeaker 21. Magnetic gap 23Q shown in FIG. 8 can be narrowed, and increases a magnetic flux density in magnetic gap 23Q accordingly.

Support strut 24 may preferably be made of non-magnetic material. This configuration can prevent a magnetic flux generated from magnetic circuit 53 and a magnetic flux generated by magnetic circuit 23 from flowing in support strut 24. Accordingly, a magnetic flux density in magnetic gap 53D and a magnetic flux density in magnetic gap 23Q can be increased. Support strut 24 may be formed preferably by die-casting aluminum as a material.

Figure 15:
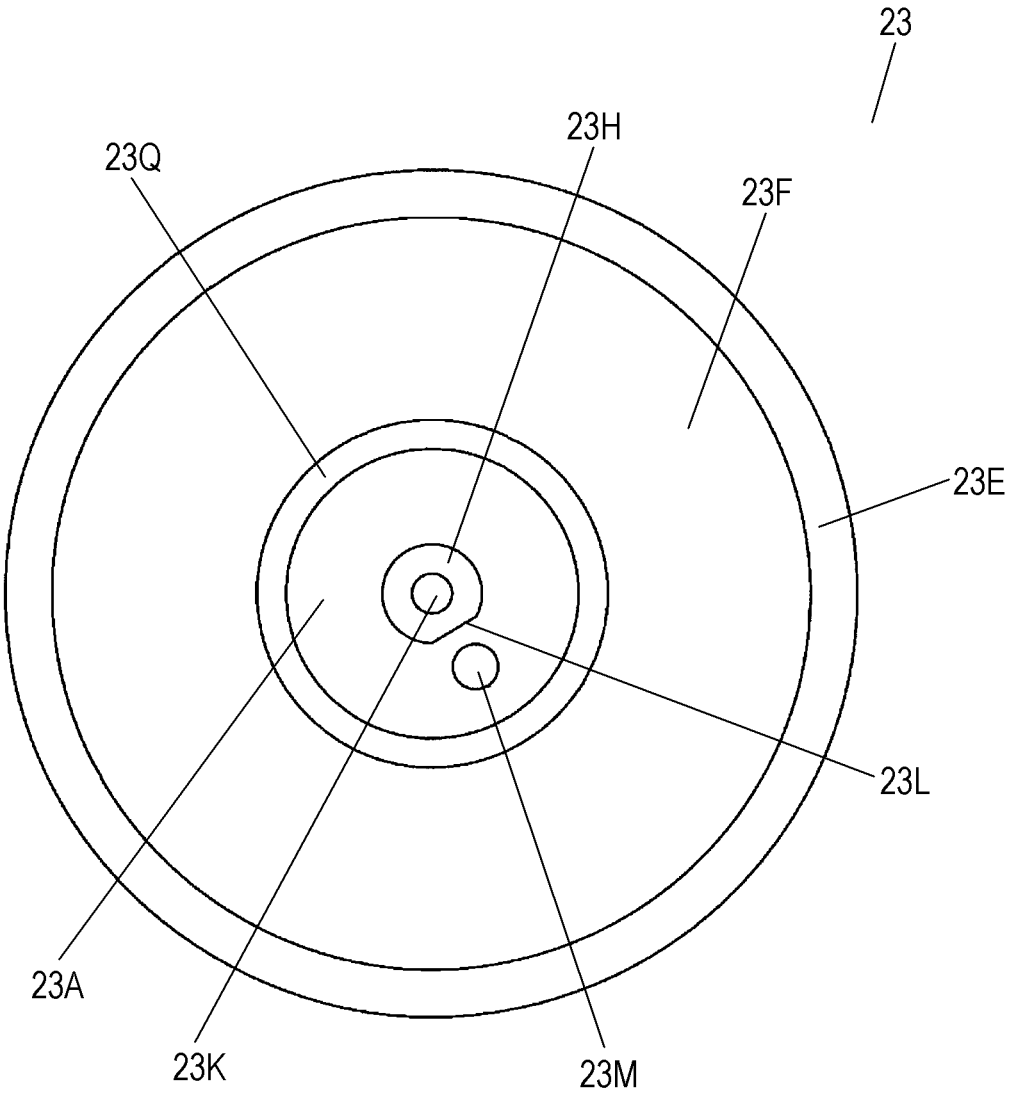
FIG. 15 is a top plan view of a center pole of the loudspeaker shown in FIG. 6.

As shown in FIG. 12, through-hole 24E may be preferably formed in support strut 24. Through-hole 24E passes through support strut 24 from upper end portion 24A to lower end portion 24B. FIG. 15 is a top plan view of center pole 23D. Through-hole 23M is preferably formed in center pole 23D. Through-hole 23M passes through center pole 23D shown in FIG. 9 from upper surface 23A to lower surface 23B. A center axis of through-hole 23M is preferably aligned with an extension of a center axis of through-hole 24E shown in FIG. 12. In order to provide such alignment of holes, as shown in FIG. 15, rotation stopper 23L is preferably formed on insertion hole 23H. This configuration prevents the center axis of through-hole 23M from deviating from the center axis of through-hole 24E shown in FIG. 12.

As shown in FIG. 8, lead wire 59A passes through-hole 24E shown in FIG. 12 and through-hole 23M shown in FIG. 15, and extends to lower surface 23B. As shown in FIG. 9, groove 23P may preferably be formed in lower surface 23B. Groove 23P is formed in lower surface 23B from through-hole 23M to an outer circumferential end of center pole 23D. Lead wire 59A extending to lower surface 23B, as shown in FIG. 13, is arranged along groove 23P, and extends to the outer circumferential end of center pole 23D. As shown in FIG. 8, lead wire 59A extending to the outside of magnetic circuit 23 passes through an outer side surface of magnetic circuit 23 and is connected to terminal 59.

As shown in FIG. 14, fixing element 41 further includes head 41B and shaft 41C. Head 41B is formed at a base of fixing element 41. A diameter of head 41B is larger than a diameter of through-hole 23K. Shaft 41C is disposed between head 41B and threaded portion 41A. Shaft 41C of fixing element 41 extends from a lower end of through-hole 23K to a portion of through-hole 24D around an upper end of through-hole 24D. Threads are not formed on shaft 41C.

Shaft 41C preferably has fitting portion 41D. Fitting portion 41D is fitted into through-hole 23K shown in FIG. 9. This configuration prevents the center axis of fixing element 41 from deviating from the center axis of through-hole 23K shown in FIG. 9.

Fitting portion 41D is preferably fitted in through-hole 24D at lower end portion 24B of support strut 24, as shown in FIG. 12. This configuration prevents the center axis of support strut 24 shown in FIG. 12 from deviating from the center axis of fixing element 41.

Fitting portion 41D is preferably fitted in both through-hole 24D at lower end portion 24B shown in FIG. 12 and through-hole 23K shown in FIG. 9. In this case, a first diameter of through-hole 24D shown in FIG. 12 is equal to a diameter of through-hole 23K shown in FIG. 9. This configuration prevents the center axis of support strut 24 shown in FIG. 12 from deviating from the center axis of fixing element 41. Accordingly, support strut 24 is prevented from deviating from the center axis of magnetic circuit 23.

Fixing element 41 is preferably made of non-magnetic metal. This configuration can prevent a magnetic flux generated through from magnetic circuit 23 and a magnetic flux generated through magnetic circuit 53 shown in FIG. 13 from flowing in fixing element 41. This increases a magnetic flux density in magnetic gap 53D shown in FIG. 13 and a magnetic flux density in magnetic gap 23Q shown in FIG. 9 accordingly.

Figure 16:
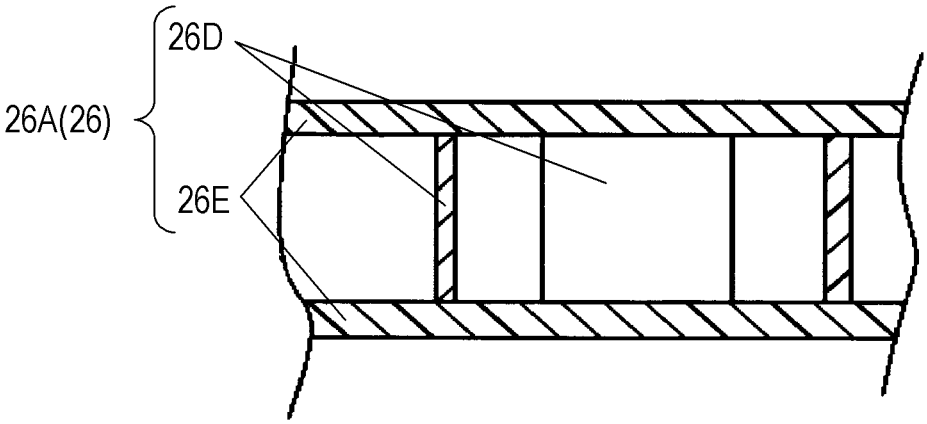
FIG. 16 is an enlarged cross-sectional view of a flat diaphragm of the loudspeaker shown in FIG. 6.

FIG. 16 is an enlarged cross-sectional view of a main part of flat diaphragm 26. Diaphragm body 26A includes skin layers 26E and honeycomb core 26D which is made of metal. Skin layer 26E is formed on both, front and rear surfaces of honeycomb core 26D.

As shown in FIG. 6, flat diaphragm 26 has an annular shape. An inner circumference of flat diaphragm 26 is connected to frame 25 while an outer circumference of flat diaphragm 26 is connected to frame 22. Flat diaphragm 26 includes diaphragm body 26A, outer edge 26B, and inner edge 26C. Outer edge 26B connects an outer circumference of flat diaphragm 26 to frame 22. Inner edge 26C connects an inner circumference of flat diaphragm 26 to frame 25.

As shown in FIG. 13, peak 26P of inner edge 26C is preferably located below straight line L56 extending from the outside of diaphragm body 56A perpendicularly onto a surface of diaphragm body 56A. This configuration suppresses a reflection of sound output from diaphragm body 56A on inner edge 26C. The peak of inner edge 26C is preferably located below arbitrary straight line L56 extending from the outside of diaphragm body 56A shown in FIG. 13 perpendicularly onto a surface of diaphragm body 56A. This configuration can further suppress a reflection of sound output from diaphragm body 56A shown in FIG. 13 on inner edge 26C.

Frame 25 includes connecting surface 51A and connecting surface 51B. Connecting surface 51A is coupled to edge 56B while connecting surface 51B is coupled to inner edge 26C. Connecting surface 51B is located a side below connecting surface 51A. This configuration allows peak 26P of inner edge 26C to be disposed below straight line L56 extending from the outside of diaphragm body 56A perpendicularly onto the surface of diaphragm body 56A.

Inner edge 26C is preferably coupled to a lower surface of flat diaphragm 26. This configuration can suppress a reflection of sound output from diaphragm body 56A on inner edge 26C. Inner edge 26C is coupled to the lower surface of flat diaphragm 26 while outer edge 26B is preferably coupled to a lower surface of diaphragm body 26A. This configuration reduces distortion of flat diaphragm 26.

As shown in FIG. 13, loudspeaker 21 may include ring body 60. In this case, ring body 60 is coupled to inner edge 26C. Peak 26P of inner edge 26C may be preferably located below extension line LL56 expanding straight from an upper surface of ring body 60 through peak 56P of edge 56B. Peak 26P of inner edge 26C is preferably located below extension line LL60 expanding straight from angled surface 60K of ring body 60. This configuration suppresses a reflection of sound output from diaphragm body 56A on ring body 60.

Exemplary Embodiment 2

Figure 17:
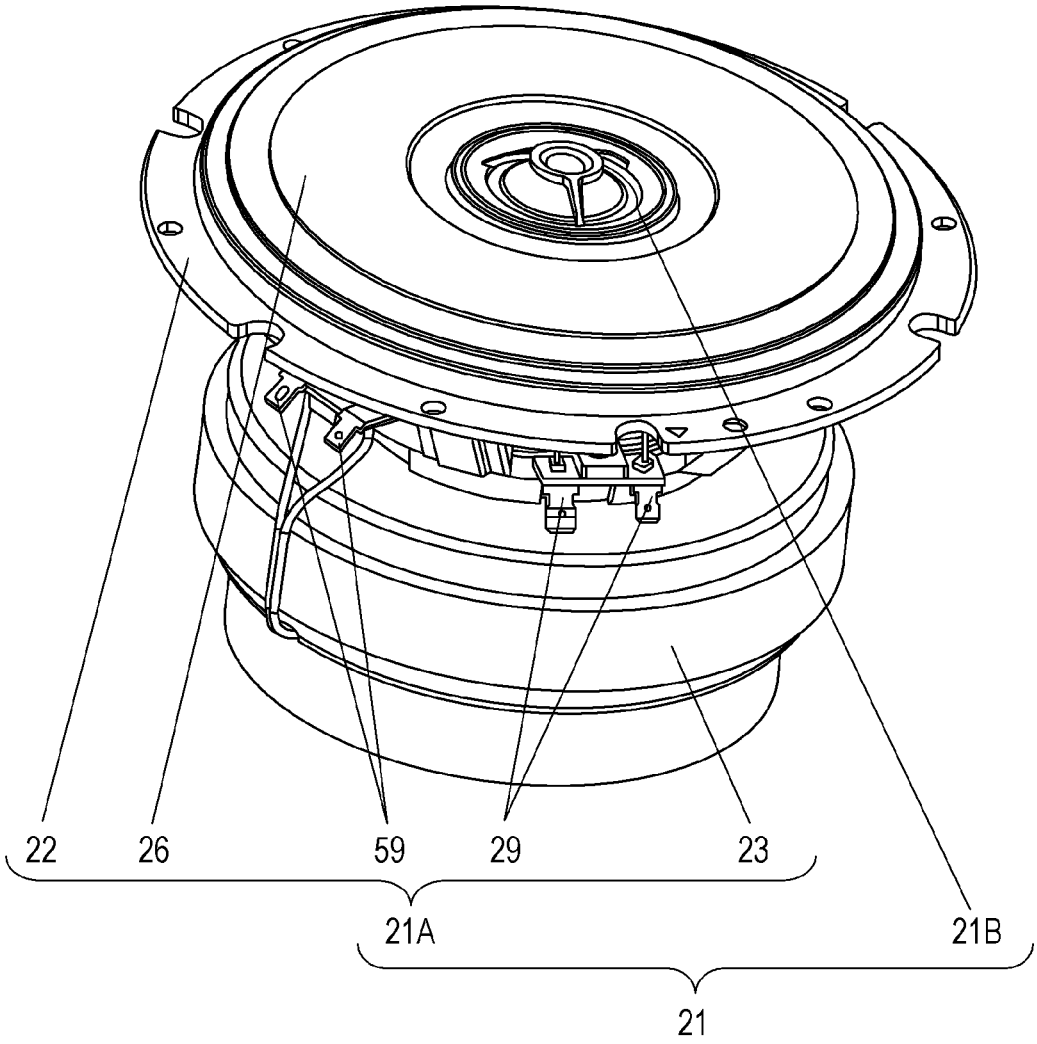
FIG. 17 is a perspective view of a loudspeaker according to Exemplary Embodiment 2.
Figure 18:
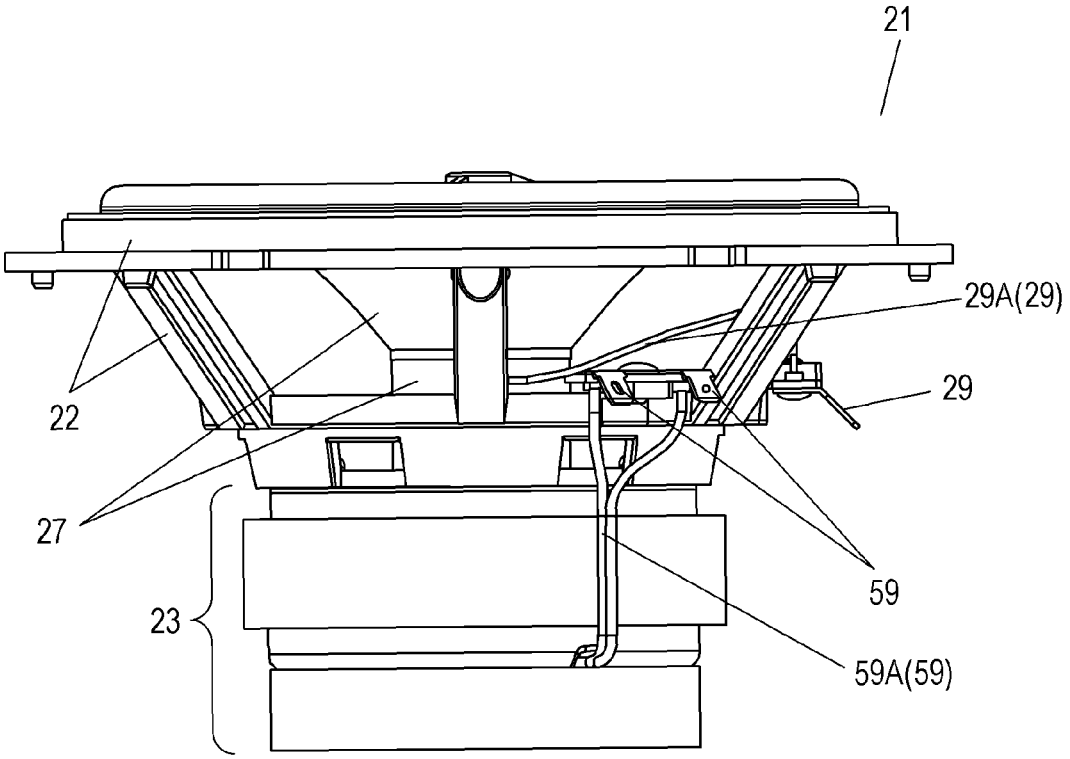
FIG. 18 is a side view of the loudspeaker according to Embodiment 2.
Figure 19:
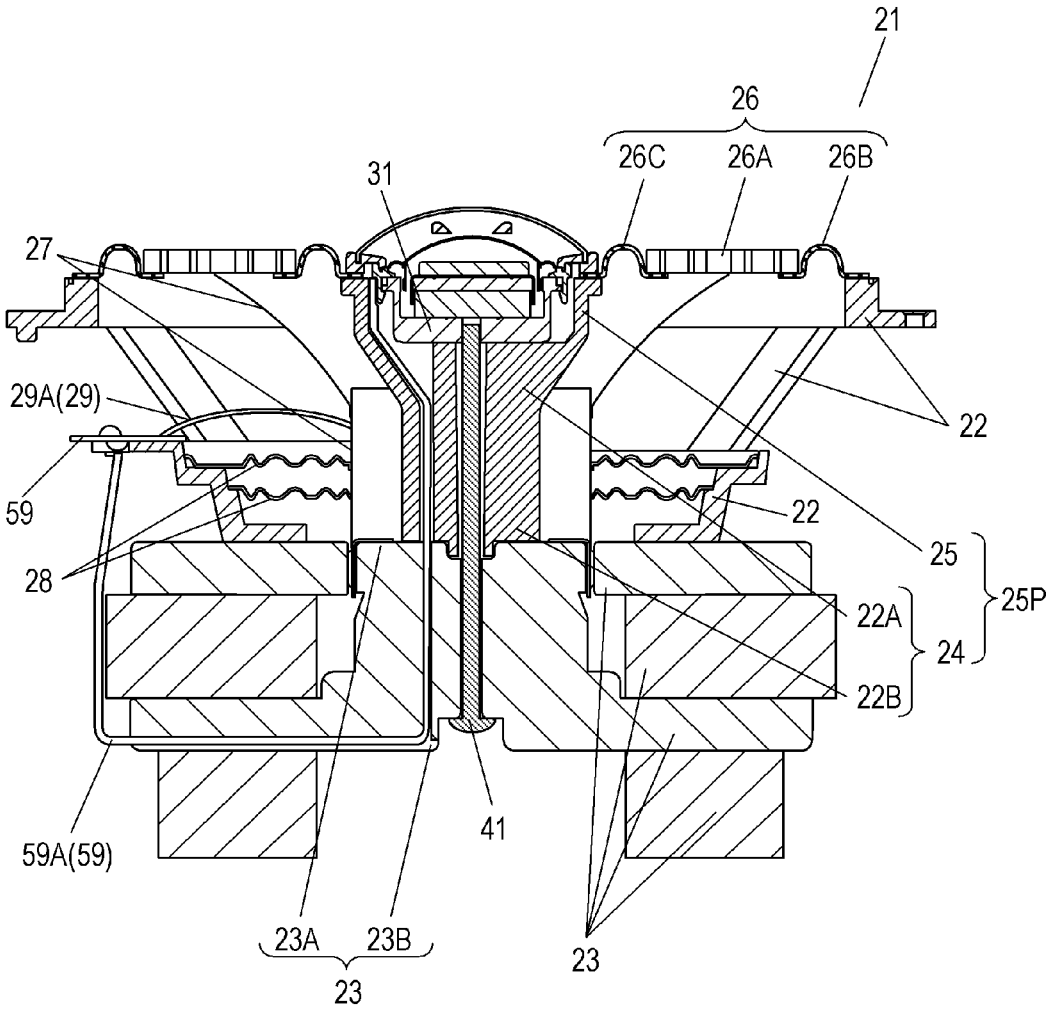
FIG. 19 is a cross-sectional view of the loudspeaker according to Embodiment 2.

FIG. 17 is a perspective view of loudspeaker 21 according to Exemplary Embodiment 2. FIG. 18 is a side view of loudspeaker 21. FIG. 19 is a cross-sectional view of loudspeaker 21.

Loudspeaker 21 includes frame 22, magnetic circuit 23, support strut 24, frame 25, flat diaphragm 26, driver body 27, pressing element 31, and metal-made fixing element 41.

Magnetic circuit 23 is mechanically coupled to frame 22. Magnetic circuit 23 has upper surface 23A and lower surface 23B opposite to upper surface 23A.

Support strut 24 is coupled to upper surface 23A such that support strut 24 stands upwardly on upper surface 23A. Support strut 24 is disposed at the center of upper surface 23A. Support strut 24 includes upper end portion 24A and lower end portion 24B opposite to upper end portion 24A. Lower end portion 24B of support strut 24 faces upper surface 23A.

Frame 25 is coupled to upper end portion 24A. Flat diaphragm 26 has an annular shape. An inner circumference of flat diaphragm 26 is connected to frame 25 while an outer circumference of flat diaphragm 26 is connected to frame 22.

Pressing element 31 is pressed onto upper end portion 24A. That is, pressing element 31 presses lower end portion 24B onto upper surface 23A. Fixing element 41 passes through support strut 24 from lower surface 23B. Support strut 24 is held such that support strut 24 is provided between pressing element 31 and upper surface 23A.

The support strut of the above-mentioned conventional loudspeaker is fixed to the magnetic circuit and the loudspeaker unit with the threaded portion. Hence, the support strut or the loudspeaker unit may be angled with respect to an upper surface of the magnetic circuit. As a result, the diaphragm may be mounted while being angled, or the diaphragm may deviate from the center of the support strut. Hence, distortion characteristic of sound output from the diaphragm is deteriorated.

In loudspeaker 21 according to Embodiment 2, fixing element 41 fastens support strut 24, pressing element 31 and magnetic circuit 23 to each other while pressing element 31 is pressed onto upper end portion 24A. That is, support strut 24 is held such that support strut 24 is provided between pressing element 31 and upper surface 23A. Accordingly, support strut 24 is prevented from being angled with respect to upper surface 23A. Further, frame 25 can be disposed accurately at the center of magnetic circuit 23. Further, the connecting surface of frame 25 is reliably parallel with flat diaphragm 26 and upper surface 23A. Accordingly, flat diaphragm 26 is prevented from being angled with respect to upper surface 23A, and flat diaphragm 26 is prevented from deviating from the center of magnetic circuit 23. As a result, distortion of sound output from loudspeaker 21 can be decreased.

Fixing element 41 is made of metal, and thus, is hard, hence allowing fixing element 41 to increase the fastening strength among pressing element 31, support strut 24, and magnetic circuit 23.

Loudspeaker 21 according to Embodiment 2 will be detailed below. As shown in FIG. 17, loudspeaker 21 includes loudspeaker (loudspeaker unit) 21A and loudspeaker (loudspeaker unit) 21B. A frequency band of sound output from loudspeaker 21A is different from a frequency band of sound output from loudspeaker 21B. Loudspeaker 21 includes terminals 29 and terminals 59. Terminals 29 and 59 are fixed to frame 22. Terminals 29 supply signals to loudspeaker 21A. Terminals 59 supply signals to loudspeaker 21B.

Loudspeaker 21A is, e.g. a full-range loudspeaker. Loudspeaker 21A may not necessarily be a full-range loudspeaker, and may be a woofer or a subwoofer. On the other hand, loudspeaker 21B is, e.g. a dome-type tweeter. Loudspeaker 21B may not necessarily be a dome-type tweeter, and may be a cone-type tweeter. Loudspeaker 21B may not necessarily be a tweeter, and may be a squawker or a full-range loudspeaker. Further, loudspeaker 21B may be an equalizer having a spherical shape. Alternatively, loudspeaker 21 may include a device having a function, such as a light emitting unit for decorating loudspeaker 21 by illumination, other than a function of a loudspeaker in place of loudspeaker 21B.

Loudspeaker 21B is disposed at the center of loudspeaker 21A. That is, the center of loudspeaker 21A and the center of loudspeaker 21B are coaxially disposed. That is, loudspeaker 21 is a coaxial-type loudspeaker. This configuration stabilizes a position of a sound image generated from loudspeaker 21.

Loudspeaker 21A and loudspeaker 21B preferably have circular outer profiles viewing from above loudspeaker 21. This configuration can decrease distortion of sound output from loudspeaker 21.

Figure 20:
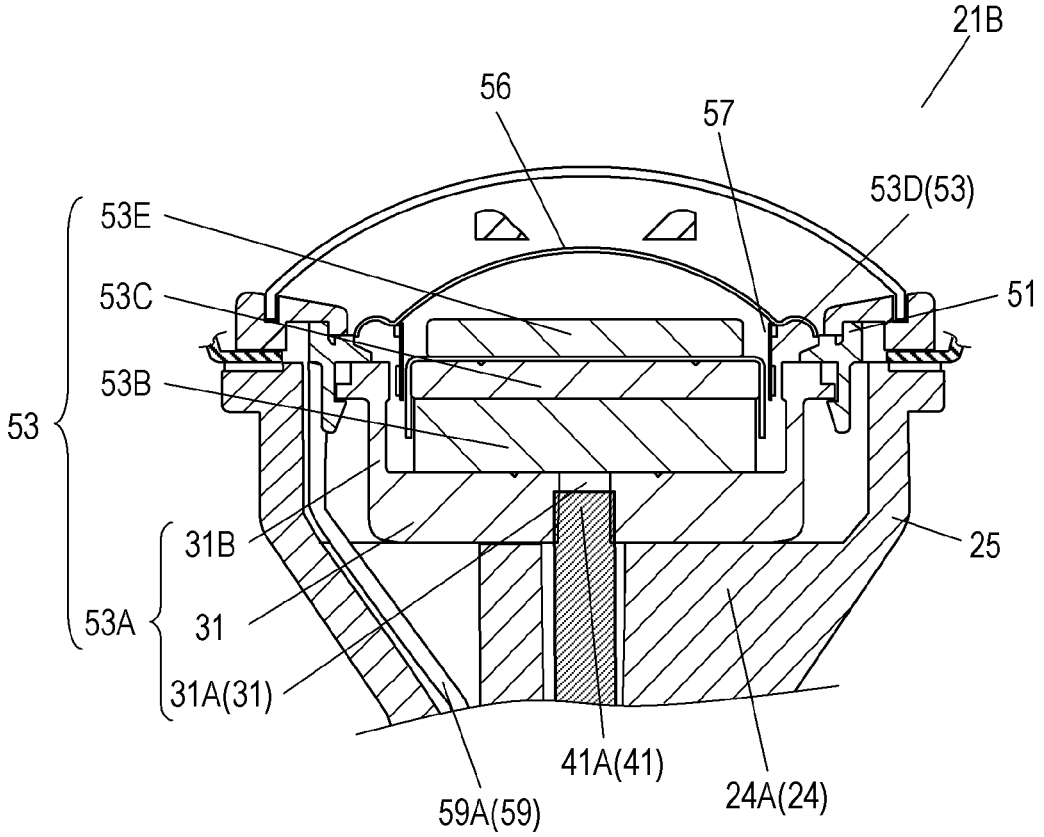
FIG. 20 is a cross-sectional view of a loudspeaker unit of the loudspeaker according to Embodiment 2.

Loudspeaker 21B will be described with reference to drawings. FIG. 20 is a cross-sectional view of loudspeaker 21B. Loudspeaker 21B is accommodated in frame 25. Frame 25 is disposed at the center of loudspeaker 21A shown in FIG. 17. Loudspeaker 21B includes frame 51, diaphragm 56, magnetic circuit 53 having magnetic gap 53D, and voice coil 57.

Frame 51 is accommodated in frame 25. An outer circumference of diaphragm 56 is connected to frame 51. Diaphragm 56 preferably includes an edge. In this case, an outer circumference of the edge is coupled to frame 51.

Magnetic circuit 53 includes yoke 53A, magnet 53B, and upper plate 53C. Magnet 53B and upper plate 53C have a circular columnar shape. Yoke 53A includes pressing element 31 and tubular portion 31C. Tubular portion 31C rises from an outer circumferential end of pressing element 31. Pressing element 31 has a circular shape viewing from above. Tubular portion 31C has a cylindrical shape. That is, yoke 53A has a cylindrical shape with a bottom. This configuration allows pressing element 31 to constitute a portion of the magnetic circuit, hence decreasing the number of parts of the loudspeaker. Accordingly, the number of man-hours for assembling loudspeaker 21 shown in FIG. 19 can be decreased.

Pressing element 31 and tubular portion 31C are formed unitarily. In this case, tubular portion 31C is bent from pressing element 31. That is, yoke 53A has a cylindrical shape with a bottom. This configuration can enhance productivity of yoke 53A.

Yoke 53A and upper plate 53C are made of magnetic metal material. Accordingly, pressing element 31 is made of magnetic metal material. Yoke 53A and upper plate 53C are preferably made of iron. In the case that yoke 53A is made of iron, pressing element 31 is also made of iron.

The loudspeaker according to Embodiment 2 may not necessarily have the configuration in which pressing element 31 and tubular portion 31C are formed unitarily. Pressing element 31 and tubular portion 31C may be formed as members separate from each other. Tubular portion 31C may not necessarily have a cylindrical shape, and may have a cylindrical shape with bottom. That is, pressing element 31 and tubular portion 31C are disposed such that pressing element 31 overlaps the bottom of tubular portion 31C. In this case, pressing element 31 is preferably be made of magnetic material. In magnetic circuit 53, a region located below an outer circumferential portion of magnet 53B has a largest magnetic resistance. A bottom portion of yoke 53A overlaps pressing element 31 below the outer circumferential portion of magnet 53B, hence decreasing a magnetic resistance in the region located below the outer circumferential portion of magnet 53B, accordingly increasing a magnetic flux density in magnetic gap 53D.

Magnet 53B is coupled to pressing element 31. Magnet 53B is disposed at the center of pressing element 31. Yoke 53A is magnetically coupled to magnet 53B. Upper plate 53C is mounted on an upper surface of magnet 53B opposite to pressing element 31. Upper plate 53C is magnetically coupled to magnet 53B. Yoke 53A and upper plate 53C are disposed such that an inner circumferential surface of yoke 53A faces an outer circumferential surface of upper plate 53C. This configuration provides magnetic gap 53D between the inner circumferential surface of yoke 53A and the outer circumferential surface of upper plate 53C.

Canceling magnet 53E may be disposed on upper plate 53C. In this case, canceling magnet 53E is disposed such that a magnetic flux generated by canceling magnet 53E repels against a magnetic flux generated by magnet 53B.

Voice coil 57 has end portion 157 and end portion 257 opposite to end portion 157. End portion 157 of voice coil 57 is inserted into magnetic gap 53D while end portion 257 of voice coil 57 is coupled to diaphragm 56. Terminal 59 shown in FIG. 17 preferably includes lead wire 59A. Voice coil 57 is electrically connected to terminals 59 via lead wire 59A.

Loudspeaker 21A will be described below. As shown in FIG. 19, loudspeaker 21A includes frame 22, magnetic circuit 23, support strut 24, frame 25, flat diaphragm 26, and driver body 27. Magnetic circuit 23 has magnetic gap 23Q. Loudspeaker 21A may further include dampers 28D, 28E. Frame 22 is preferably made of metal. This configuration provides frame 22 with a large strength. Frame 22 is preferably made of non-magnetic material. This configuration suppresses leakage of a magnetic flux generated from magnetic circuit 23 to the frame, hence increasing a magnetic flux density in magnetic gap 23Q shown in FIG. 24. Frame 22 is preferably formed by, e.g. die-casting aluminum as a material. Internal loss of frame 22 formed by die-casting of aluminum is larger than internal loss of frame 22 made of metal, such as iron. This configuration suppresses peaks and dips in frequency sound pressure characteristics of loudspeaker 21 caused by resonance of frame 22, and enhances productivity of frame 22.

Flat diaphragm 26 includes diaphragm body 26A, outer edge 26B, and inner edge 26C. Outer edge 26B connects an outer circumference of flat diaphragm 26 to frame 22. On the other hand, inner edge 26C connects an inner circumference of flat diaphragm 26 to frame 25. Outer edge 26B and inner edge 26C are coupled to a lower surface of diaphragm body 26A.

Figure 21:
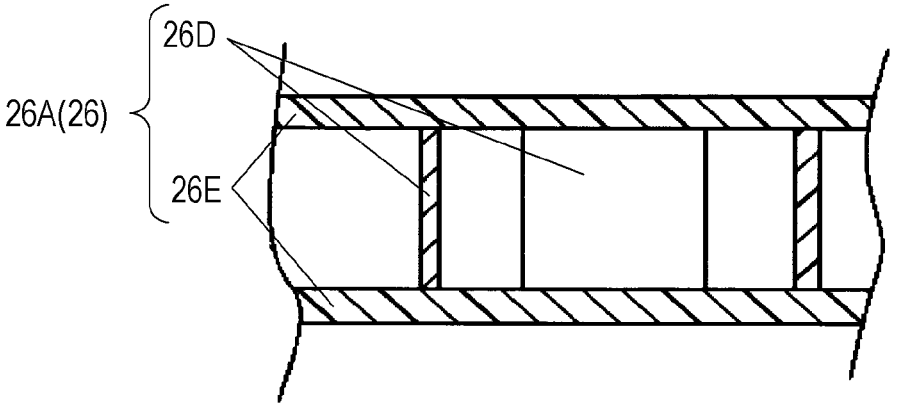
FIG. 21 is an enlarged cross-sectional view of a flat diaphragm of the loudspeaker according to Embodiment 2.

FIG. 21 is an enlarged cross-sectional view of a main part of flat diaphragm 26. Diaphragm body 26A includes honeycomb core 26D made of metal and skin layers 26E. Skin layer 26E is formed on an upper surface and a lower surface of honeycomb core 26D.

Figure 22:
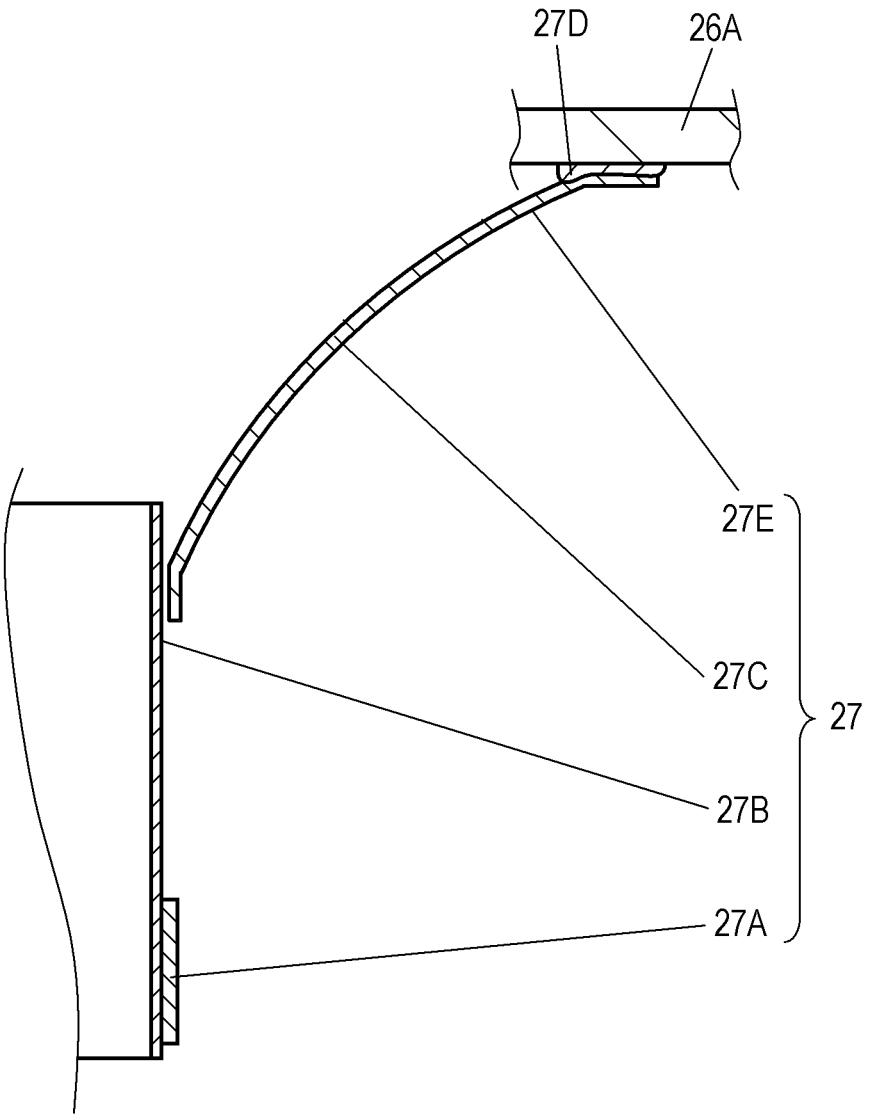
FIG. 22 is an enlarged cross-sectional view of a driver body of the loudspeaker according to Embodiment 2.

FIG. 22 is an enlarged cross-sectional view of driver body 27. Driver body 27 includes voice coil 27A, bobbin 27B, and coupling cone 27C. Voice coil 27A is wound on end portion 127B of bobbin 27B. End portion 127B of bobbin 27B is coupled to end portion 127C of coupling cone 27C. End portion 227C of coupling cone 27C is coupled to the lower surface of diaphragm body 26A. Voice coil 27A is inserted into magnetic gap 23Q shown in FIG. 24. Driver body 27 drives flat diaphragm 26 in response to signals which flows into voice coil 27A.

End portion 227C of coupling cone 27C is coupled to the lower surface of diaphragm body 26A with adhesive 27D. End portion 227C of coupling cone 27C includes adhering portion 27F and angled portion 27E. Adhering portion 27F is parallel to the lower surface of diaphragm body 26A. Angled portion 27E is angled with respect to the lower surface of diaphragm body 26A. This configuration allows adhesive 27D to fill between diaphragm body 26A and angled portion 27E. Thus, in coupling cone 27C, diaphragm body 26A adheres to adhering portion 27F while diaphragm body 26A adheres to angled portion 27E. This configuration increases a coupling strength between coupling cone 27C and flat diaphragm 26. As a result, a speed of sound of flat diaphragm 26 is increased. Further, distortion of sound output from flat diaphragm 26 can be decreased.

Terminals 29 shown in FIG. 17 preferably include lead wire 29A shown in FIG. 19. In this case, a hole which allows lead wire 29A to pass through frame 22 is formed in frame 22. This configuration connects voice coil 27A electrically to terminals 29 via lead wire 29A.

Figure 23:
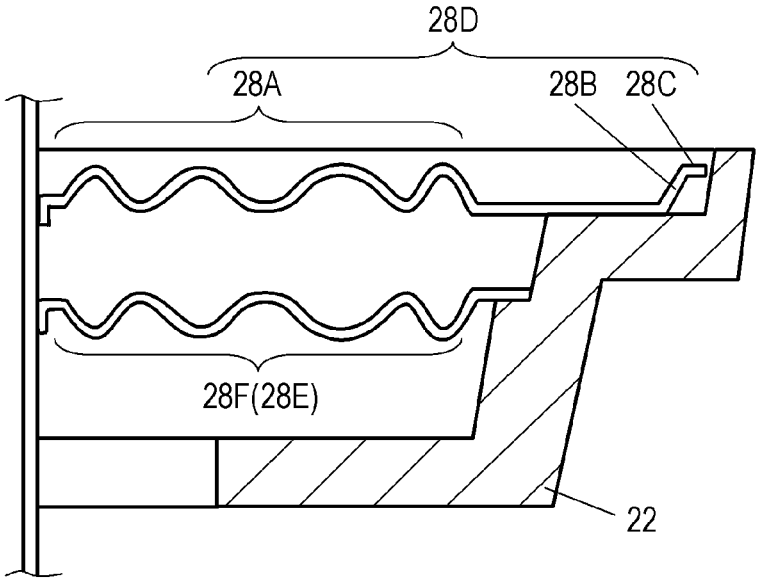
FIG. 23 is an enlarged cross-sectional view of a damper of the loudspeaker according to Embodiment 2.

FIG. 23 is an enlarged cross-sectional view of dampers 28D and 28E. Damper 28D includes body portion 28A, an inner circumferential portion, and an outer circumferential portion. Body portion 28A is disposed between the inner circumferential portion and the outer circumferential portion. Body portion 28A has a cross section having a wave shape. The inner circumferential portion of damper 28D is coupled to bobbin 27B while the outer circumferential portion of damper 28D is coupled to frame 22.

Bent portion 28B which is bent upward or downward from body portion 28A is preferably provided at the outer circumferential portion of damper 28D. This configuration can suppress plastic deformation of damper 28D when an external force is applied to damper 28D. flange 28C which is further bent from bent portion 28B is preferably provided at a distal end of bent portion 28B. This configuration can further suppress plastic deformation of damper 28D.

Loudspeaker 21A may further include damper 28E. Damper 28E includes body portion 28F, an inner circumferential portion, and an outer circumferential portion. Body portion 28F is disposed between the inner circumferential portion and the outer circumferential portion. Body portion 28F has a cross section having a wave shape. The inner circumferential portion of damper 28E is coupled to bobbin 27B while the outer circumferential portion of damper 28E is coupled to frame 22. In this case, the shape of body portion 28A of damper 28D is preferably symmetrical to the shape of body portion 28F of damper 28E with respect to a plane perpendicular to a center axis of voice coil 27A. This configuration can decrease distortion of voice coil 27A in upward and downward directions, accordingly reducing distortion of sound output from loudspeaker 21. In this case, flange 28C is preferably provided at the outer circumferential portion of either damper 28D or damper 28E. This configuration prevents damper 28D and damper 28E from being incorrectly coupled to bobbin 27B and frame 22 due to opposite arrangement of the damper 28D and the damper 28E.

Figure 24:
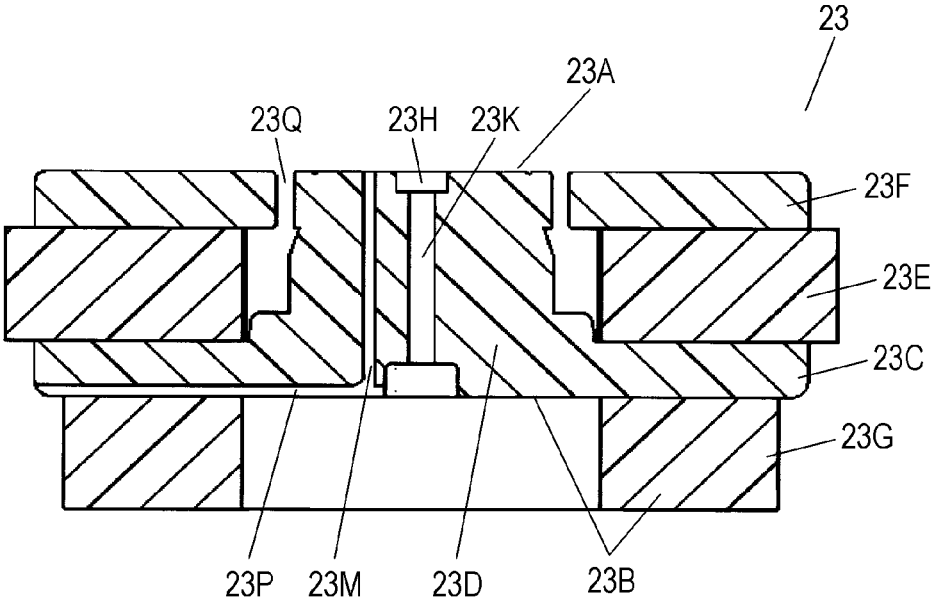
FIG. 24 is a cross-sectional view of a magnetic circuit of the loudspeaker according to Embodiment 2.

FIG. 24 is a cross-sectional view of magnetic circuit 23. Magnetic circuit 23 is preferably an outer magnet type magnetic circuit. Outer magnet type magnetic circuit 23 includes lower plate 23C, center pole 23D, magnet 23E, and upper plate 23F. Lower plate 23C, center pole 23D, and upper plate 23F are made of magnetic material. Lower plate 23C, center pole 23D and upper plate 23F is preferably made of iron.

Center pole 23D is a portion protruding at the center of lower plate 23C. Magnet 23E is coupled to an upper surface of lower plate 23C. Magnet 23E has an annular shape having a hole formed at the center thereof. Upper plate 23F is coupled to an upper surface of magnet 23E. Upper plate 23F also has an annular shape having a hole formed at the center thereof. This configuration allows lower plate 23C, center pole 23D, magnet 23E, and upper plate 23F to be magnetically coupled to each other. Center pole 23D passes through the hole formed in magnet 23E and the hole formed in upper plate 23F. Center pole 23D and upper plate 23F are disposed such that an outer side surface of center pole 23D faces an inner side surface of upper plate 23F. This configuration provides magnetic gap 23Q between the outer side surface of center pole 23D and the inner side surface of upper plate 23F.

In outer magnet type magnetic circuit 23, an upper surface of center pole 23D constitutes upper surface 23A while a lower surface of center pole 23D constitutes lower surface 23B. Through-hole 23K is formed in center pole 23D. Through-hole 23K passes through center pole 23D from lower surface 23B to upper surface 23A. A center axis of through-hole 23K is aligned with a center axis of center pole 23D viewing from above.

Magnetic circuit 23 may further include canceling magnet 23G. Canceling magnet 23G is coupled to a lower surface of lower plate 23C. Canceling magnet 23G preferably has an annular shape. In this case, canceling magnet 23G generates a magnetic field in a direction that the magnetic field repels against a magnetic flux generated from magnet 23E. That is, a surface of magnet 23E and a surface of canceling magnet 23G which face each other have the same magnetic polarity. This configuration increases a magnetic flux density in magnetic gap 23Q. Insertion hole 23H is formed in upper surface 23A of center pole 23D.

Magnetic circuit 23 may not necessarily be the outer magnet type magnetic circuit, and may be an inner magnet type magnetic circuit. Alternatively, magnetic circuit 23 may be configured by combining an outer magnet type magnetic circuit and an inner magnet type magnetic circuit.

Figure 25:
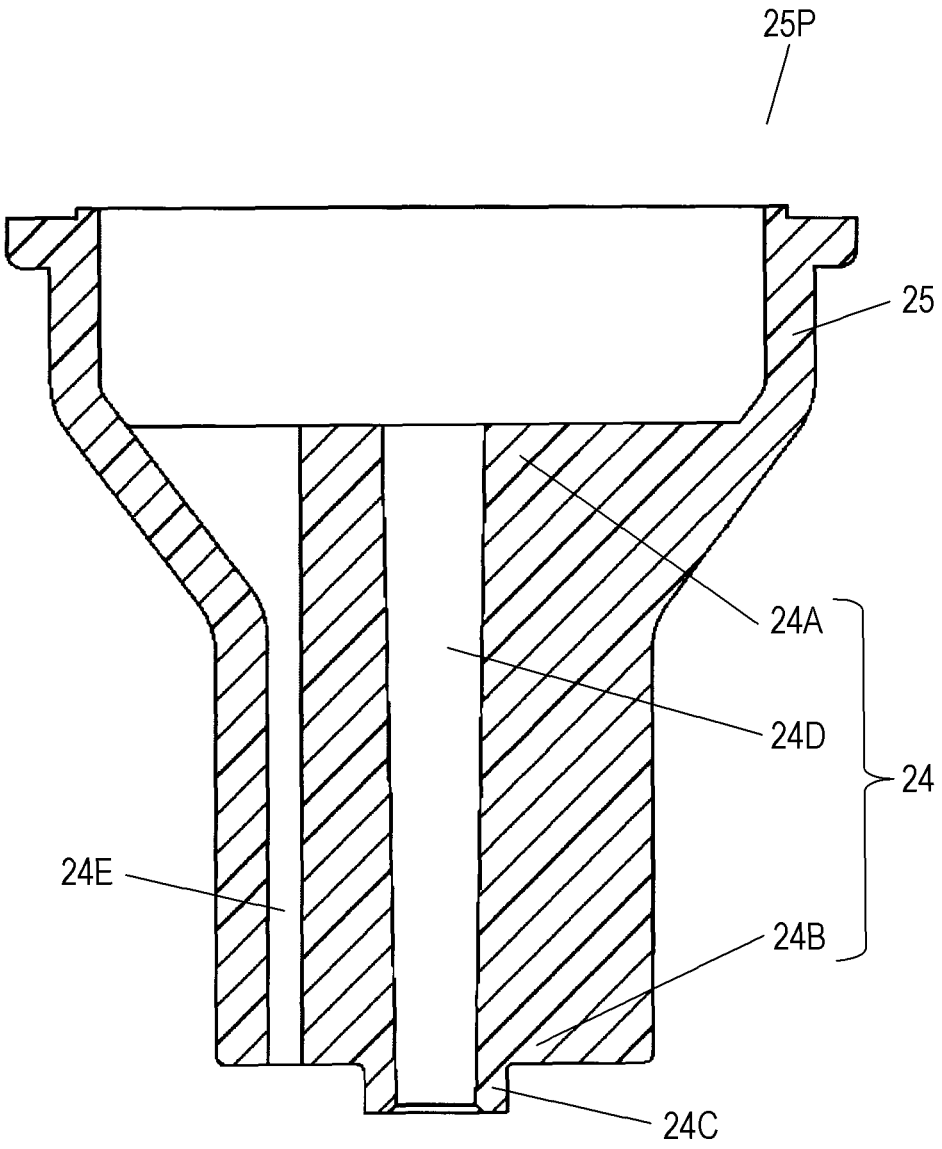
FIG. 25 is a cross-sectional view of a support strut of the loudspeaker according to Embodiment 2.

FIG. 25 is a cross-sectional view of support strut 24. Protrusion 24C is formed on lower end portion 24B of support strut 24. Protrusion 24C is fitted in insertion hole 23H shown in FIG. 24. This configuration allows support strut 24 to maintain a state shown in FIG. 19 where support strut 24 stands upward on upper surface 23A of center pole 23D. Insertion hole 23H shown in FIG. 24 is formed in the center of upper surface 23A of center pole 23D. That is, a center axis of protrusion 24C is aligned with a center axis of insertion hole 23H and a center axis of through-hole 23K shown in FIG. 24. Accordingly, support strut 24 can be disposed accurately at the center of center pole 23D shown in FIG. 24.

Support strut 24 has through-hole 24D which passes through support strut 24 from lower end portion 24B to upper end portion 24A. A center axis of through-hole 24D is aligned with the center axis of through-hole 23K shown in FIG. 24. This configuration allows fixing element 41 shown in FIG. 19 to be inserted straight into through-hole 24D.

Through-hole 24D provided in lower end portion 24B has a first diameter while through-hole 24D provided in upper end portion 24A has a second diameter. The second diameter is preferably larger than the first diameter. That is, an inner circumferential surface of through-hole 24D is angled such that a diameter of through-hole 24D gradually increases toward upper end portion 24A from lower end portion 24B. With this configuration, even if through-hole 24D is angled with respect to a center axis of support strut 24, fixing element 41 shown in FIG. 19 inserted into through-hole 24D is prevented from being angled with respect to the center axis of support strut 24. Accordingly, support strut 24 is prevented from being angled with respect to upper surface 23A shown in FIG. 19.

Support strut 24 is preferably made of metal. Support strut 24 made of metal can have more stable size and shape against, e.g. an external force and a change in temperature environment than support strut 24 made of resin. Accordingly, a change in distortion characteristics of loudspeaker 21 shown in FIG. 19 against an external force and a change in temperature environment can be suppressed.

Support strut 24, pressing element 31, and center pole 23D will be detailed with reference to FIG. 19. Support strut 24 is preferably made of material softer than material of pressing element 31. That is, pressing element 31 is preferably harder than support strut 24. Support strut 24 is preferably made of material softer than material of center pole 23D. That is, center pole 23D is preferably harder than support strut 24. Support strut 24 is held such that support strut 24 is provided between pressing element 31 and center pole 23D which are harder than support strut 24.

This configuration allows pressing element 31 to press an upper surface of support strut 24, and allows upper surface 23A of center pole 23D to press a lower surface of support strut 24. Support strut 24 is less hard than pressing element 31, hence causing a portion of the upper surface of support strut 24 to deform. Further, Support strut 24 is less hard than center pole 23D, hence causing a portion of the lower surface of support strut 24 to deform. Accordingly, support strut 24 can be disposed perpendicularly to upper surface 23A of magnetic circuit 23 reliably.

Support strut 24 is preferably made of non-magnetic material. This configuration can prevent a magnetic flux generated by magnetic circuit 23 from flowing into support strut 24, hence increasing a magnetic flux density in magnetic gap 23Q accordingly. Support strut 24 is preferably formed by die-casting aluminum as a material.

Figure 26:
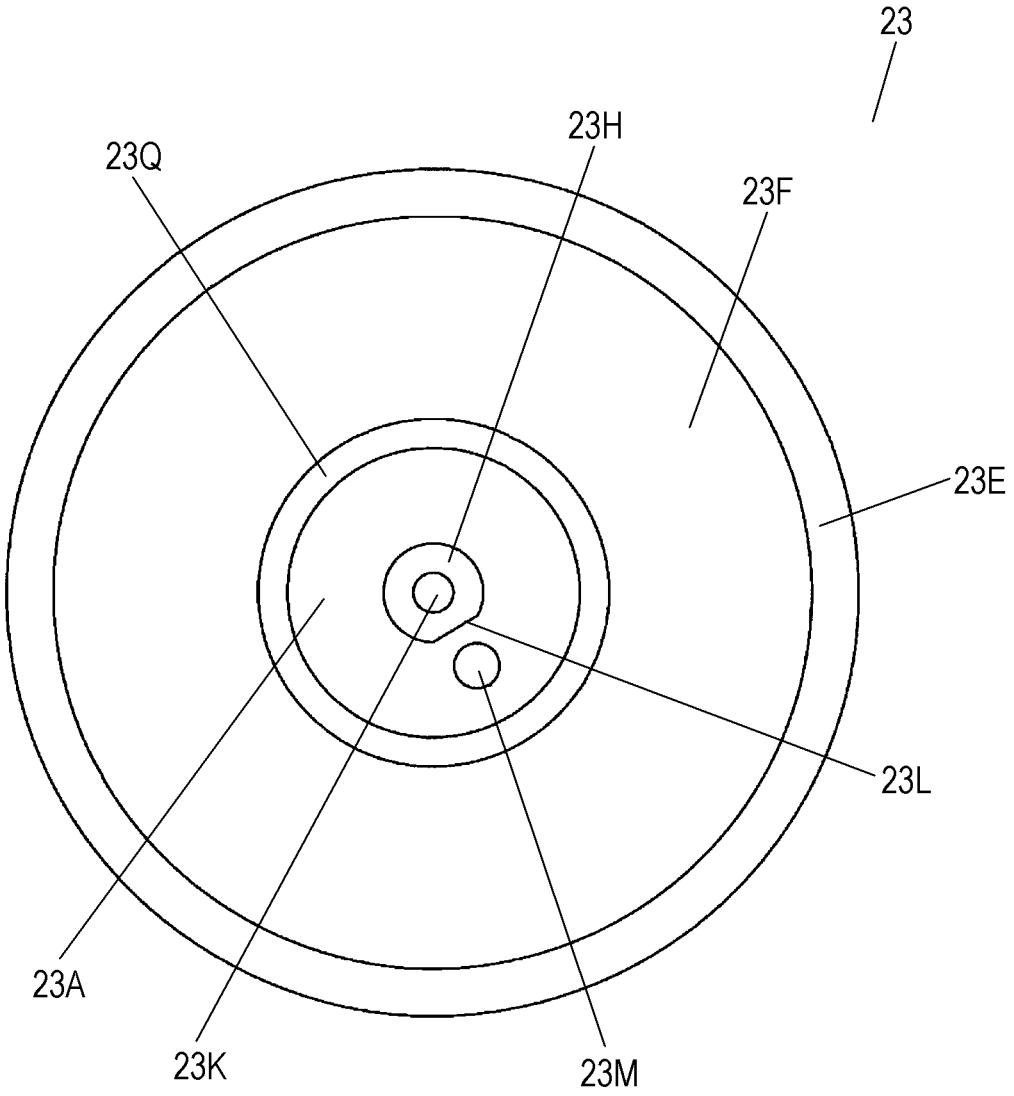
FIG. 26 is a top plan view of a center pole of the loudspeaker according to Embodiment 2.

As shown in FIG. 25, through-hole 24E is preferably formed in support strut 24. Through-hole 24E passes through support strut 24 from upper end portion 24A to lower end portion 24B. FIG. 26 is a top plan view of center pole 23D. Center pole 23D preferably has through-hole 23M therein. Through-hole 23M passes through center pole 23D shown in FIG. 24 from upper surface 23A to lower surface 23B. A center axis of through-hole 23M is preferably on an extension of a center axis of through-hole 24E shown in FIG. 25. In order to align these holes, as shown in FIG. 26, rotation stopper 23L is formed on insertion hole 23H. This configuration prevents the center axis of through-hole 23M from deviating from the center axis of through-hole 24E shown in FIG. 25.

As shown in FIG. 19, lead wire 59A passes through-hole 24E shown in FIG. 25 and through-hole 23M shown in FIG. 26, and extends to lower surface 23B. As shown in FIG. 24, groove 23P is preferably formed in lower surface 23B. Groove 23P is formed in lower surface 23B from through-hole 23M to an outer circumference of center pole 23D. Lead wire 59A extending to lower surface 23B, as shown in FIG. 19, is arranged along groove 23P, and extends to the outer circumferential end of center pole 23D. As shown in FIG. 19, lead wire 59A extending to the outside of magnetic circuit 23 passes an outer side surface of magnetic circuit 23 and is connected to terminals 59.

As shown in FIG. 25, frame 25 is formed on upper end portion 24A of support strut 24. Frame 25 stands upward on upper end portion 24A. Frame 25 is coupled to an outer circumferential end of upper end portion 24A. Frame 25 is preferably formed unitarily with support strut 24. This configuration positions frame 25 accurately with respect to support strut 24, accordingly preventing flat diaphragm 26 shown in FIG. 19 from being angled and preventing flat diaphragm 26 shown in FIG. 19 from deviating from the center of support strut 24. Further, it is not necessary to form frame 25 and support strut 24 separately, hence enhancing productivity of frame 25.

In order to form frame 25 and support strut 24 unitarily, frame 25 and support strut 24 are preferably by die-casting aluminum as a material. This configuration can prevent vibrations generated by loudspeaker 21A shown in FIG. 17 from transmitting to loudspeaker 21B, and prevent vibrations generated by loudspeaker 21B from transmitting to loudspeaker 21A. Frame 25 and support strut 24 may not necessarily be formed unitarily, and frame 25 and support strut 24 may be formed separately. In this case, frame 25 may be made of a resin.

Figure 27:
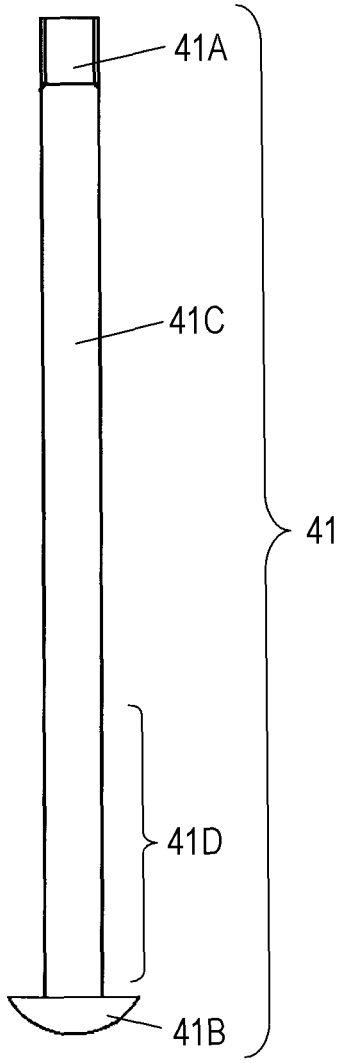
FIG. 27 is a side view of a fixing element of the loudspeaker according to Embodiment 2.

FIG. 27 is a side view of fixing element 41. Fixing element 41 includes threaded portion 41A, head 41B, and shaft 41C. Head 41B is formed at a base portion of fixing element 41. A diameter of head 41B is larger than a diameter of through-hole 23K. Threaded portion 41A is formed at a distal end of fixing element 41. Shaft 41C is disposed between head 41B and threaded portion 41A. Shaft 41C of fixing element 41 is positioned in a range from a lower end of through-hole 23K to a position near an upper end of through-hole 24D. Threads are not formed on shaft 41C. Threaded hole 31A shown in FIG. 20 is formed in pressing element 31. Threaded portion 41A shown in FIG. 27 is engaged with threaded hole 31A shown in FIG. 20. Fixing element 41 is made of metal, thus having high hardness. Hence, even when vibrations or a change in temperature are applied to loudspeaker 21, the generation of loosening of threaded portion 41A can be suppressed.

Shaft 41C preferably includes fitting portion 41D. Fitting portion 41D is fitted into through-hole-23K shown in FIG. 24. This configuration prevents the center axis of fixing element 41 from deviating from the center axis of through-hole 23K shown in FIG. 24.

Fitting portion 41D is preferably fitted into through-hole 24D in lower end portion 24B of support strut 24 shown in FIG. 25. This configuration prevents the center axis of support strut 24 shown in FIG. 25 from deviating from the center axis of fixing element 41.

Fitting portion 41D is preferably fitted in both through-hole 24D in lower end portion 24B shown in FIG. 25 and through-hole 23K shown in FIG. 24. In this case, a first diameter of through-hole 24D shown in FIG. 25 is equal to a diameter of through-hole 23K shown in FIG. 24. This configuration prevents the center axis of support strut 24 shown in FIG. 25 from deviating from the center axis of fixing element 41. Accordingly, support strut 24 is disposed such that support strut 24 is prevented from deviating from the center axis of magnetic circuit 23.

In FIG. 19, fixing element 41 is preferably made of non-magnetic metal. This configuration prevents a magnetic flux generated by magnetic circuit 23 and a magnetic flux generated by magnetic circuit 53 shown in FIG. 20 from flowing in fixing element 41. Accordingly, a magnetic flux density in magnetic gap 53D shown in FIG. 20 and a magnetic flux density in magnetic gap 23Q shown in FIG. 24 can be increased.

Pressing element 31 is preferably softer than fixing element 41. That is, fixing element 41 is harder than pressing element 31. In view of the above, fixing element 41 is made of stainless steel. This configuration can suppress the deformation of threaded portion 41A shown in FIG. 27 when threaded portion 41A shown in FIG. 27 is inserted into and fastened to threaded-hole 31A shown in FIG. 20. That is, some threads formed on threaded hole 31A shown in FIG. 20 can deform to conform with threaded portion 41A shown in FIG. 27. Accordingly, even when fixing element 41 is inserted into pressing element 31 while a center axis of threaded hole 31A shown in FIG. 20 is angled with respect to a center axis of fixing element 41, the angle of the center axis of threaded hole 31A with respect to the center axis of fixing element 41 can be decreased. As a result, it is possible to increase perpendicularity of the center axis of support strut 24 with respect to a surface of pressing element 31 pressed to support strut 24.

As described above, fixing element 41 is harder than pressing element 31. Further, pressing element 31 and center pole 23D shown in FIG. 24 are harder than support strut 24. This configuration prevents the center axis of support strut 24 from deviating from the center axis of magnetic circuit 23. Further, the center axis of support strut 24 can be perpendicular to upper surface 23A of magnetic circuit 23 reliably.

Accordingly, a step is not formed between a coupling surface of frame 22 with outer edge 26B and a coupling surface of the frame with inner edge 26C. As a result, flat diaphragm 26 is prevented from being angled. That is, the center axis of magnetic circuit 23 can be perpendicular to a surface of flat diaphragm 26 reliably. Accordingly, flat diaphragm 26 can be prevented from rolling, and as a result, reduce distortion of sound output from loudspeaker 21. Further, magnetic gap 23Q shown in FIG. 24 can be narrowed, and increase a magnetic flux density in magnetic gap 23Q accordingly.

Further, a center axis of flat diaphragm 26 is prevented from deviating from a center axis of magnetic circuit 23, and accordingly, suppresses rolling of flat diaphragm 26, hence reducing distortion of sound output from loudspeaker 21. Magnetic gap 23Q shown in FIG. 24 can be narrowed, and increase a magnetic flux density in magnetic gap 23Q accordingly.

Exemplary Embodiment 3

Figure 28:
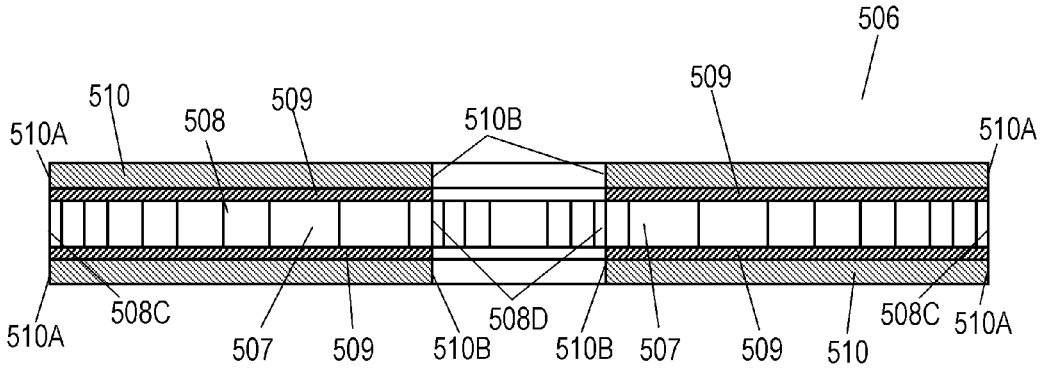
FIG. 28 is a cross-sectional view of a flat diaphragm according to Exemplary Embodiment 3.
Figure 29:
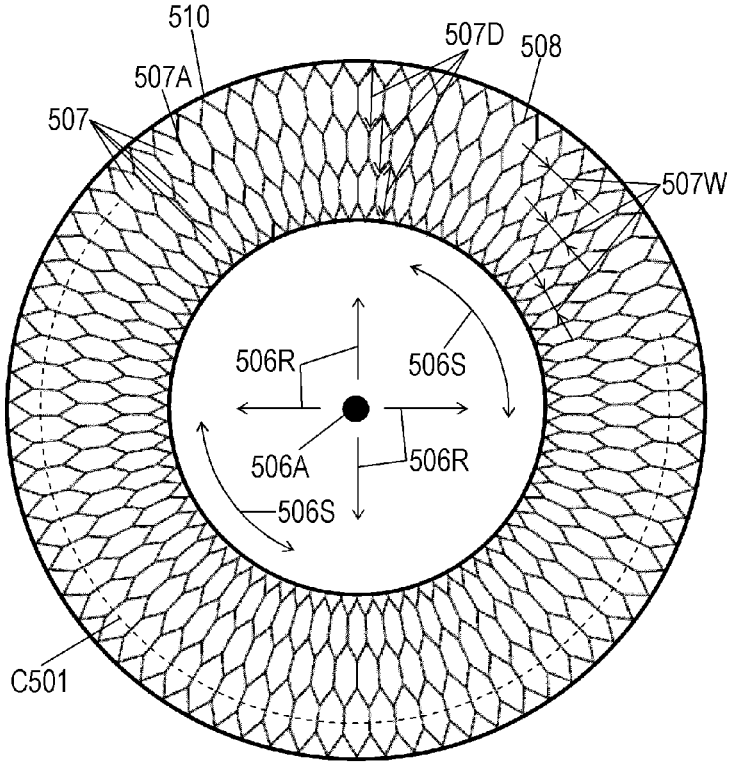
FIG. 29 is a top view of a core substrate used in the flat diaphragm according to Embodiment 3.

FIG. 28 is a cross-sectional view of flat diaphragm 506 in accordance with Exemplary Embodiment 3. FIG. 29 is a top view of core substrate 508 of flat diaphragm 506.

As shown in FIG. 28 and FIG. 29, flat diaphragm 506 includes core substrate 508 and skin layers 510 formed on both surfaces of core substrate 508 via adhesive layers 509. Core substrate 508 has an annular shape and has a honeycomb structure including plural cells 507 each having a hexagonal shape.

Cells 507 are arranged symmetrically with respect to center axis 506A of the annular shape of core substrate 508. Cells 507 positioned at an outermost circumference of core substrate 508 open in the direction toward an outside of the annular shape of core substrate 508.

This configuration increases fixing strength between an outer circumference of core substrate 508 and skin layers 510, and, as a result, stabilizes a fixed state between core substrate 508 and skin layers 510 over a whole surface of flat diaphragm 506. Accordingly, vibration characteristics of flat diaphragm 506 become stable over the whole surface of flat diaphragm 506, hence suppressing distortion generated when the loudspeaker reproduced sound.

In accordance with this embodiment, each of cells 507 shown in FIG. 29 has a hexagonal shape. However, each of cells 507 may have a rhombic shape.

Configurations of flat diaphragm 506 and the loudspeaker which uses flat diaphragm 506 will detailed below.

Figure 30:
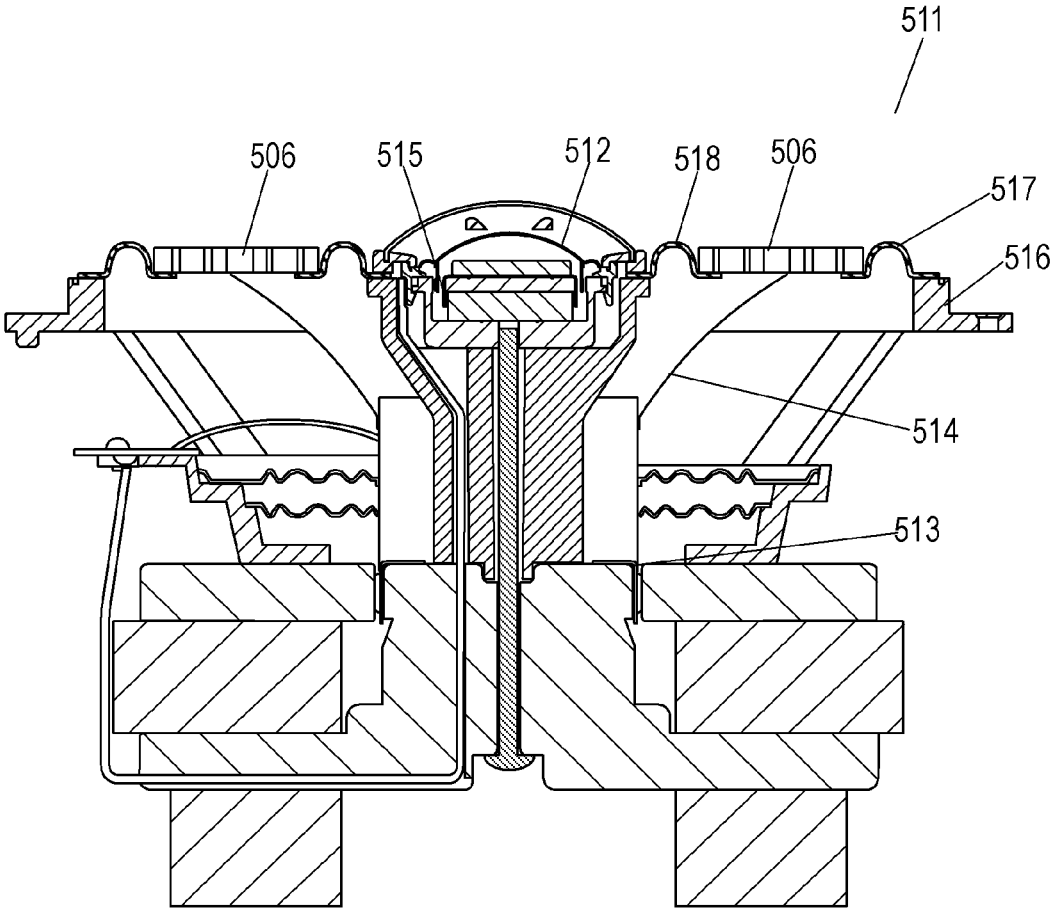
FIG. 30 is a cross-sectional view of the loudspeaker including a flat diaphragm according to Embodiment 3.

FIG. 30 is a cross-sectional view of loudspeaker 511 including flat diaphragm 506 according to Embodiment 3. Loudspeaker 511 is a coaxial loudspeaker. Loudspeaker 511 includes flat diaphragm 506 having an annular shape and diaphragm 512 disposed in a space formed in an inner circumferential side of the annular-shape of flat diaphragm 506. Flat diaphragm 506 is for reproducing sound in a low frequency band while diaphragm 512 is for reproducing sound in a high frequency band.

Driver cone 514 coupled to voice coil 513 is coupled to flat diaphragm 506. Flat diaphragm 506 is driven by voice coil 513 via driver cone 514. Diaphragm 512 is driven by voice coil 515.

Voice coils 513 and 515 are movably disposed in respective magnetic gaps formed in magnetic circuits.

As described above, flat diaphragm 506 includes core substrate 508 having a honeycomb structure, and skin layers 510 formed on both surfaces of core substrate 508 via adhesive layers 509.

Core substrate 508 is composed of cells 507. Each cell 507 has a rhombic shape or a hexagonal shape.

All cells 507 are disposed such that lines 507D each passing through diagonal vertexes of each cell 507 is positioned on a straight line extending in radial direction 506R away from center axis 506A. That is, cells 507 are arranged symmetrical with respect to center axis 506A of the annular shape of core substrate 508.

Respective flattenings of cells 507 gradually change according to a distance from center axis 506A. That is, cells 507 arranged on a straight line extending in radial direction 506R between an inner circumferential end of core substrate 508 and an outer circumferential end of core substrate 508 have flattennigs different from each other. Widths 507W of cells 507 in circumferential direction 506S perpendicular to radial direction 506R about center axis 506A gradually decrease as distances from center axis 506A to the widths decrease. Respective flattenings of cells 507 gradually increase toward the inner circumferential side of core substrate 508 from the outer circumferential side of core substrate 508.

Cells 507 arranged on one circumference C501 about center axis 506A have the same flattenings. That is, cells 507 arranged in circumferential direction 506S have the same width 507W.

The number of cells 507 arranged in circumferential direction 506S is constant regardless of the positions of cells 507 in radial direction 506R over core substrate 508 including the outer circumferential side and the inner circumferential side. Further, although individual cells 507 having different flattenings have different areas, the length of sides 507A of cells 507 surrounds individual cells 507 are equal for all cells 507.

As described above, cells 507 arranged on one straight line extending in radial direction 506R have flattenings different from each other between the inner circumferential side of core substrate 508 and the outer circumferential side of core substrate 508. Further, respective flattenings of cells 507 gradually increase toward the inner circumferential side of core substrate 508 from the outer circumferential side of core substrate 508.

This configuration allows the number of cells 507 per unit area of flat diaphragm 506 gradually increases toward the inner circumferential side of flat diaphragm 506 from the outer circumferential side of flat diaphragm 506. That is, the closer to center axis 506A cells 507 are, the greater the number of cells 507 per unit area of flat diaphragm 506 becomes. That is, the arrangement density of cells 507 gradually increases toward the inner circumferential side of flat diaphragm 506 from the outer circumferential side of flat diaphragm 506. That is, the closer to center axis 506A cells 507 are, the larger the arrangement density of cells 507 is.

Thus, the number of cells 507 per unit area of flat diaphragm 506 closer to the outer circumferential side of flat diaphragm 506 is smaller than the number of cells 507 per unit area of flat diaphragm 506 closer to the inner circumferential side of flat diaphragm 506. This arrangement may cause adhesive strength between core substrate 508 having the honeycomb structure and each of skin layers 510 disposed on both surfaces of core substrate 508 with adhesive layers 509 to become weak on the outer circumferential side of flat diaphragm 506.

Figure 31A:
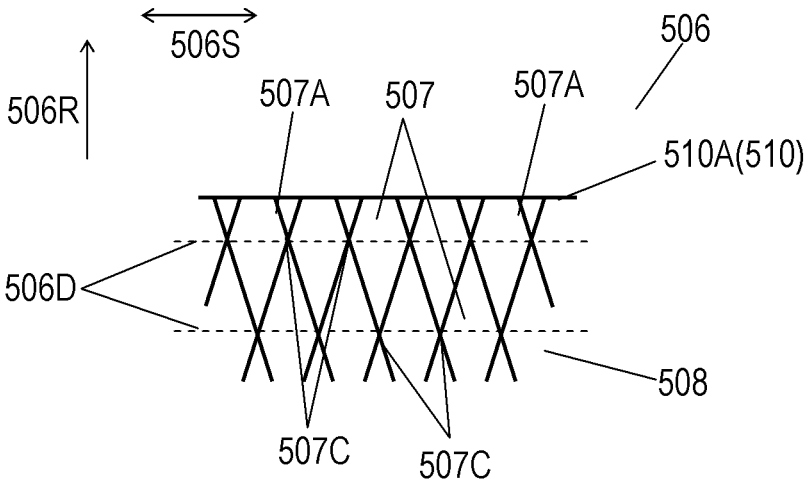
FIG. 31A is a partial enlarged view of an outer circumferential end of the flat diaphragm according to Embodiment 3.

FIG. 31A is a partial enlarged view of an outer circumferential end of flat diaphragm 506. In flat diaphragm 506 according to Embodiment 3, as shown in FIG. 31A, cells 507 positioned at an outermost circumference of flat diaphragm 506 open toward the outside.

Figure 31B:
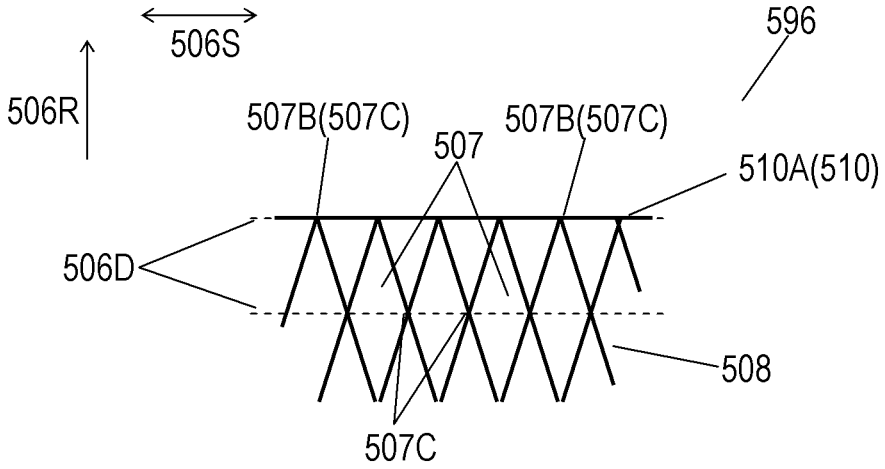
FIG. 31B is a partial enlarged view of an outer circumferential end of a comparative example of a flat diaphragm.

FIG. 31B is a partial enlarged view of a comparative example of flat diaphragm 596. In FIG. 31B, components identical to those of flat diaphragm 506 shown in FIG. 31A are denoted by the same reference numerals. In the comparative example of flat diaphragm 596, cells 507 positioned at an outermost circumference of flat diaphragm 596 do not open to the outside. As shown in FIG. 31B, in flat diaphragm 596, distal ends 507B of cells 507 are fixed to outer circumferential end 510A of skin layer 510. Alternatively, distal ends 507B of cells 507 are fixed to skin layer 510 at an area inside and close to outer circumferential end 510A of skin layer 510. In this case, outer circumferential end 510A of skin layer 510 is fixed to core substrate 508 at positions the number of which equal to the number of cells 507 positioned at the outermost circumference of core substrate 508.

Figure 42:
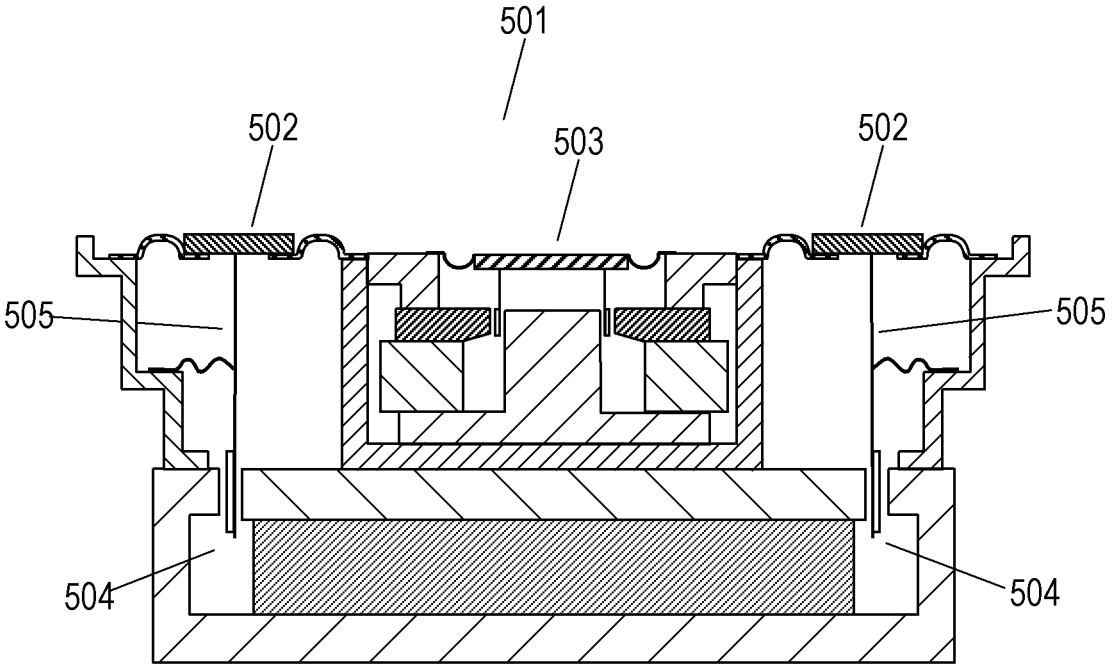
FIG. 42 PRIOR ART
FIG. 42 is a cross-sectional view of a loudspeaker including a conventional flat diaphragm.
Figure 43:
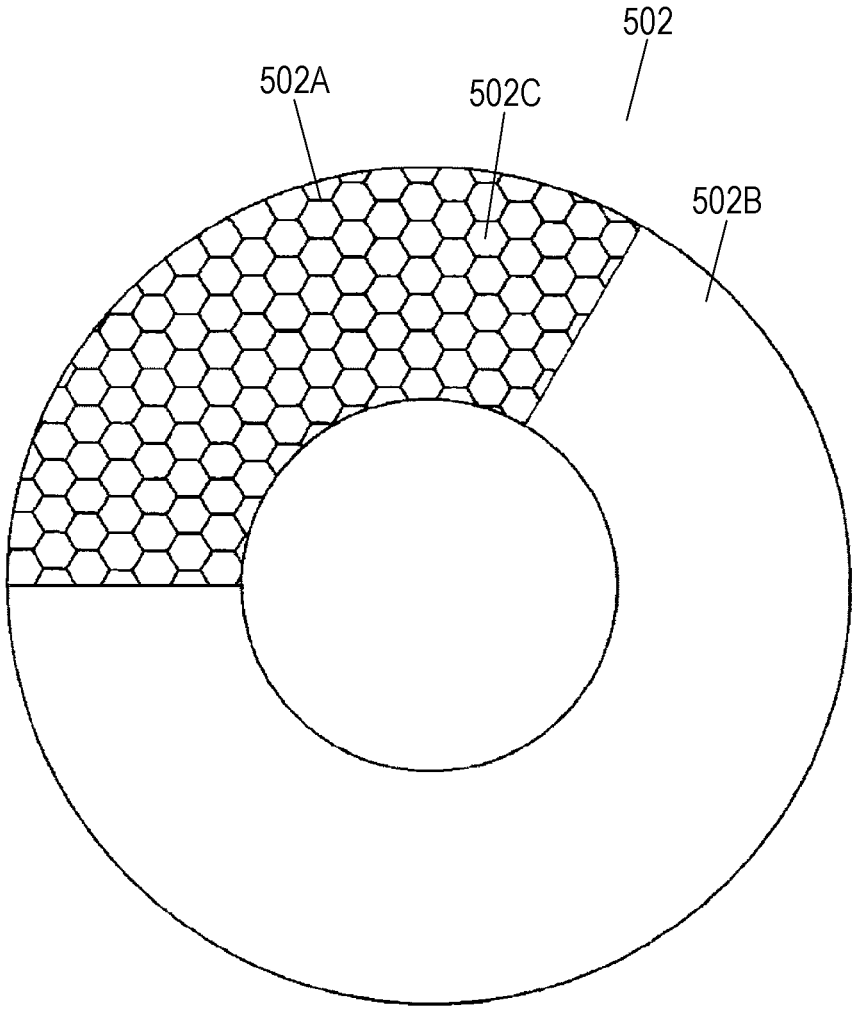
FIG. 43 PRIOR ART
FIG. 43 is a top view of a core substrate used in the flat diaphragm shown in FIG. 42.

In flat diaphragm 502 of the conventional loudspeaker shown in FIG. 42, individual cells 502C which form core substrate 502A have the same shape and the same size, and are arranged in a matrix. That is, individual cells 502C are not arranged circumferentially, but are arranged in rows and columns. Accordingly, cells 502 disposed particularly at an inner circumferential end of flat diaphragm 502 and an outer circumferential end of flat diaphragm 502 have shapes different from each other depending on portions on flat diaphragm 502 including closed cells 502C and opening cells 502C. Accordingly, at the inner circumferential end and the outer circumferential end of flat diaphragm 502, the amount of adhesive applied between core substrate 502A and skin layer 502B changes depending on positions on flat diaphragm 502 at the inner circumferential end and the outer circumferential end of flat diaphragm 502, accordingly changing fixing strength for fixing core substrate 502A to skin layer 502B drastically at the outer circumferential side and the inner circumferential side of core substrate 502A, or depending on positions on flat diaphragm 502.

As a result, vibration characteristics of flat diaphragm 502 determined based on a fixed state between core substrate 502A and skin layer 502B are different between the inner circumferential side and the outer circumferential side of flat diaphragm 502, and facilitating distortion generated in original sound reproduced by loudspeaker 501.

In contrary, in flat diaphragm 506 in accordance with Embodiment 3 shown in FIG. 31A, distal ends of sides 507A of opening cell 507 which do not constitute an end of cell 507 are connected to outer circumferential end 510A of skin layer 510, or are connected to skin layer 510 at an area inside and close to circumferential end 510A. In this case, outer circumferential end 510A of skin layer 510 is fixed to core substrate 508 at positions the number of which is twice as large as the number of cells 507. That is, outer circumferential end 510A of skin layer 510 is fixed to core substrate 508 at a large number of positions at narrow intervals, accordingly allowing core substrate 508 to be firmly fixed to skin layer 510.

Outer circumferential end 510A of skin layer 510 is positioned on an end surface of flat diaphragm 506, hence causing skin layer 510 to tend to be fixed to core substrate 508 unstably.

In flat diaphragm 506 according to Embodiment 3, in order to suppress the unstable fixed state between skin layer 510 and core substrate 508, each cell 507 positioned at the outermost circumference of core substrate 508 is incomplete cell 507 which opens to the outside. That is, each cell 507 positioned at the outermost circumference of core substrate 508 is not completely surrounded by sides 507A of cell 507. In this configuration, sides 507A of cell 507 project outwardly.

Further, ends of sides 507A are fixed to outer circumferential end 510A of skin layer 510 with adhesive layer 509, or are fixed to skin layer 510 with adhesive layer 509 while ends of sides 507A are adjacent to an inner side of outer circumferential end 510A of skin layer 510.

In flat diaphragm 506 according to Embodiment 3, opening cells 507 provided at outer circumferential end 510A of skin layer 510 where a fixed state between skin layer 510 and core substrate 508 tends to become unstable provide the above advantageous effects. Similarly, cells 507 which open to the inside may be disposed at inner circumferential end 510B of skin layer 510 (see FIG. 29). Inner circumferential end 510B of skin layer 510 is also positioned on an end surface of flat diaphragm 506. Accordingly, inner circumferential end 510B of skin layer 510 is fixed to core substrate 508 at a large number of positions at narrow intervals, and skin layer 510 are firmly fixed accordingly, suppressing the unstable fixed state between skin layer 510 and core substrate 508.

In flat diaphragm 506 according to Embodiment 3, all cells 507 positioned on an outermost circumference of core substrate 508 may open to the outside in radial direction 506R while all cells 507 positioned on an innermost circumference of core substrate 508 may open to the inside in a direction opposite to radial direction 506R. As shown in FIG. 31A and FIG. 31B, regarding cells 507 arranged in radial directions 506R, ends 507C of cells 507 in radial directions 506R are positioned on lines 507D extending in circumferential direction 506S. In flat diaphragm 506 according to Embodiment 3 shown in FIG. 31A, none of lines 506D is positioned at outer circumferential end 508C of core substrate 508 (see FIG. 28), or none of lines 506D is positioned at inner circumferential end 508D of core substrate 508 (see FIG. 28). In flat diaphragm 506 according to Embodiment 3 shown in FIG. 31A, none of lines 506D may be positioned at outer circumferential end 508C and inner circumferential end 508D of core substrate 508. In flat diaphragm 596 of the comparative example shown in FIG. 31B, one of lines 506D is positioned at outer circumferential end 508C or inner circumferential end 508D of core substrate 508.

Incomplete cells 507 each having an open end may be formed at both outer circumferential end 510A of skin layer 510 and inner circumferential end 510B of skin layer 510. Alternatively, incomplete cells 507 each having an open end may be provided at either outer circumferential end 510A or inner circumferential end 510B of skin layer 510.

As shown in FIG. 30, flat diaphragm 506 is supported to outer frame 516 of loudspeaker 511 with outer edge 517 provided at the outer circumference of flat diaphragm 506 while flat diaphragm 506 is supported by inner edge 518 to an outer circumference of diaphragm 512 by inner edge 518 provided at the inner circumference of flat diaphragm 506. That is, flat diaphragm 506 having an annular shape is supported at both the inner and outer circumferences. This configuration stabilizes rigidity of flat diaphragm 506 at the inner circumference thereof and rigidity of flat diaphragm 506 at the outer circumference thereof, hence suppressing variations of vibration characteristics of flat diaphragm 506.

In flat diaphragm 506 according to Embodiment 3, vibration characteristics become stable over the entire surface of flat diaphragm 506, hence providing an advantageous effect that loudspeaker 511 including flat diaphragm 506 can reproduce sound close to original sound. Accordingly, loudspeaker 511 is effectively applicable to various kinds of electronic apparatuses.

Exemplary Embodiment 4

Figure 32A:
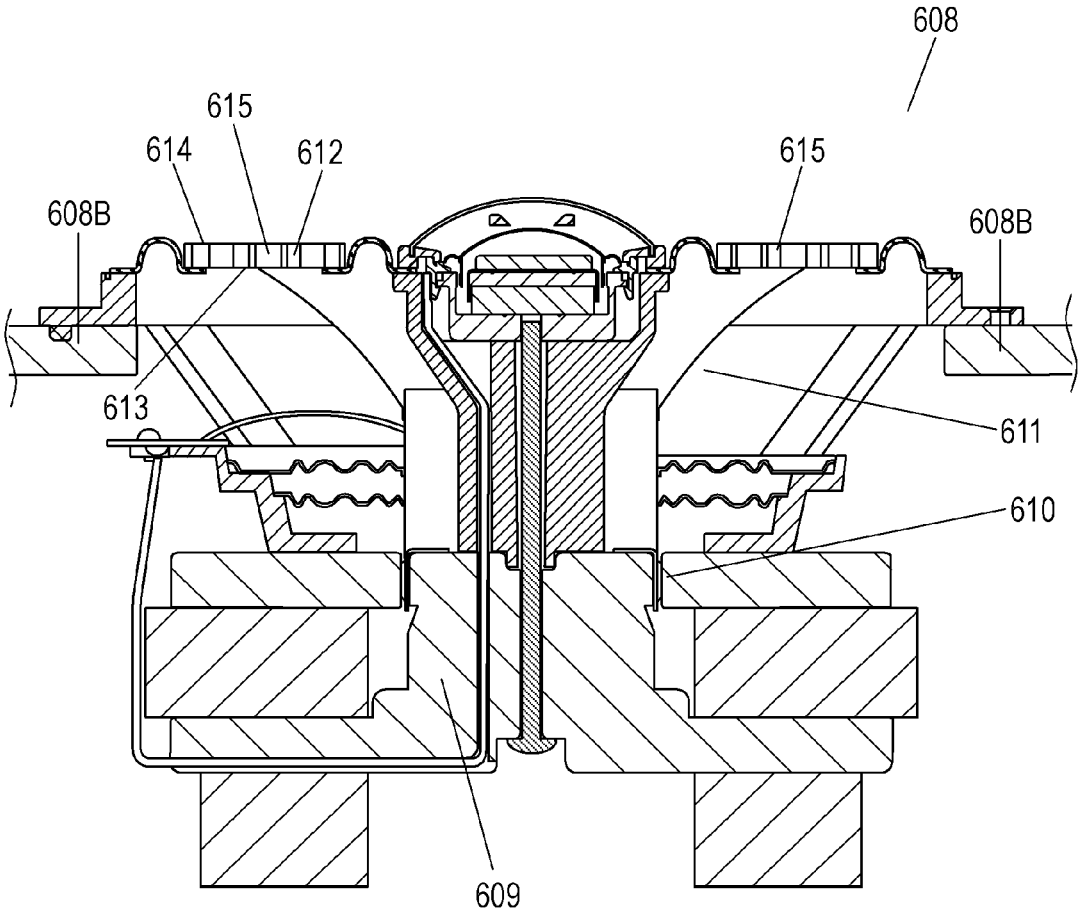
FIG. 32A is a cross-sectional view of a loudspeaker according to Exemplary Embodiment 4.
Figure 33:
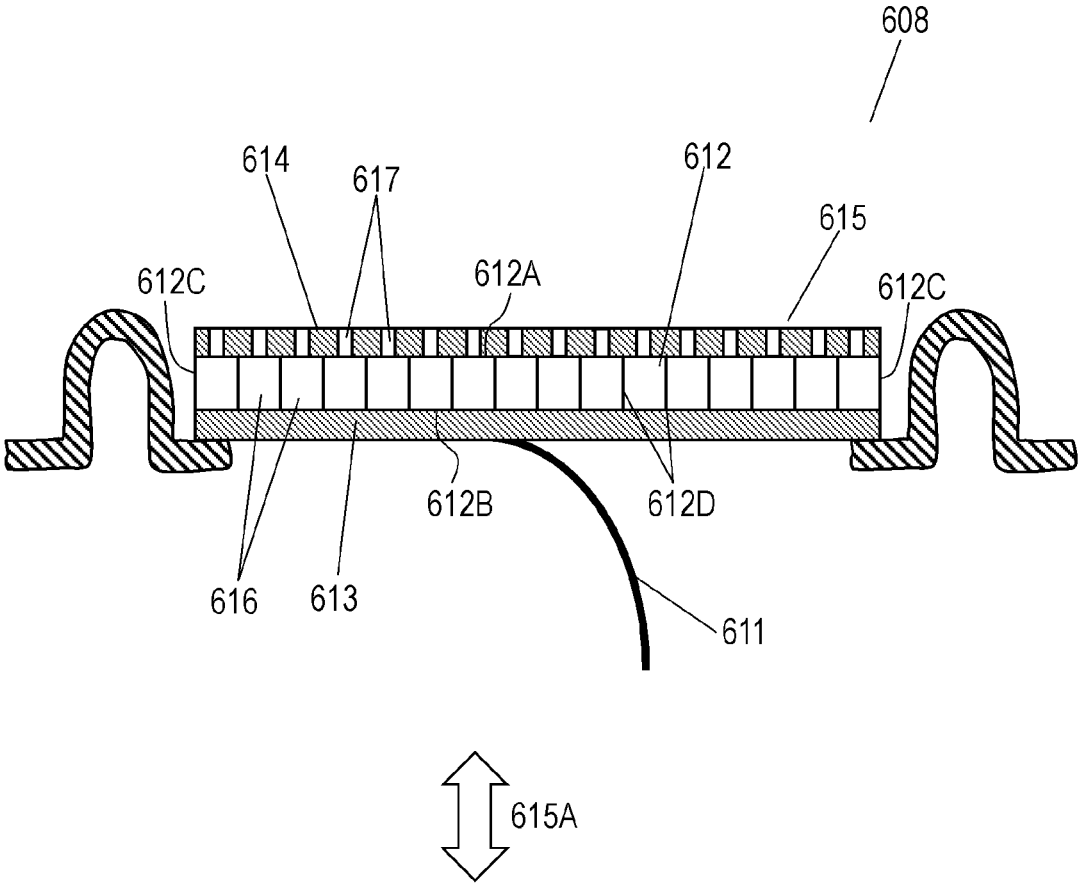
FIG. 33 is an enlarged cross-sectional view of the loudspeaker according to Embodiment 4.

FIG. 32A is a cross-sectional view of loudspeaker 608 according to Exemplary Embodiment 4. FIG. 33 is an enlarged cross-sectional view of a main part of the loudspeaker.

As shown in FIG. 32A, loudspeaker 608 includes magnetic circuit 609, voice coil 610, coupling cone 611 connected to voice coil 610, and flat diaphragm 615 connected to coupling cone 611.

As shown in FIG. 33, flat diaphragm 615 includes core substrate 612, skin layer 613, and skin layer 614. Core substrate 612 has a honeycomb structure composed of cells 616 which are continuously arranged and separated by partition walls 612D.

Skin layer 613 is formed on lower surface 612B of core substrate 612 toward coupling cone 611.

Skin layer 614 is formed on upper surface 612A of core substrate 612. Skin layer 613 and skin layer 614 are opposite to each other with respect to core substrate 612.

Skin layer 614 preferably has air permeability. Further, skin layer 614 has larger tensile strength than skin layer 613.

This configuration air from the inside and the outside of cells 616 in flat diaphragm 615 flows into and out from flat diaphragm 615 mainly through skin layer 614 having air permeability even when flat diaphragm 615 vibrates at large amplitude. Thus, air is prevented from flowing into and out from the inside and the outside of cell 616 through a side surface of flat diaphragm 615. This suppresses noise due to the air flowing into and out from flat diaphragm 615 through the side surface of flat diaphragm 615, and accordingly, suppresses the noise mixed in original sound reproduced by loudspeaker 608.

A configuration of flat diaphragm 615 will be detailed below.

Flat diaphragm 615 includes core substrate 612, skin layer 613, and skin layer 614. Core substrate 612 has a flat plate shape having upper surface 612A, lower surface 612B, and side surface 612C connected to upper surface 612A and lower surface 612B. Skin layer 613 is stuck onto lower surface 612B of core substrate 612 such that skin layer 613 is connected to coupling cone 611 of flat diaphragm 615.

Figure 32B:
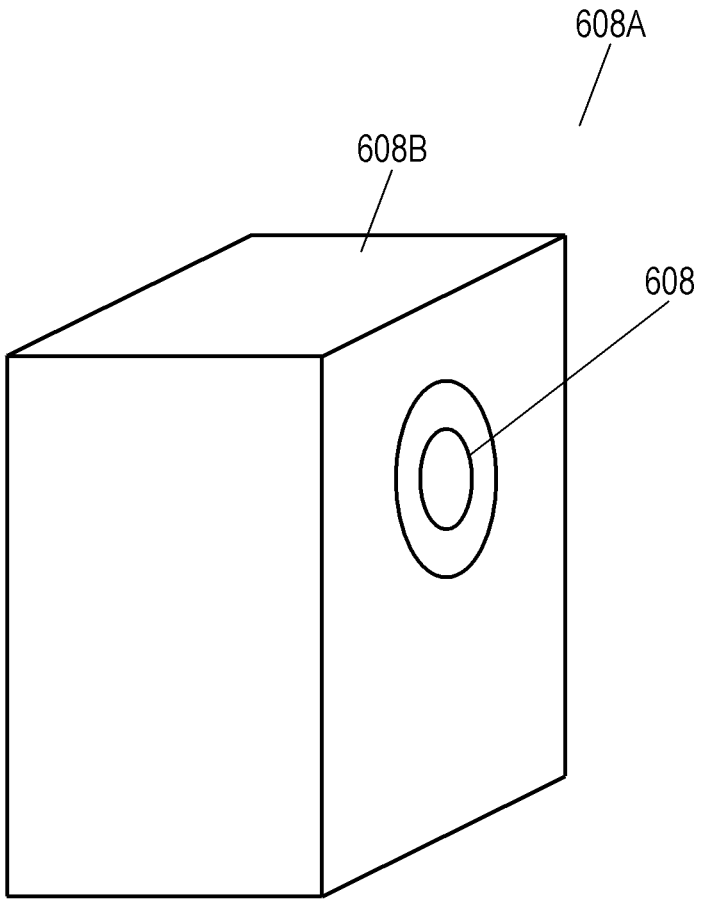
FIG. 32B is a schematic perspective view of a loudspeaker system including the loudspeaker according to Embodiment 4.

FIG. 32B is a schematic perspective view of loudspeaker system 608A including loudspeaker 608. Loudspeaker system 608A includes loudspeaker 608 and enclosure 608B accommodating loudspeaker 608 therein. Skin layer 613 is disposed inside enclosure 608B accommodating loudspeaker 608 therein.

Skin layer 614 is stuck to upper surface 612A of core substrate 612 opposite to skin layer 613 of flat diaphragm 615. Skin layer 614 is disposed outside enclosure 608B, that is, skin layer 614 is disposed at a side to a listener.

Core substrate 612 has a honeycomb structure. Skin layer 613 and skin layer 614 are disposed on lower surface 612B and upper surface 612A, i.e., both surfaces of core substrate 612, respectively, thereby increasing mechanical strength of flat diaphragm 615.

Since skin layer 613 and skin layer 614 are stuck to respective surfaces of core substrate 612, cells 616 which are spaces independent from each other and non-communicable with each other are disposed in core substrate 612, thus forming the honeycomb structure. Skin layer 614 has air permeability. Cells 616 are communicated with the outside of flat diaphragm 615 through ventilation apertures 617 provided in skin layer 614. Cells 616 are communicated with the outside of the flat diaphragm 615 not through skin layer 613. That is, cells 616 are not completely closed, and open to skin layer 614. That is, cells 616 open to outside enclosure 608B Skin layer 613 is preferably made of, e.g. an aluminum foil or an aluminum plate. Skin layer 614 is preferably made of, e.g. aramid fiber woven fabric, a titanium foil, or a titanium plate. Skin layer 614 has higher tensile strength than skin layer 613.

In the case that skin layer 614 is made of an aramid fiber woven fabric, positions of ventilation apertures 617 are not particularly restricted since the woven fabric has a lot of ventilation apertures 617.

In the case that skin layer 614 is made of a titanium foil or a titanium plate, single ventilation aperture 617 or plural ventilation apertures 617 communicated with individual cells 616 may be formed in skin layer 614. Alternatively, in the case that skin layer 614 is made of a titanium foil or a titanium plate, a lot of ventilation apertures 617 may be formed in skin layer 614.

When amplitude 615A of vibrations of flat diaphragm 615 is large, skin layer 613 may warp to change volumes of cells 616. Alternatively, the increase of a temperature of flat diaphragm 615 may increase a pressure in cells 616. In flat diaphragm 615 according to Embodiment 4, a gap may be formed between core substrate 612 and skin layer 613 or between core substrate 612 and skin layer 614 due to an insufficient fixed state so that volumes of cells 616 may change or a pressure in cells 616 increase. Even in this case, little air in cells 616 flows into and out from flat diaphragm 615 through side surface 612C of core substrate 612.

That is, even when the volume of each cell 616 or a pressure in each cell 616 change, air in cells 616 flows into and out from flat diaphragm 615 through a lot of ventilation apertures 617 formed in skin layer 614. This can suppress noise due to air flowing into and out from flat diaphragm 615 through the side surface of flat diaphragm 615. As a result, the noise is prevented from being mixed in original sound reproduced by loudspeaker 608.

Skin layer 614 positioned outside enclosure 608B is made of a material having a large tensile strength.

That is, in loudspeaker 608, the generation of noise is suppressed by air permeability of flat diaphragm 615. Further, since skin layer 614 is made of a material having a large tensile strength, characteristics of loudspeaker 608 in a high frequency band can be easily enhanced, and it is possible to obtain flat frequency characteristics having no irregularities in undesired characteristics.

Figure 44:
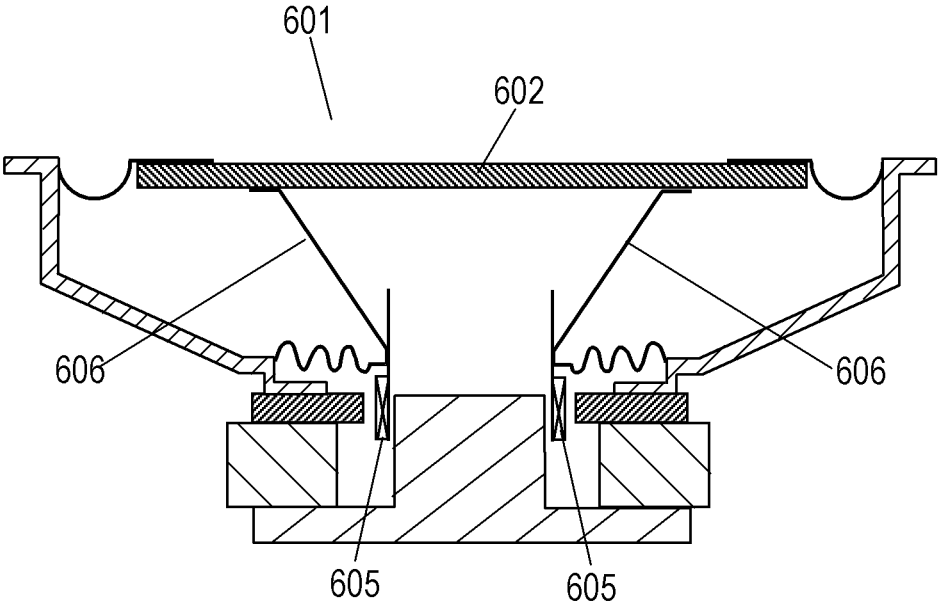
FIG. 44 PRIOR ART
FIG. 44 is a cross-sectional view of another conventional loudspeaker.
Figure 45:
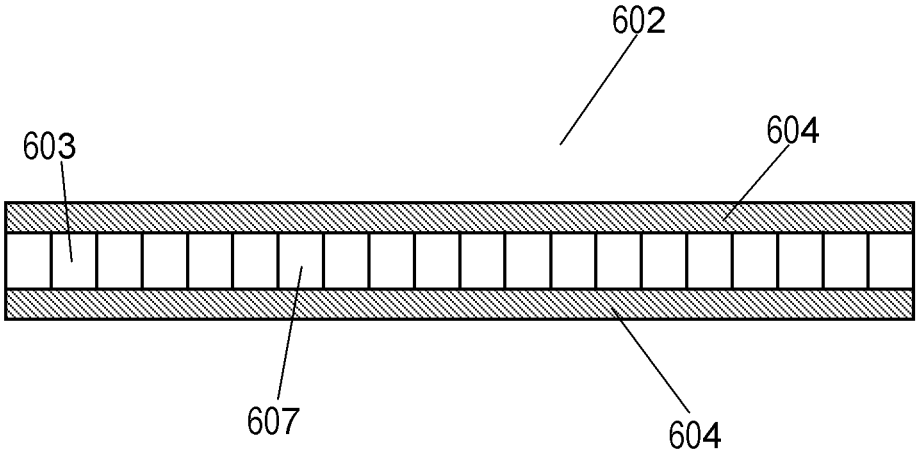
FIG. 45 PRIOR ART
FIG. 45 is a cross-sectional view of a diaphragm of the loudspeaker shown in FIG. 44.

In conventional loudspeaker 601 shown in FIG. 44, when a gap is formed between core substrate 603 and skin layer 604, air may flow into and out from cells 607 through a side surface of core substrate 603 in the lateral direction, as shown in FIG. 45. In particular, air may flow into and out through a limited gap and concentrating to the gap, and generate abnormal sound, which may generate noise in original sound reproduced by loudspeaker 601.

Figure 34:
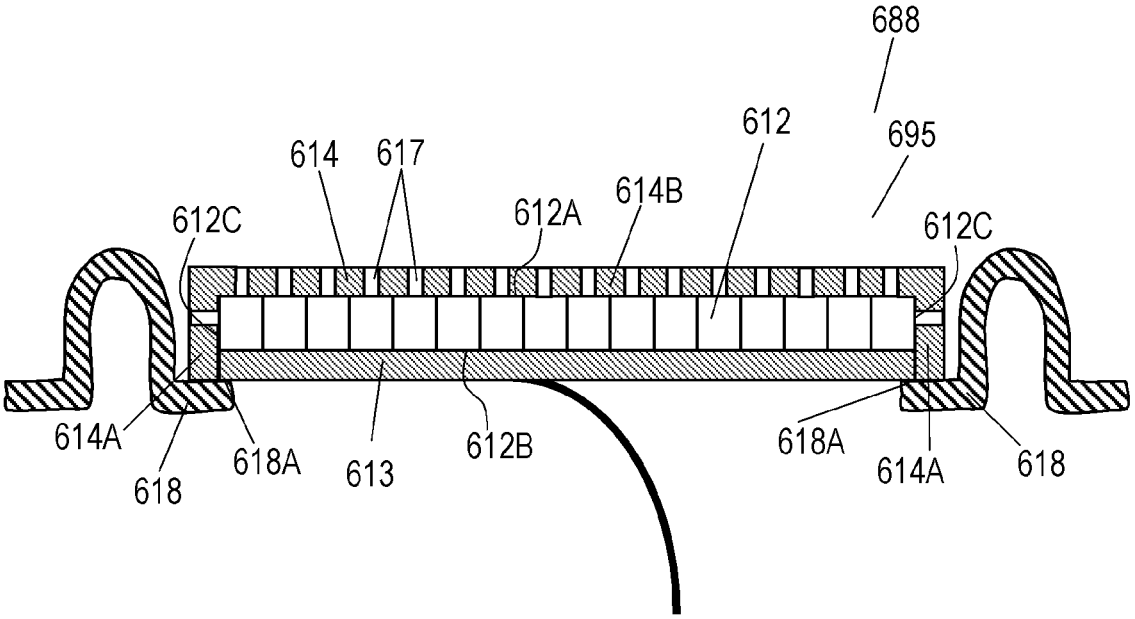
FIG. 34 is a cross-sectional view of another loudspeaker according to Embodiment 4.

FIG. 34 is a cross-sectional view of another loudspeaker 688 according to Embodiment 4. In FIG. 34, components identical to those of loudspeaker 608 shown in FIG. 33 are denoted by the same reference numerals. Loudspeaker 688 includes flat diaphragm 695 instead of flat diaphragm 615 of loudspeaker 608 shown in FIG. 33. In flat diaphragm 615 shown in FIG. 33, only skin layer 614 is formed on upper surface 612A of core substrate 612 (an outer side of enclosure 608B). In flat diaphragm 695 shown in FIG. 34, skin layer 614 covers upper surface 612A and side surface 612C of core substrate 612. Skin layer 614 includes upper surface portion 614B which covers upper surface 612A of the core substrate and side surface portion 614A which covers side surface 612C of core substrate 612.

As described above, a lot of ventilation apertures 617 are formed in skin layer 614, and may decrease the fixing strength between skin layer 614 and core substrate 612 with adhesive accordingly.

In view of the above, in flat diaphragm 695 shown in FIG. 34, skin layer 614 covers not only upper surface 612A but also side surface 612C of core substrate 612. Side surface portion 614A of skin layer 614 is thus fixed to side surface 612C of core substrate 612. Ventilation apertures 617 communicating with cells 616 are formed also in side surface portion 614A of skin layer 614.

That is, the fixing strength between upper surface 612A of core substrate 612 and skin layer 614 is enhanced by fixing strength of side surface 612C of core substrate 612. Accordingly, the fixing strength between skin layer 614 having ventilation apertures 617 therein and core substrate 612 is enhanced, hence stabilizing vibration characteristics of flat diaphragm 615.

A region where side surface portion 614A of skin layer 614 is fixed to side surface 612C of core substrate 612 extends in a thickness direction of core substrate 612. In a cross-sectional view shown in FIG. 34, the size of the region does not apparently increase. However, cells 616 each having a tubular shape extending in the thickness direction of core substrate 612 form core substrate 612 having a disk shape as assembled. The region where side surface portion 614A of skin layer 614 is fixed to side surface 612C of core substrate 612 has a tubular shape which substantially surrounds core substrate 612. Accordingly, the region where side surface portion 614A of skin layer 614 is fixed to side surface 612C of core substrate 612 increases, and has a shape having a large mechanical strength.

As described above, the fixing strength between skin layer 614 having ventilation apertures 617 and core substrate 612 is enhanced to stabilize vibration characteristics of flat diaphragm 615. Accordingly, loudspeaker 688 suppresses noise mixed in the reproduced original sound, and reproduces the original sound with high fidelity.

Edge 618 holds flat diaphragm 615 by contacting skin layer 613. In flat diaphragm 695 shown in FIG. 34, skin layer 614 covers side surface 612C of core substrate 612 and the side surface of skin layer 613, and reaches edge 618. However, skin layer 614 may cover side surface 612C of core substrate 612 partially. Skin layer 614 may not necessarily reach edge 618 while completely covering side surface 612C of core substrate 612.

Edge 618 holds flat diaphragm 615 by contacting skin layer 613 via fixing layer 618A. Skin layer 613 is made of an aluminum foil or an aluminum plate having substantially a flat surface over the entire thereof. This configuration can stabilize the fixing between edge 618 and skin layer 613.

Loudspeakers 608 and 688 according to Embodiment 4 can reduce air flowing into and from flat diaphragm 615 and 695 through the side surface of flat diaphragm 615 and 695. This configuration provides an advantageous effect that noise mixed to original sound reproduced by loudspeakers 608 and 688 can be suppressed. Accordingly, loudspeakers 608 and 688 are effectively applicable to various kinds of electronic apparatuses.

Exemplary Embodiment 5

Figure 35:
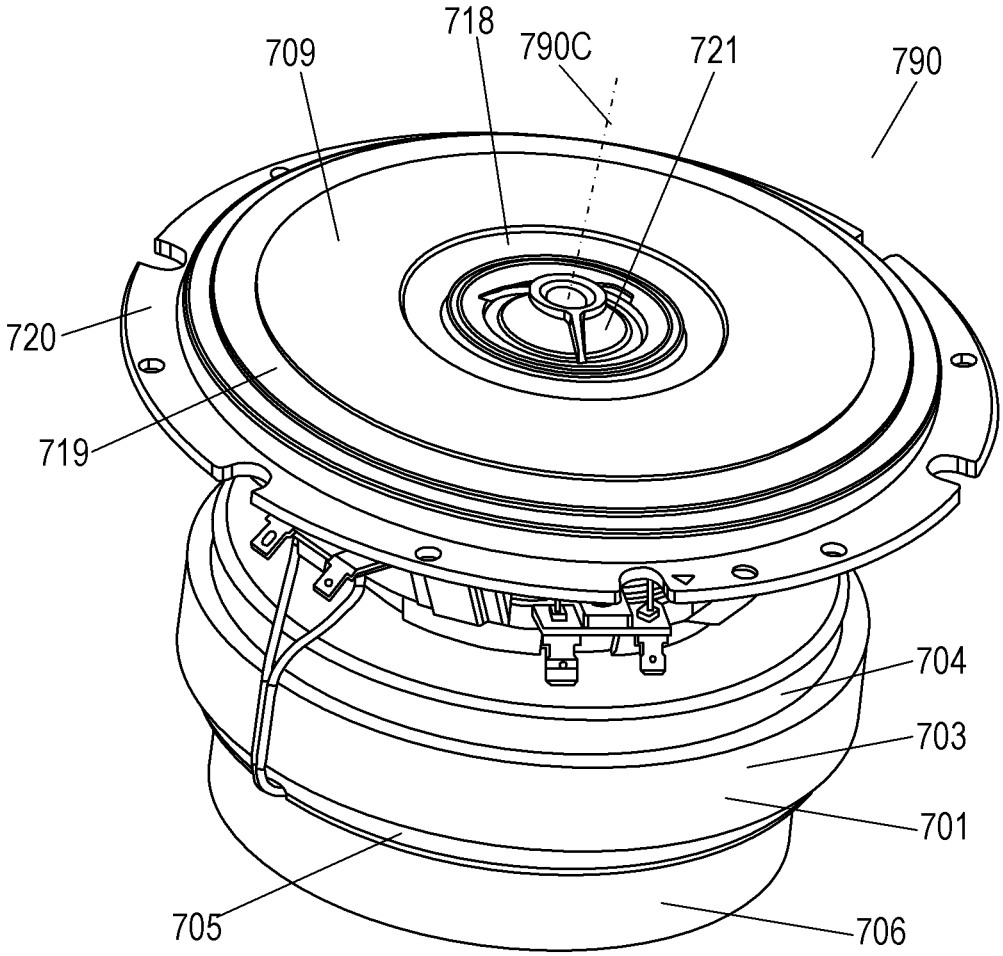
FIG. 35 is a perspective view of a loudspeaker according to Exemplary Embodiment 5.
Figure 36:
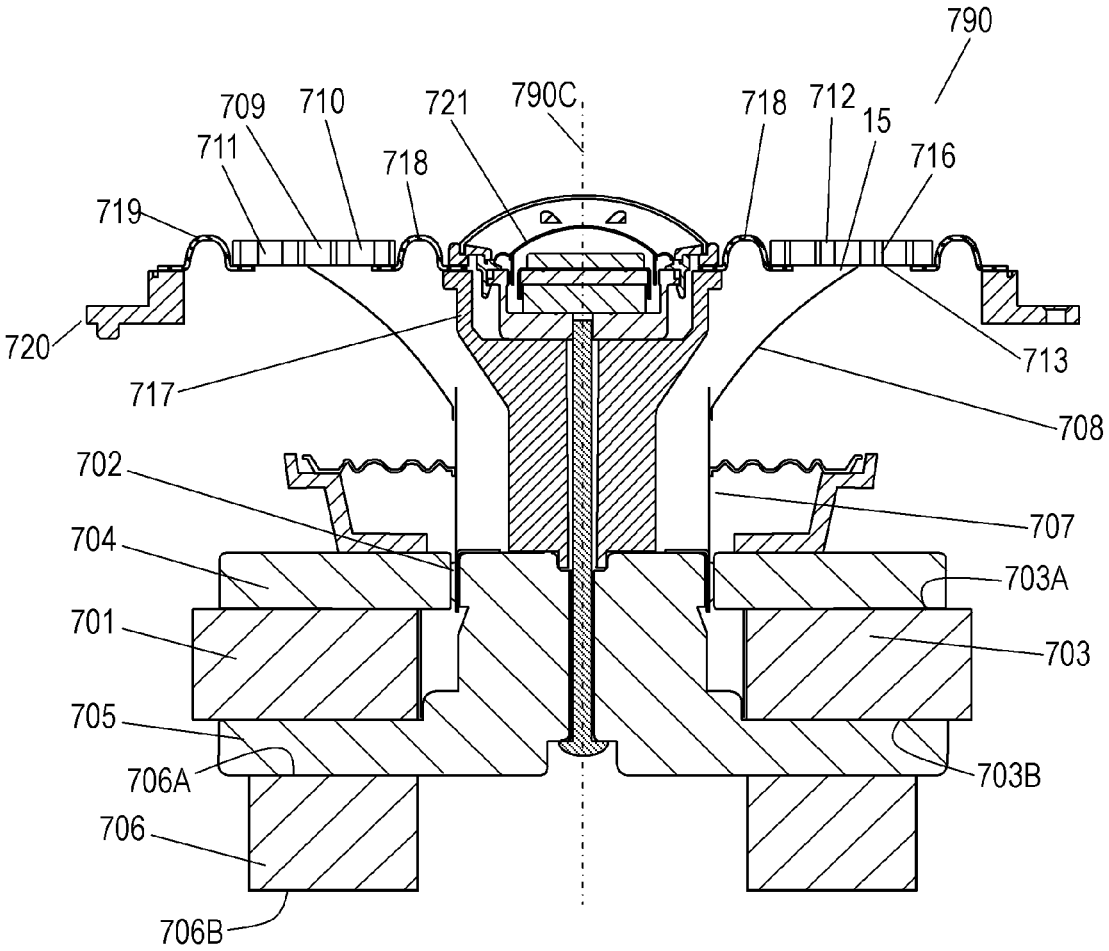
FIG. 36 is a cross-sectional view of the loudspeaker according to Embodiment 5.

FIG. 35 and FIG. 36 are a perspective view and a cross-sectional view of loudspeaker 790 according to Exemplary Embodiment 5, respectively. Magnetic circuit 701 for low frequency sound to middle frequency band sound has magnetic gap 702. Magnetic circuit 701 includes magnet 703 having a ring shape and yoke 704 and yoke 705 for forming a magnetic path which are coupled to upper surface 703A and lower surface 703B of the magnet, respectively.

Magnetic gap 702 is formed between yoke 704 and yoke 705.

Magnet 706 having a ring shape is disposed on yoke 705 opposite to magnet 703.

According to Embodiment 5, lower surface 703B of magnet 703 toward yoke 705 functions as an N-pole while upper surface 703A of magnet 703 toward yoke 704 functions as an S-pole. Upper surface 706A of magnet 706 toward yoke 705 functions as an N-pole while lower surface 706B of magnet 706 opposite to yoke 705 functions as an S-pole. This configuration allows a magnetic flux generated from the N-pole of magnet 703 to pass through yoke 705 and magnetic gap 702 in this order, and returns to the S-pole of magnet 703.

Further, a portion of a magnetic flux generated from the N-pole of magnet 706 also passes through yoke 705 and magnetic gap 702 in this order, and returns to the S-pole of magnet 703. While an extremely small portion of a magnetic flux generated from the N-pole of magnet 706 directly returns to the S-pole of magnet 706, most of the magnetic flux generated from the N-pole of magnet 706 is directed to magnetic gap 702 via yoke 705. As a result, the magnetic fluxes generated from magnet 703 and magnet 706 pass through magnetic gap 702, providing a large electromagnetic force in magnetic gap 702 accordingly. A coil portion of voice coil 707 having a cylindrical shape is movably disposed in magnetic gap 702.

One end of coupling cone 708 is fixed to an upper portion of voice coil 707 with adhesive. Flat diaphragm 709 is fixed to the other end of coupling cone 708.

As shown in FIG. 36, coupling cone 708 has a conical frustum sleeve shape such that a diameter of a portion of coupling cone 708 on a voice coil 707 has a small diameter. A portion of coupling cone 708 on flat diaphragm 709 has a larger diameter than the portion of coupling cone 708 on voice coil 707.

Figure 37:
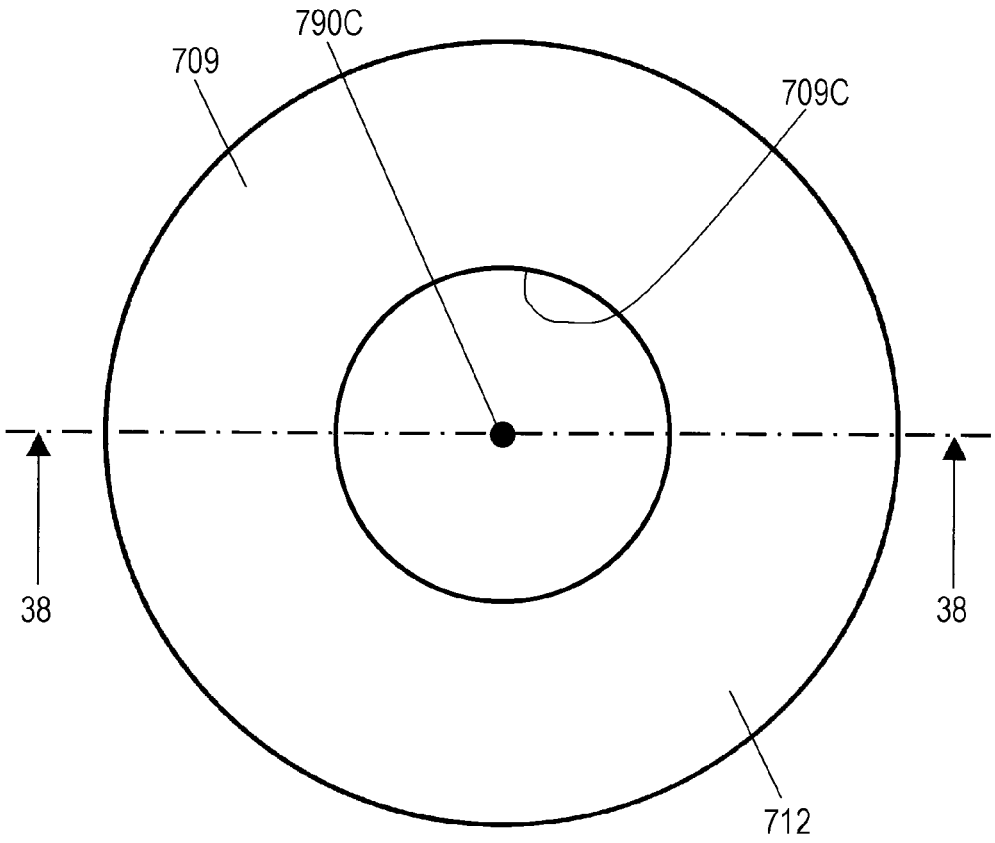
FIG. 37 is a plan view of a flat diaphragm of the loudspeaker according to Embodiment 5.
Figure 38:
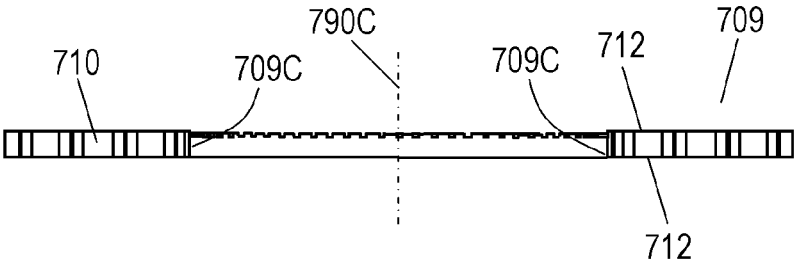
FIG. 38 is a cross-sectional view of the flat diaphragm on line 38-38 shown in FIG. 37.

FIG. 37 is a plan view of flat diaphragm 709. FIG. 38 is a cross-sectional view of flat diaphragm 709 on line 38-38 shown in FIG. 37. Flat diaphragm 709 includes tube core body 711 and plate bodies 712 disposed on upper surface 711A and lower surface 711B of tube core body 711.

Figure 39:
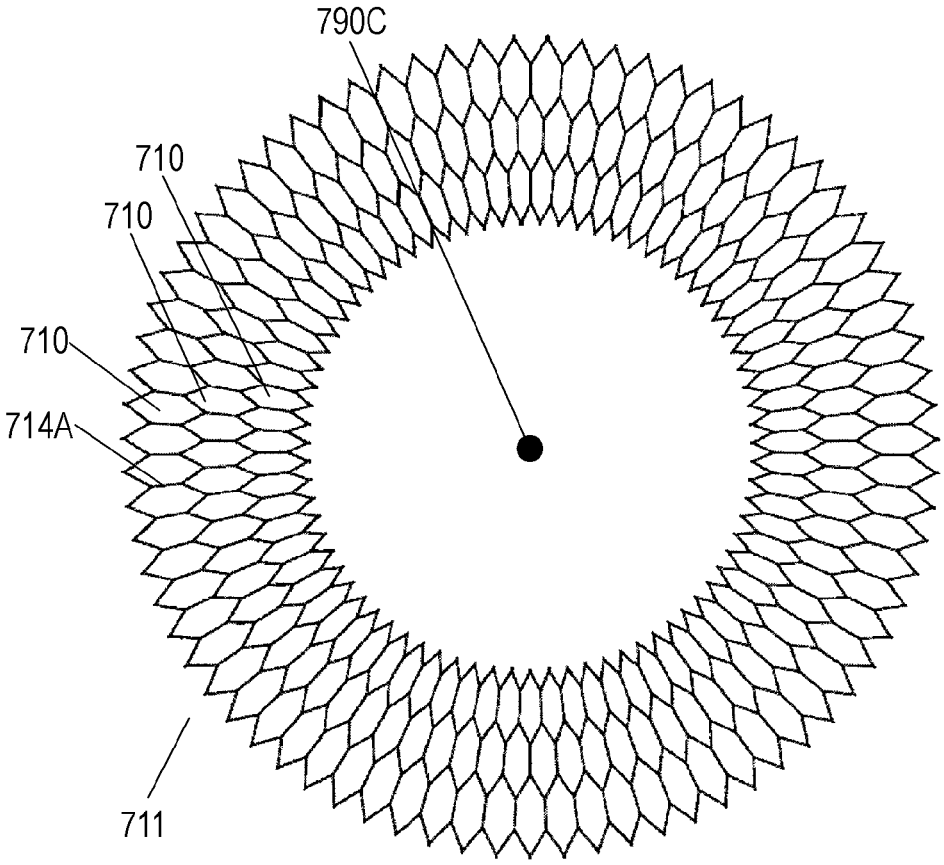
FIG. 39 is a plan view of a tube body forming the flat diaphragm according to the fifth exemplary embodiment.
Figure 40:
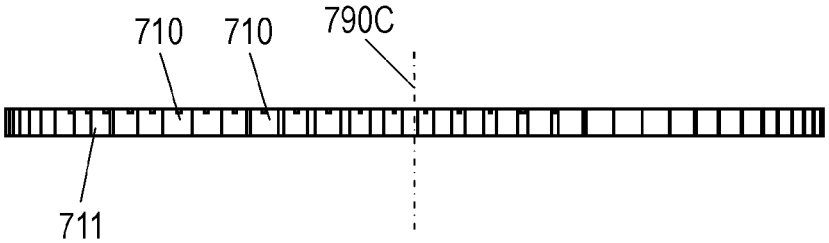
FIG. 40 is a side view of the tube body according to Embodiment 5.

FIG. 39 is a plan view of tube core body 711 forming flat diaphragm 709. FIG. 40 is a side view of tube core body 711. Tube core body 711 is composed of tubular bodies 710 which are arranged continuously and connected to each other in a surface direction, and has a ring shape about center axis 790C which surrounds center axis 790C.

According to Embodiment 5, tube core body 711 is made of an aluminum thin plate, and has a honeycomb structure composed of tubular bodies 710 which are continuously connected to each other.

The diameter of tubular body 710 out of tubular bodies 710 which is disposed on an outer circumference of the ring shape of tube core body 711 is larger than the diameter of tubular body 710 which is disposed on an inner circumference of tube core body 711 and closer to center axis 790C than tubular body 710 disposed on the outer circumference of tube core body 711.

As shown in FIG. 39, diameters of tubular bodies 710 gradually increase toward the outer circumference of the ring shape from the inner circumference of the ring shape. That is, the diameters of tubular bodies 710 gradually increase as the increase of a distance from center axis 790C.

According to Embodiment 5, as shown in FIG. 36, coupling cone 708 is fixed to tube core body 711 at a position outside an inner circumferential end of the ring shaped tube core body 711.

Figure 41:
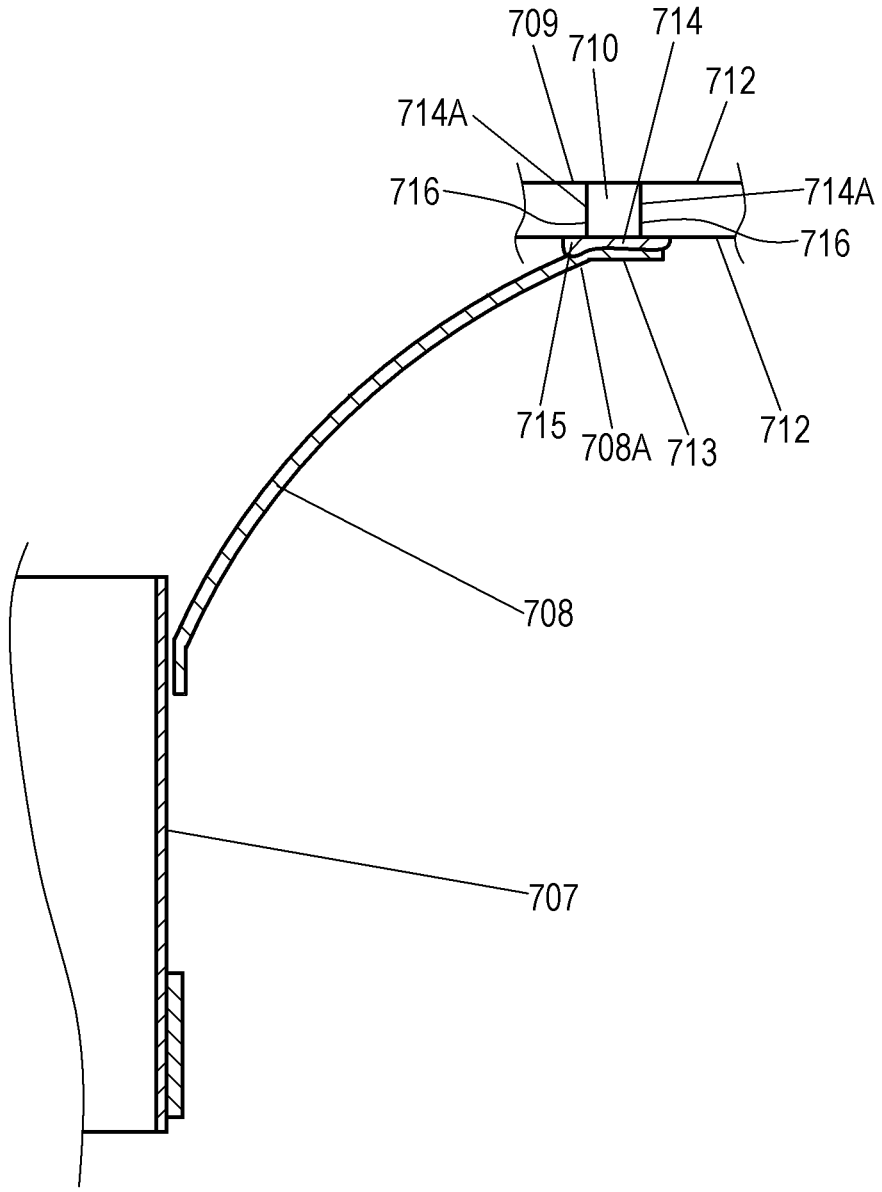
FIG. 41 is an enlarged cross-sectional view of the loudspeaker according to Embodiment 5.

FIG. 41 is an enlarged cross-sectional view of loudspeaker 790. Flange portion 713 which is bent toward the outside is provided at an end of coupling cone 708 toward flat diaphragm 709. Adhesive 714 for fixing flange portion 713 to plate body 712 disposed on a lower surface of flat diaphragm 709 is applied to flange portion 713. This configuration allows coupling cone 708 to be fixed to tube core body 711 at a position outside the inner circumferential end of tube core body 711.

As shown in FIG. 41, a portion of adhesive 714 flows into gap 715 having an acute angle which is formed between an end portion of coupling cone 708 toward flat diaphragm 709 and plate body 712 disposed on the lower surface of flat diaphragm 709. Adhesive 714 fixes inner circumferential fixing portion 708A of coupling cone 708 facing gap 715.

Respective tubular wall surfaces 716 of tubular bodies 710 of tube core body 711 forming flat diaphragm 709 are disposed on a portion of flat diaphragm 709 fixed to inner circumferential fixing portion 708A of coupling cone 708 with adhesive 714. Tubular wall surface 716 is a wall surface of partition wall 710A which separates tubular bodies 710 from one another.

In tube core body 711 in accordance with Embodiment 5, the diameters of tubular bodies 710 gradually increase toward the outer circumference of the ring shape of tube core body 711 from the inner circumferential end of tube core body 711. That is, diameters of tubular bodies 710 gradually increase as the increase of distances to the tubular bodies from center axis 790C. This configuration, with respect to the plurality of tubular bodies 710 forming tube core body 711, the diameter of tubular body 710 out of tubular bodies 710 which is disposed on the outer circumference of tube core body 711 is larger than the diameter of tubular body 710 disposed on the inner circumference of tube core body 711. That is, the diameter of tubular body 710 disposed on the outer circumference is large. As shown in FIG. 41, tubular wall surfaces 716 of tubular bodies 710 of tube core body 711 forming flat diaphragm 709 extend across the portion of flat diaphragm 709 fixed to inner circumferential fixing portion 708A of coupling cone 708.

This configuration in loudspeaker 790 according to Embodiment 5 can suppress distortion generated in reproduced sound. The reason will be detailed below.

In loudspeaker 790 according to Embodiment 5, flat diaphragm 709 includes tube core body 711 and plate bodies 712 disposed on upper and lower surfaces of tube core body 711. Tube core body 711 is composed of tube core bodies 711 continuously arranged in the surface direction. This configuration prevents flat diaphragm 709 per se from warping, accordingly suppressing distortion in sound reproduced by loudspeaker 790.

Next, coupling cone 708 includes inner circumferential fixing portion 708A positioned at an end thereof toward flat diaphragm 709. A portion of adhesive 714 which fixes flange portion 713 to plate body 712 disposed on the lower surface of flat diaphragm 709 flows into gap 715 having an acute angle and formed between plate body 712 disposed on the lower surface of flat diaphragm 709 and inner circumferential fixing portion 708A. Inner circumferential fixing portion 708A is fixed to plate body 712 disposed on the lower surface of flat diaphragm 709 with the portion of adhesive 714 flown into the gap. In a portion of flat diaphragm 709 fixed to inner circumferential fixing portion 708A of coupling cone 708, tubular wall surfaces 716 of tubular bodies 710 of tube core body 711 forming flat diaphragm 709 are disposed in a portion of flat diaphragm 709 fixed to inner circumferential fixing portion 708A of coupling cone 708. This configuration allows vibrations from coupling cone 708 to transmit to tubular wall surfaces 716 of tubular bodies 710 of tube core body 711, and hence, flat diaphragm 709 per se warps very little, accordingly suppressing distortion in sound reproduced by loudspeaker 790.

Further, vibrations from voice coil 707 smoothly transmit to coupling cone 708 having the conical frustum shape in which the portion of coupling cone 708 toward voice coil 707 has a smaller diameter while the portion of coupling cone 708 toward flat diaphragm 709 has a larger diameter. The vibrations smoothly transmitting to coupling cone 708 directly transmit to flat diaphragm 709 via flange portion 713 and inner circumferential fixing portion 708A fixed to flat diaphragm 709, hence generating little distortion in vibrations. Loudspeaker 790 according to Embodiment 5 exhibits the above-mentioned actions in comprehensive and combinations so that distortion in reproduced sound can be suppressed.

In the conventional loudspeaker disclosed in PTL 5, vibrations generated from the voice coil in the magnetic gap transmit to the flat diaphragm via the flange portion of the coupling cone while sound is output due to the vibrations of the flat diaphragm. The vibrations output from the voice coil transmit to the flat diaphragm via the flange portion of the coupling cone. Accordingly, large vibrations transmit to the flat diaphragm which corresponds to the flange portion. As a result, the flat diaphragm warps and generates large distortion in reproduced sound.

In loudspeaker 790 according to Embodiment 5, as shown in FIG. 36, cylindrical container 717 is disposed inside of the ring shape of flat diaphragm 709. Damper 718 supporting the inner circumference of flat diaphragm 709 to cylindrical container 717 is disposed between cylindrical container 717 and the inner circumference of flat diaphragm 709

An outer circumferential end of the ring shape of flat diaphragm 709 is mounted onto outer frame 720 via damper 719 such that flat diaphragm 709 can vibrate.

As shown in FIG. 35, outer frame 720 shown in FIG. 36 is fixed to yoke 704.

In loudspeaker 790 according to Embodiment 5, diaphragm 721 for high frequency band sound is disposed in cylindrical container 717. Tube core body 711 of flat diaphragm 709 is not used for forming diaphragm 721. Flat diaphragm 709 which reproduces low frequency band sound and middle frequency band sound reproduces sound in almost all frequency bands at the time of reproducing actual voice or music. On the other hand, diaphragm 721 for high frequency band sound reproduces only extremely high-frequency sound. In the case that tube core body 711 is used for forming diaphragm 721 for high frequency band sound, tube core body 711 can hardly reproduce high frequency band sound due to its large weight. Accordingly, as described above, tube core body 711 used for forming flat diaphragm 709 is not used for forming diaphragm 721.

In Embodiment 1 to 5, terms, such as "above", "below", "upper surface", "lower surface", "upper portion", and "lower portion", indicating directions indicate relative directions determined based only on a relative positional relationship of constitutional elements of a loudspeaker, and do not indicate absolute directions, such as a vertical direction.

INDUSTRIAL APPLICABILITY

A loudspeaker according to the present invention reduces distortion, and hence, is applicable to various audio apparatuses.

REFERENCE MARKS IN THE DRAWINGS

21 loudspeaker
21A loudspeaker
21B loudspeaker
22 frame (second frame)
23 magnetic circuit (second magnetic circuit)
23A upper surface
23B lower surface
23C lower plate
23D center pole
23E magnet (second magnet)
23F upper plate
23G canceling magnet
23H insertion hole
23K through-hole
23L rotation stopper
23M through-hole

23P groove
23Q magnetic gap (second magnetic gap)
24 support strut
24A upper end portion
24B lower end portion
24C protrusion
24D through-hole
24E through-hole
25 frame
25P support body
26 flat diaphragm
26A diaphragm body
26B outer edge
26C inner edge
26D honeycomb core
26E skin layer
27 driver body
27A voice coil (second voice coil)
27B bobbin
27C coupling cone
27D adhesive
27E angled portion
28A body portion
28B bent portion
28C flange
28D damper
28E damper
29 terminal
29A lead wire
31A bottom portion
31B threaded hole
31C tubular portion
41 fixing element
41A threaded portion
41B head
41C shaft
41D fitting portion
51 frame (first frame)
51A connecting surface (first connecting surface)
51B connecting surface (second connecting surface)
53 magnetic circuit (first magnetic circuit)
53A yoke
53B magnet (first magnet)
53C upper plate
53D magnetic gap (first magnetic gap)
53E canceling magnet
56 diaphragm
56A diaphragm body
56B edge
56C coupling portion (first coupling portion)
56D roll portion
56E coupling portion (second coupling portion)
56F extension portion
56G flange
56H burrs
56K bent portion
56L bent portion
56M connecting portion (first connecting portion)
56N connecting portion (second connecting portion)
57 voice coil (first voice coil)
57A coil
57B bobbin
59 terminal
59A lead wire
60 ring body
60K angled surface
61 adhesive
62 cap
62A upper plate portion
62B side plate portion
62C extension portion
506 flat diaphragm
507 cell
507A cell side portion
507B cell end portion
508 core substrate
509 adhesive layer
510 skin layer
510A outer circumferential end of skin layer
511 loudspeaker
512 diaphragm
513 voice coil
514 driver cone
515 voice coil
516 outer frame
517 outer edge
518 inner edge
608 flat diaphragm speaker
609 magnetic circuit
610 voice coil
611 coupling cone
612 core substrate
613 skin layer
614 skin layer
615 flat diaphragm
616 cell
617 ventilation aperture
618 edge
701 magnetic circuit
702 magnetic gap
703 magnet
704 yoke
705 yoke
706 magnet
707 voice coil
708 coupling cone
709 flat diaphragm
710 tubular body
711 tube core body
712 plate body
713 flange portion
714 adhesive
716 tubular wall surface
717 cylindrical container
718 damper
719 damper
720 outer frame
721 diaphragm

The invention claimed is:

1. A loudspeaker comprising:

a diaphragm body having a dome portion protruding upward, an extension portion extending downward from an outer circumference of the dome portion, and a bent portion between the dome portion and the extension portion;

a first magnetic circuit disposed below the diaphragm body, the first magnetic circuit having a first magnetic gap;

a first voice coil having a first end portion and a second end portion, the first end portion being inserted into the first magnetic gap, the second end portion being coupled to the extension portion of the diaphragm body;

an edge including a first coupling portion provided at an outer circumference of the edge, a second coupling portion provided at an inner circumference of the edge and coupled to the bent portion of the diaphragm body, and a roll portion disposed between the first coupling portion and the second coupling portion, the edge having a surface facing downward; and a first frame coupled to the edge, wherein the first frame has a first connecting surface disposed below the second coupling portion and coupled to the surface of the edge at the first coupling portion of the edge.

2. The loudspeaker according to claim 1, wherein the second coupling portion is angled with respect to the first coupling portion.

3. The loudspeaker according to claim 1, wherein a peak of the roll portion is located below a straight line extending from an outside of the diaphragm body perpendicularly onto a surface of the diaphragm body.

4. The loudspeaker according to claim 1, wherein the edge includes:

a first connecting portion disposed between the roll portion and the first coupling portion to be connected to the roll portion and the first coupling portion, the first connecting portion having an arcuate shape with a first radius, and a second connecting portion disposed between the roll portion and the second coupling portion to be connected to the roll portion and the second coupling portion, the second connecting portion having an arcuate shape with a second radius larger than the first radius.

5. The loudspeaker according to claim 1, wherein the diaphragm body further has a flange provided at a side of the extension portion opposite to the bent portion.

6. The loudspeaker according to claim 5, wherein the flange has a burr which is formed at a distal end of the flange and which projects in a direction away from the roll portion.

7. The loudspeaker according to claim 5, wherein the flange has a bent portion which is formed at a distal end of the flange and which is bent in a direction away from the roll portion.

8. The loudspeaker according to claim 1, further comprising a ring body having an upper surface and a lower surface which is coupled to the first coupling portion.

9. The loudspeaker according to claim 8, wherein the upper surface of the ring body has an angled surface which is angled such that a distance between the upper surface and the lower surface of the ring body gradually decreases toward an inner circumference of the ring body from an outer circumference of the ring body.

10. The loudspeaker according to claim 9, wherein the angled surface is located below a straight line extending from an outside of the diaphragm body perpendicularly onto a surface of the diaphragm body.

11. The loudspeaker according to claim 1, further comprising:

a second frame having an upper portion and a lower portion;

a second magnetic circuit coupled to the lower portion of the second frame, the second magnetic circuit having a second magnetic gap;

a support body disposed at a center portion of the second magnetic circuit, the first magnetic circuit and the second frame being Fixed to the support body;

a flat diaphragm having an annular shape having an inner circumference and an outer circumference which is connected to the upper portion of the second frame;

a second voice coil having a first end portion and a second end portion, the a first end portion of the second voice coil being coupled to the flat diaphragm, the second end portion of the second voice coil being inserted into the second magnetic gap; and an inner edge connected to the inner circumference of the flat diaphragm and the support body.

12. The loudspeaker according to claim 11, wherein a peak of the inner edge is located below a straight line extending from an outside of the diaphragm body perpendicularly onto a surface of the diaphragm body.

13. The loudspeaker according to claim 11, wherein the support body has a second connecting surface which is coupled to the inner edge and which is disposed below the first connecting surface.

14. The loudspeaker according to claim 11, wherein the inner edge is coupled to a lower surface of the flat diaphragm.

15. The loudspeaker according to claim 11, further comprising a ring body having an upper surface and a lower surface which is coupled to the first coupling portion, wherein a peak of the inner edge is located below a line which passes through a peak of the edge and the upper surface of the ring body.

16. The loudspeaker according to claim 11, further comprising a ring body having an upper surface and a lower surface, wherein the upper surface of the ring body has an angled surface which is angled such that a distance between the upper surface and the lower surface of the ring body gradually decreases toward an inner circumference of the ring body from an outer circumference of the ring body, and wherein a peak of the inner edge is located below a line extending along the angled surface.

17. The loudspeaker according to claim 1, wherein the roll portion is inclined downward from the second coupling portion to the first coupling portion.

* * * * *